US007654819B2

(12) United States Patent
Okada et al.

(10) Patent No.: US 7,654,819 B2
(45) Date of Patent: Feb. 2, 2010

(54) TUBULAR FLAME BURNER AND METHOD FOR CONTROLLING COMBUSTION

(75) Inventors: Kuniaki Okada, Hiroshima (JP); Munehiro Ishioka, Hiroshima (JP); Hitoshi Oishi, Hiroshima (JP); Tatsuya Shimada, Kanagawa (JP); Koichi Takashi, Kanagawa (JP); Yutaka Suzukawa, Tokyo (JP); Yoshiki Fujii, Kanagawa (JP); Takamitsu Kusada, Kanagawa (JP)

(73) Assignee: JFE Steel Corporation, Tokyo (JP)

( * ) Notice: Subject to any disclaimer, the term of this patent is extended or adjusted under 35 U.S.C. 154(b) by 64 days.

(21) Appl. No.: 10/514,668

(22) PCT Filed: Aug. 7, 2003

(86) PCT No.: PCT/JP03/10059

§ 371 (c)(1),
(2), (4) Date: Jan. 4, 2005

(87) PCT Pub. No.: WO2004/025179

PCT Pub. Date: Mar. 25, 2004

(65) Prior Publication Data

US 2005/0106517 A1 May 19, 2005

(30) Foreign Application Priority Data

| | | |
|---|---|---|
| Aug. 9, 2002 | (JP) | 2002-233072 |
| Aug. 9, 2002 | (JP) | 2002-233109 |
| Aug. 15, 2002 | (JP) | 2002-236951 |
| Aug. 15, 2002 | (JP) | 2002-236952 |
| Aug. 15, 2002 | (JP) | 2002-236953 |
| Aug. 15, 2002 | (JP) | 2002-236954 |

(51) Int. Cl.
*F23D 17/00* (2006.01)
*F23D 14/02* (2006.01)
*F23C 3/00* (2006.01)

(52) U.S. Cl. ..... 431/8; 431/350; 431/353; 431/173

(58) Field of Classification Search ..... 431/12, 431/173, 181, 350, 354, 9, 8, 353
See application file for complete search history.

(56) References Cited

U.S. PATENT DOCUMENTS 2,464,791 A * 3/1949 Bonvillian et al. ..... 431/173

(Continued)

FOREIGN PATENT DOCUMENTS

EP 310327 A2 * 4/1989

(Continued)

*Primary Examiner*—Carl D Price
(74) *Attorney, Agent, or Firm*—Frishauf, Holtz, Goodman & Chick, P.C.

(57) ABSTRACT

A tubular flame burner, a combustion method, and combustion controller, are disclosed. Here, the tubular flame burner comprises: a tubular combustion chamber whose h one end is open; fuel-spraying nozzles and oxygen-containing-gas spraying nozzles. The respective nozzle orifices are formed in the inner face of the combustion chamber so that each spraying direction is in a neighborhood of a tangential direction of the inner circumferential wall of the combustion chamber. And an ignition device is disposed at a position r/2 from the tube axis of the combustion chamber (r: the radius of the combustion chamber). The length of the combustion chamber can be adjusted, the tubular flame burner is a multi-stage burner formed of multiple tubular flame burners, and a gap between the inner tube and the outer tube serves as a gas-flow path. A combustion control method for the tubular flame burner is disclosed, wherein on/off of switching valves is controlled so that the spraying speed from each nozzle is maintained in a predetermined range corresponding to the combustion load.

20 Claims, 26 Drawing Sheets

U.S. PATENT DOCUMENTS 3,185,202 A * 5/1965 Mitchell et al. ..... 431/176
3,224,419 A * 12/1965 Lowenstein et al. ..... 122/478
3,490,230 A * 1/1970 Suter et al. ..... 60/39.23
3,732,070 A * 5/1973 Vietorisz ..... 432/214
4,044,553 A * 8/1977 Vaught ..... 60/39.23
4,054,409 A 10/1977 Ando et al.
4,257,760 A * 3/1981 Schuurman et al. ..... 431/158
4,509,912 A * 4/1985 VanBerkum ..... 431/76
4,672,900 A * 6/1987 Santalla et al. ..... 110/264
4,846,671 A * 7/1989 Kwiatek ..... 431/266
4,932,861 A * 6/1990 Keller et al. ..... 431/8
5,000,679 A * 3/1991 Fukuda et al. ..... 431/351
5,009,174 A * 4/1991 Polak ..... 431/9
5,249,955 A * 10/1993 Kuhn et al. ..... 431/265
5,479,781 A * 1/1996 Fric et al. ..... 60/740

FOREIGN PATENT DOCUMENTS

JP 51-133831 * 11/1976
JP 11279659 A * 10/1999
JP 11281015 A * 10/1999
JP 11281018 A * 10/1999
JP 11294734 A * 10/1999
JP 2001141207 A * 5/2001

* cited by examiner

<CONDITIONS>

BURNER DIAMETER: 4 INCHES

NUMBER OF NOZZLES: TWO NOZZLES FOR COKE-OVEN GAS
TWO NOZZLES FOR AIR

AIR RATIO: 1.0 TO 1.2

SPARK VOLTAGE: 8000 V

TUBULAR FLAME BURNER AND METHOD FOR CONTROLLING COMBUSTION

This application is the United States national phase application of International Application PCT/JP2003/010059 filed Aug. 7, 2003.

TECHNICAL FIELD

The present invention relates to a burner included in a furnace or a combustion chamber. The present invention relates to a combustion burner included and used in an industrial furnace or a combustion chamber.

BACKGROUND OF THE INVENTION

In general, an industrial-use gas burner has been known such as a configuration whose flame is formed in front of the tip of a burner. Concerning such a burner, fuel supplied through a fuel-passage and combustion air supplied through an air-passage are sprayed in front of the burner from the nozzle, resulting in forming the turbulence by the sprayed air and fuel.

Accordingly, the combustion flame becomes turbulent, and the partial flame extinction happens. Such partial flame extinction makes the combustion not stable. In order to avoid such a phenomenon as much as possible, nozzle is designed to exhibit the optimal nozzle-flow-velocity so that stable combustion is obtained, which corresponds to the particular heating value and combustion speed of the employed fuel from the thermal perspective and the perspective of fluid dynamics.

In such a case, the stable combustion is done when using the fuel suitable for the designed nozzle. On the other hand, combustion becomes unstable when using other kinds of fuel.

Furthermore, combustion reaction is always performed within a flame that has a certain volume, so the reaction is required to continue for a long period. In such a case, NOx or soot is apt to generate by the reason of the long combustion time. And, the flame has a partial high-temperature region and a low-temperature region, wherein NOx is easy to generate in the high-temperature region, and soot is easy to generate in the low-temperature region.

On the other hand, a tubular flame burner is disclosed in Japanese Unexamined Patent Application Publication No. 11-281015. This publication includes a tubular combustion chamber of which one-end opens and a nozzle for spraying a fuel gas and a nozzle for spraying an oxygen-containing-gas in the neighborhood of the closed end thereof. Here, the nozzle is located, facing in the tangential direction of the inner circumferential wall of the aforementioned combustion chamber.

With the aforementioned tubular flame burner, stable flame is formed in a high-speed swirl within the burner, accordingly combustion is performed with small irregularities in the temperature of a combustion flame. Therefore, no partial high-temperature regions are easy to be formed. Furthermore, stable combustion is achieved even with a low oxygen ratio or air excess ratio. Consequently, the tubular flame burner has the advantage to reduce harmful substances such as NOx or the like, unburned portions of hydrocarbon or the like, and environmental pollutants such as soot and the like, as well as to reduce of the size thereof.

FIG. 8 is explanatory diagrams which show an conventional tubular flame burner, wherein FIG. 8A is a configuration diagram which shows the tubular flame burner, and FIG. 8B is a cross-sectional view taken along line B-B in FIG. 8A. The tubular flame burner includes a tubular combustion chamber 121, whose one end opens for serving as an exhaust vent for an exhaust gas. Furthermore, the tubular flame burner includes long slits on the other end along the tube axis, each of which are connected to one of nozzles 122 for separately supplying a fuel gas and a nozzle for supplying an oxygen-containing-gas.

The nozzles 122 are disposed in a tangential direction of the inner wall of the combustion chamber 121 for spraying the fuel gas and the oxygen-containing-gas so as to form a swirl thereof within the combustion chamber 121. Furthermore, the tip of each nozzle 122 is formed flat with a reduced orifice for spraying the fuel gas and the oxygen-containing-gas at high speed. Note that reference numeral 123 denotes a spark plug.

In the above-mentioned burner having such a configuration, when a mixture gas is ignited, which forms a swirl (such a swirl is generated by the fuel gas and the oxygen-containing-gas sprayed from the nozzles 122), the gas within the combustion chamber 121 is stratified into concentric gas layers with different densities, due to difference in the density of the gas and the centrifugal force. That is to say, a high-temperature and low-density exhaust gas exists close to the axis of the combustion chamber 121, and a high-density unburned gas exists close to the inner wall of the combustion chamber 121 (away from the axis thereof). This state exhibits remarkable stability from the viewpoint of fluid dynamics. In this case, a tube-shaped flame is formed, and the gas flow is stratified into stable layers, thereby forming a film-shaped stable flame. The position of the flame is determined, being influenced by the position, wherein two factors (one is the exhaust gas speed toward the center of the combustion chamber 121 and the other is the flame propagation speed) balance each other in natural process. In FIG. 8A, reference numeral 124 denotes a tube-shaped flame.

Furthermore, an unburned low-temperature gas forms a boundary layer near the inner wall of the combustion chamber. Accordingly, the wall of the combustion chamber 121 is not heated by the direct heat transfer to a degree of a high temperature, resulting in avoiding the thermal loss, which means, preventing the heat from releasing to the outside of the wall. That is to say, the aforementioned burner has the effective advantage on great thermal insulation, thereby maintaining thermal stability of combustion.

The gas within the combustion chamber 121 flows downstream while swirling, and at the same time, the mixture gas around the inner wall continuously burns so as to form a tubular flame. And, a generated exhaust gas flows toward the axis of the combustion chamber 121 so as to be discharged from the open-end.

However, the conventional tubular flame burner having such a configuration happens to have problems as follows. That is to say:

In general, a fuel gas that has a small heating value invites a disadvantage, that is, the range of the air excess ratio is extremely narrow, taking into consideration the usable range for igniting by electronic spark. Therefore, it is extremely difficult to ignite such a fuel without premixing of the fuel gas and the oxygen-containing-gas.

The aforementioned tubular flame burner has the same difficult problem on igniting by the electronic spark due to the limited range of the air excess ratio of the fuel gas and the oxygen-containing-gas suitable for the ignition. Accordingly, it may be a case, the aforementioned tubular flame burner requires a pilot burner.

Furthermore, the conventional tubular flame burner has such problems as the following description.

(1) In particular, in case of using oil fuel or heavy-hydrocarbon fuel such as a propane gas, the free carbon content within the fuel emits light during combustion, resulting in forming a luminous flame. The luminous flame has such a characteristic that the radiation rate is high by himself, resulting in increasing radiation heat from the luminous flame. Accordingly, when the burner having a configuration, whose luminous flame is located in the position capable of viewing from the heated material, the aforementioned burner exhibits high heat transfer efficiency. However, with the aforementioned conventional burner, the fuel sprayed into the furnace does not form a luminous flame, but forms a transparent exhaust gas that has small emissivity due to the complete combustion of the fuel within the combustion chamber. This leads to small heat transfer efficiency of the combustion method with the conventional tubular burner.

(2) With the conventional tubular burner, no soot is generated due to complete combustion of the fuel. Accordingly, the conventional tubular burner is not used in case of requiring soot, for example, such as carburizing steel with high efficiency, for example.

(3) The conventional tubular burner exhibits excellent combustion performance due to complete combustion of the fuel within the combustion chamber, but NOx is easy to be generated.

Furthermore, the conventional tubular flame burner has a configuration, wherein, in order to form a tubular flame, the respective supply nozzles that are flat along the tube axis are connected to the slits extending along the tube axis. (The slits are located in the tubular combustion chamber.) The conventional tubular flame burner is used while spraying the fuel gas and the oxygen-containing-gas into the combustion chamber, simultaneously with forming high-speed swirl of the sprayed fuel gas and the oxygen-containing-gas. Accordingly, the conventional tubular flame burner causes such a problem that relatively high pressure loss happens at the slits. That is to say, in general, the fuel gas and the oxygen-containing-gas are supplied with a constant pressure. Accordingly, there is need to increase the flow of the fuel gas and the oxygen-containing-gas, in case of increasing the combustion load. But in this case, the pressure loss at the slits increases, proportional to the squire value of the flow speed, ending up in a small increase in a combustion load.

Contrarily, when the conventional tubular flame burner having a configuration is used (wherein each slit is formed with an increased cross-sectional area so as to reduce the pressure loss at the slit), the flow speed of the fuel gas and the oxygen-containing-gas remarkably reduce along the tangential direction of the inner wall of the combustion chamber. Such reduction happens in the event that combustion is performed with a small flow of the fuel gas and the oxygen-containing-gas corresponding to a small combustion load. Accordingly, a tube-shaped flame is not formed, leading to such a problem as increased amount of NOx, soot, and the like, generated in the combustion chamber.

As described above, concerning the conventional tubular flame burner, the problem is as follows. In the event that the supply flow of the fuel gas and the oxygen-containing-gas is adjusted corresponding to the change in the combustion load, it may be a case, the flow speed of the fuel gas and the oxygen-containing-gas is out of the range of the suitable flow speed. The suitable flow speed is determined between the flame formation minimal flow speed required for formation of a tube-shaped flame and the permissive maximal flow speed dependent upon the pressure loss, inviting difficulty in stable combustion in a wide range of the combustion load, and resulting in a narrow range of the combustion load suitable for the conventional tubular flame burner.

Furthermore, there is need to further improve the aforementioned conventional tubular flame burner in order to employ fuel with lower heat output so as to improve the practical use.

Accordingly, the present invention has been conceived in order to solve the aforementioned problems of the conventional tubular flame burner. And the present invention has been conceived and studied in order to provide a tubular flame burner having a new flame formation mechanism, wherein various kinds of fuel can be used, wherein combustion is performed in a wide combustion range, and wherein stable combustion is maintained even with a wide range of the change in combustion load. And in the present invention, stable combustion can be performed, and discharge of an environmental pollution substance created due to combustion is prevented.

SUMMARY OF THE INVENTION

The present invention comprises the following devices and methods in order to solve the above-described conventional problems. That is to say:

Firstly, a tubular flame burner comprises:

a tubular combustion chamber having two ends of an open end and a closed end including an ignition device; and fuel-gas spraying nozzles and oxygen-containing-gas spraying nozzles, each orifice of which faces toward the inner face of the combustion chamber so as to spray a fuel gas and an oxygen-containing-gas in a neighborhood of a tangential direction of the inner circumferential wall of the combustion chamber;

wherein the ignition device is disposed at a position between a point of the tube axis extending along the longitudinal direction of the combustion chamber, and a point of an axis away from the tube axis along the cross-sectional direction orthogonal to the longitudinal direction thereof by ½ of the radius thereof.

Secondly, a tubular flame burner comprises:

a tubular combustion chamber wherein the front-end opens; and fuel-gas spraying nozzles and oxygen-containing-gas spraying nozzles, each orifice of which faces toward the inner face of the combustion chamber so as to spray a gas in a neighborhood of a tangential direction of the inner circumferential wall of the combustion chamber, wherein a tube as a component of the combustion chamber, wherein the fuel and the oxygen-containing-gas are discharged from the nozzle orifices of the combustion chamber, is formed of an inner tube and an outer tube for adjusting the length of the combustion chamber by sliding the outer inner face along the outer face of the inner tube.

Thirdly, a tubular flame burner comprises:

a tubular combustion chamber wherein the front-end opens; and fuel-gas spraying nozzles and oxygen-containing-gas spraying nozzles, each orifice of which faces toward the inner face of the combustion chamber, which can spray gas in a neighborhood of a tangential direction of the inner circumferential wall of the combustion chamber, for separately spraying fuel and an oxygen-containing-gas, or spraying a premixed gas, wherein the tubular flame burner is formed of a plurality of the tubular flame burners, and wherein the tubular flame burner is a multi-stage tubular flame burner having a configuration, wherein the rear-end of the tubular flame burner with a greater inner diameter of the combustion chamber is connected to the front-end of the tubular flame burner with a smaller inner diameter of the combustion chamber. In such a way, the multi-stage tubular flame burner is formed.

Fourthly, a tubular flame burner comprises:

a tubular combustion chamber wherein the front-end opens;

fuel-gas spraying nozzles and oxygen-containing-gas spraying nozzles, each orifice of which faces toward the inner face of the combustion chamber, which can spray gas in a neighborhood of a tangential direction of the inner circumferential wall of the combustion chamber; and an outer tube with a longer inner diameter than the outer diameter of the combustion chamber, which covers the combustion chamber;

wherein a gap between the outer face of the combustion chamber and the inner face of the outer tube provides a passage for a fuel gas or an oxygen-containing-gas to pass before supplying these gases to the spraying nozzles.

Fifthly, a combustion controller for a tubular flame burner comprises:

a tubular combustion chamber wherein the front-end opens;

a plurality of fuel-gas spraying nozzles and a plurality of oxygen-containing-gas spraying nozzles, each orifice of which faces toward the inner face of the combustion chamber, for spraying generally toward a tangential direction of the inner circumferential wall of the combustion chamber. Here, these nozzles are disposed along at least one direction of the longitudinal direction and the circumferential direction;

switching valves disposed on supply lines, wherein each of the switching valves are connected to the corresponding one of the nozzles included in the tubular flame burner; and means for controlling on/off of the switching valves so that the spraying speed from the nozzles is maintained in a predetermined range corresponding to the combustion load applied to the tubular flame burner.

Sixthly, a combustion controller for a tubular flame burner comprises:

a tubular flame burner comprising:

a tubular combustion chamber, wherein the front-end opens; and a plurality of nozzles, each orifice of which faces toward the inner face of the combustion chamber, for spraying a premixed gas formed of a fuel gas and an oxygen-containing-gas in a neighborhood of a tangential direction of the inner circumferential wall of the combustion chamber. Here, these nozzles are disposed along at least one direction of the longitudinal direction and the circumferential direction;

switching valves disposed on supply lines each of which are connected to the corresponding one of the nozzles; and control means for controlling on/off of the switching valves so that the spraying speed from the nozzles is maintained in a predetermined range corresponding to the combustion load applied to the tubular flame burner.

Seventhly, a combustion controller for a tubular flame burner comprises:

a tubular flame burner comprising:

a tubular combustion chamber, wherein the front-end opens; and a plurality of fuel-gas spraying nozzles and a plurality of oxygen-containing-gas spraying nozzles, each orifice of which faces toward the inner face of the combustion chamber, for spraying in a neighborhood of a tangential direction of the inner circumferential wall of the combustion chamber;

switching valves disposed on supply lines, wherein the respective switching valves are connected to the corresponding one of the nozzles included in the tubular flame burner;

control means for controlling on/off of the switching valves so that the spraying speed from the nozzles is maintained in a predetermined range corresponding to the combustion load applied to the tubular flame burner;

adjusting means for adjusting the aperture area of each nozzle orifice to be variable; and control means for adjusting the aperture area of each nozzle orifice to be variable by controlling the adjusting means so that the spraying speed from the nozzles is maintained in a predetermined range corresponding to the combustion load applied to the tubular flame burner.

Eighthly, a combustion controller for a tubular flame burner comprises:

a tubular flame burner comprising:

a tubular combustion chamber wherein the front-end opens; and a plurality of fuel-gas spraying nozzles and a plurality of oxygen-containing-gas spraying nozzles, wherein each orifice of the nozzle faces toward the inner face of the combustion chamber, for spraying a premixed gas formed of a fuel gas and an oxygen-containing-gas in a neighborhood of a tangential direction of the inner circumferential wall of the combustion chamber;

switching valves disposed on supply lines, wherein each of the switching valves are connected to the corresponding one of the nozzles included in the tubular flame burner;

control means for controlling on/off of the switching valves so that the spraying speed from the nozzles is maintained in a predetermined range corresponding to the combustion load applied to the tubular flame burner;

adjusting means for adjusting the aperture area of each nozzle orifice to be variable; and control means for adjusting the aperture area of each nozzle orifice to be variable by controlling the adjusting means so that the spraying speed from the nozzles is maintained in a predetermined range corresponding to the combustion load applied to the tubular flame burner.

Ninthly, a combustion control method for a tubular flame burner comprises:

a step for preparing a tubular combustion chamber, wherein the front-end opens, and a plurality of fuel-spraying nozzles and a plurality of oxygen-containing-gas spraying nozzles. Here, each nozzle orifice faces the inner wall of the combustion chamber, disposed along at least one direction of the longitudinal direction and the circumferential direction;

a step for connecting supply lines to the nozzles, and providing switching valves to the supply lines;

a step for adjusting the fuel-spraying nozzles and the oxygen-containing-gas spraying nozzles so that each spraying direction is in a neighborhood of a tangential direction of the inner circumferential wall of the combustion chamber, to control combustion; and a step for controlling on/off of the switching valves so that the spraying speed from the nozzles is maintained in a predetermined range corresponding to the combustion load applied to the tubular flame burner.

Tenthly, a method for controlling a combustion by a tubular flame burner comprising:

a step for preparing a tubular combustion chamber wherein the front-end opens, and for preparing a plurality of nozzles, wherein each nozzle orifice faces the inner wall of the combustion chamber, for spraying a premixed gas formed of a fuel gas and an oxygen-containing-gas and wherein each nozzle orifice is disposed along at least one direction of the longitudinal direction and the circumferential direction;

a step for connecting supply lines to the nozzles, and providing switching valves to the supply lines;

a step for adjusting the fuel-spraying nozzles to be variable and the oxygen-containing-gas spraying nozzles so that each spraying direction is in a neighborhood of a tangential direction of the inner circumferential wall of the combustion chamber, to control combustion; and a step for controlling on/off of the switching valves so that the spraying speed from the nozzles is maintained in a predetermined range corresponding to the combustion load applied to the tubular flame burner.

Eleventh, a method for controlling combustion by a tubular flame burner comprises:

a step for preparing a tubular combustion chamber wherein the front-end opens, and a plurality of fuel-spraying nozzles and a plurality of oxygen-containing-gas spraying nozzles, wherein each nozzle orifice faces the inner wall of the combustion chamber;

a step for connecting supply lines to the nozzles, and for providing switching valves to the supply lines;

a step for adjusting the fuel-spraying nozzles and the oxygen-containing-gas spraying nozzles so that each spraying direction is in a neighborhood of a tangential direction of the inner circumferential wall of the combustion chamber, to control combustion;

a step for controlling on/off of the switching valves so that the spraying speed from the nozzles is maintained in a predetermined range corresponding to the combustion load applied to the tubular flame burner; and a step for adjusting the apertures area of the nozzle orifices so that the spraying speed from the nozzles is maintained in a predetermined range corresponding to the combustion load applied to the tubular flame burner by adjusting means for adjusting the apertures area of the nozzle orifices.

Twelfth, a method for controlling combustion by a tubular flame burner comprises:

a step for preparing: a tubular combustion chamber whose front-end opens, and a plurality of nozzles whose each nozzle orifice faces the inner wall of the combustion chamber, for spraying a premixed gas formed of a fuel gas and an oxygen-containing-gas;

a step for connecting supply lines to the nozzles, and providing switching valves to the supply lines;

a step for adjusting the nozzles so that each spraying direction is in a neighborhood of a tangential direction of the inner circumferential wall of the combustion chamber, to control combustion;

a step for controlling on/off of the switching valves so that the spraying speed from the nozzles is maintained in a predetermined range corresponding to the combustion load applied to the tubular flame burner; and, a step for adjusting the apertures area of the nozzle orifices so that the spraying speed from the nozzles is maintained in a predetermined range corresponding to the combustion load applied to the tubular flame burner by adjusting means for adjusting the apertures of the nozzle orifices.

Thirteenth, a method for controlling combustion by a tubular flame burner comprises:

a step for preparing a tubular combustion chamber whose front-end opens, and whose respective nozzle orifice faces the inner wall of the combustion chamber for separately spraying fuel and an oxygen-containing-gas, or spraying a premixed gas thereof;

a step for preparing a multi-stage tubular flame burner including a plurality of tubular flame burners that have the respective nozzles, wherein each spraying direction is in a neighborhood of a tangential direction of the inner circumferential wall of the combustion chamber, and having a configuration wherein the rear-end of the tubular flame burner with a longer inner diameter of the combustion chamber is connected to the front-end of the tubular flame burner with a shorter inner diameter of the combustion chamber, whereby the single multi-stage tubular flame burner is formed of the plurality of tubular flame burners; and a step for controlling combustion by selecting a tubular flame burner to be used within the plurality of tubular flame burners forming the multi-stage tubular flame burner corresponding to the combustion load.

Fourteenth, a method for controlling combustion by a tubular flame burner comprises:

a step for preparing a tubular combustion chamber formed of an inner tube, and an outer tube disposed along the outer circumferential wall of the inner tube, wherein the front-end opens, and for preparing fuel spraying nozzles and oxygen-containing-gas, wherein each nozzle orifice are formed on the inner face of the combustion chamber;

a step for adjusting the nozzles so that each spraying direction is in a neighborhood of a tangential direction of the inner circumferential wall of the combustion chamber;

a step for adjusting the length of the combustion chamber by sliding the outer tube;

wherein the outer tube has a combustion chamber whose length is long enough to generate the flame in the combustion chamber in order for the furnace temperature to reach a predetermined temperature, and further, the outer tube has a combustion chamber whose length is short enough to generate the flame outside the combustion chamber when the in-furnace temperature exceeds the predetermined temperature.

PREFERABLE EMBODIMENT OF THE INVENTION

FIRST EMBODIMENT

Figure 1:
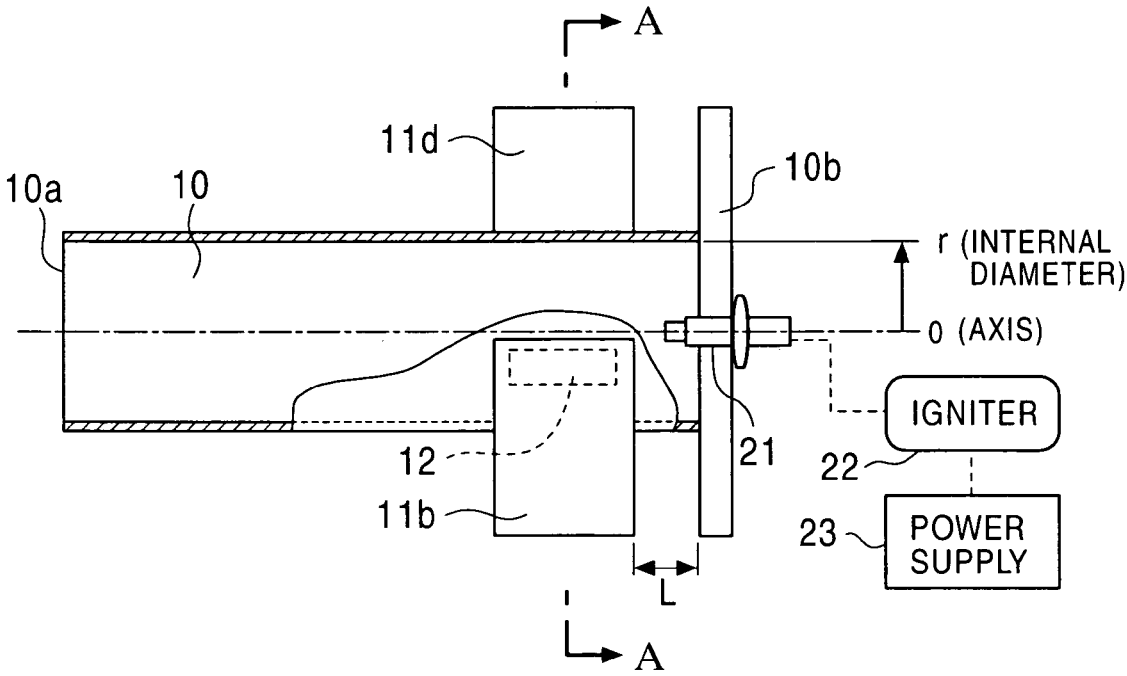
FIG. 1 is a side view of a tubular flame burner according to an embodiment of the present invention.
Figure 2:
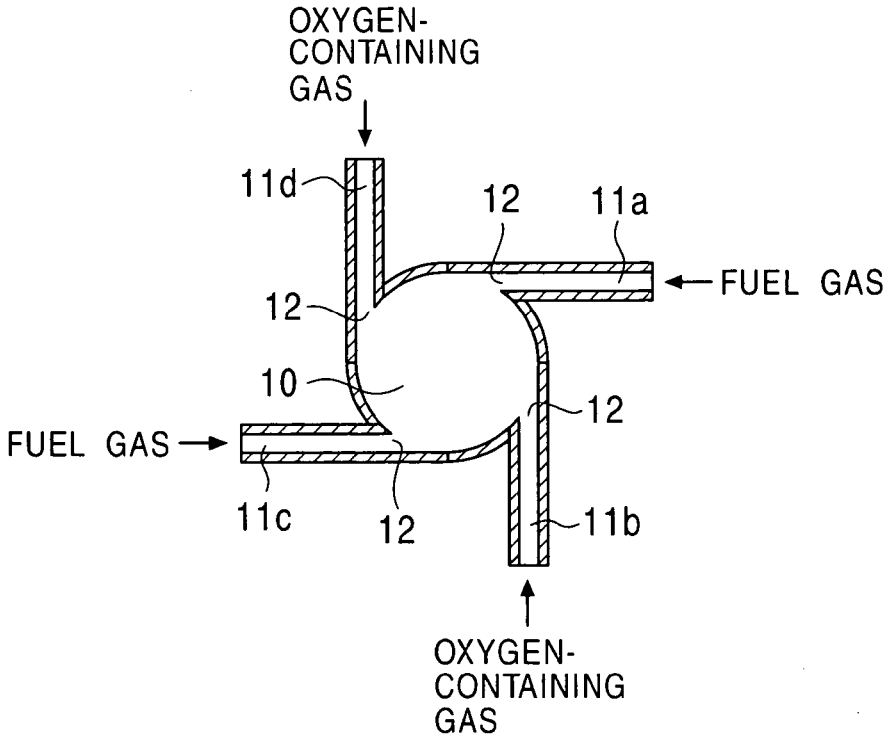
FIG. 2 is a cross-sectional view taken along line A-A in FIG. 1.
Figure 3:
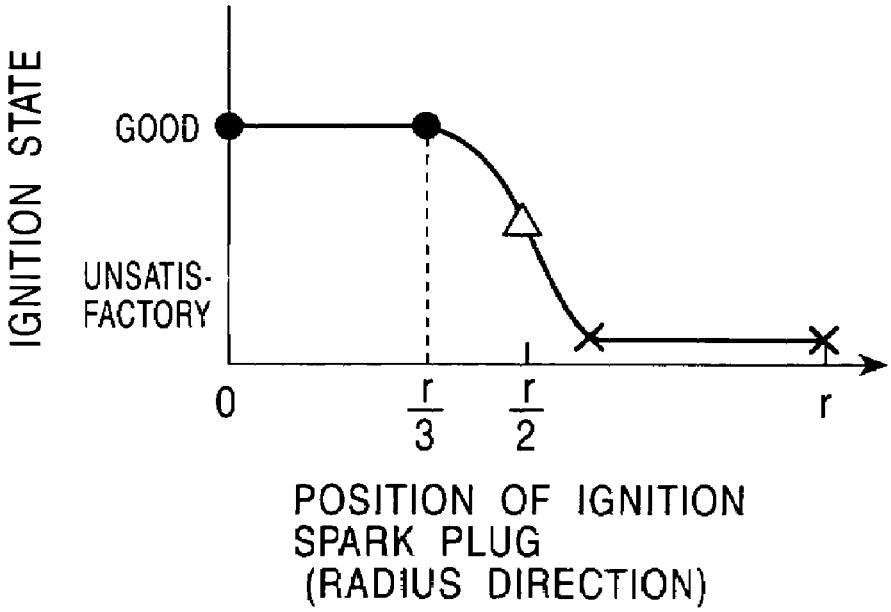
FIG. 3 is an explanatory diagram for describing ignition with a tubular flame burner according to an embodiment of the present invention.

FIG. 1 through FIG. 3 show a first embodiment of the present invention. FIG. 1 is a side view of a tubular flame burner according to the present embodiment, and FIG. 2 is a cross-sectional view taken along line A-A in FIG. 1. FIG. 3 is an explanatory diagram for describing ignition of the tubular burner according to the present embodiment.

In FIG. 1, reference numeral 10 denotes a tubular combustion chamber, wherein the front-end 10*a* opens so as to serve as an exhaust vent for an exhaust-gas. Furthermore, the tubular combustion chamber 10 includes nozzles near the rear-end 10*b* thereof for spraying fuel gas and oxygen-containing-gas into the tubular combustion chamber 10. Furthermore, the tubular combustion chamber 10 includes an ignition spark plug 21 on the rear-end 10*b* thereof for generating a spark within the combustion chamber 10 using an igniter 22 and a power supply 23.

As shown in FIG. 1 and FIG. 2, four long and narrow slits 12 are formed along the tube axis on the circumferential of the tubular combustion chamber 10, serving as nozzles for the combustion chamber 10, wherein the slits 12 are connected to nozzles 11*a*, 11*b*, 11*c*, and 11*d*, formed flat and long and narrow along the tube axis, respectively. These nozzles 11*a*, 11*b*, 11*c*, and 11*d*, are disposed so that each spray direction is in a tangential direction of the inner circumferential wall of the combustion chamber 10 so as to form a swirl in a predetermined direction. Of these four nozzles, the nozzles 11*a* and 11*c* serve as fuel-gas spraying nozzles, and the nozzles 11*b* and 11*d* serve as oxygen-containing-gas spraying nozzles.

That is to say, the fuel-gas spraying nozzles 11*a* and 11*c* spray the fuel gas toward the tangential direction of the inner circumferential wall of the combustion chamber 10 at a high speed, and the oxygen-containing-gas spraying nozzles 11*b* and 11*d* spray the oxygen-containing-gas toward the tangential direction of the inner circumferential wall of the combustion chamber 10 at a high speed, so as to form a swirl while efficiently mixing the fuel gas and the oxygen-containing-gas at a region near the inner circumferential wall of the combustion chamber 10. The mixture gas forming such a swirl is suitably ignited by the ignition spark plug 21 so as to form a tube-shaped flame within the combustion chamber 10. Note that a combustion gas is discharged from the front-end 10*a* of the combustion chamber 10*a*.

Note that the aforementioned oxygen-containing-gas represents a gas for carrying oxygen used for combustion such as air, oxygen, oxygen-enriched air, exhaust mixture gas, or the like.

With the present embodiment, the ignition spark plug 21 is disposed at a position between the tube axis of the combustion chamber 10 and a position away therefrom by r/2 (note that r denotes the radius of the combustion chamber).

FIG. 3 shows the relation between the mounting position of the ignition spark plug 21 along the radius direction of the combustion chamber 10 and the ignition state using the ignition spark plug 21. This illustrates that the combustion chamber 10 including the ignition spark plug 21 at a position between the tube axis and the position away therefrom by r/2 exhibits excellent ignition.

The reason why the flow speed of the swirl of the mixture gas of the fuel gas and the oxygen-containing-gas is relatively small near the tube axis of the combustion chamber 10, thereby effecting a mixture gas in a suitable range, and thereby enabling ignition definitely to be stable.

Thus, the tubular flame burner according to the present embodiment does not require any pilot burner for ignition, thereby reducing the size and costs thereof.

Furthermore, in case that the tubular flame burner has a configuration, that is, a reduced distance L between each of the nozzles 11*a* through 11*d* and the rear-end 10*b* of the combustion chamber 10, in order to further reduce the size thereof, the distance L is insufficient for mixing the fuel gas and the oxygen-containing-gas. Because, it leads to a problem that the region where gas fuel and oxygen-containing fuel are mixed in a suitable range of the air excess ratio may be reduced in the radius direction near the rear-end 10*b* of the combustion chamber 10. Accordingly, the ignition spark plug 21 is preferably disposed at a position between the tube axis and the position away therefrom by r/3. Thus, even in case of the tubular flame burner having such a configuration wherein the nozzles 11*a* through lid are disposed close to the ignition spark plug 21 ($L \approx 0$), excellent ignition can be done in a definite way to be stable.

Note that while description has been made in the present embodiment regarding the arrangement wherein each of the fuel-gas spraying nozzles and the oxygen-containing-gas spraying nozzles are disposed so that each spraying direction matches with the tangential direction of the inner circumferential wall of the combustion chamber, an arrangement according to the present invention is not restricted to the arrangement wherein each spraying direction matches with the tangential direction thereof. It may be a case, an arrangement is made wherein each spraying direction does not match with the tangential direction of the inner circumferential wall of the combustion chamber as long as a swirl of the gas is formed within the combustion chamber.

Furthermore, while description has been made in the present embodiment regarding the arrangement wherein the slits serving as the nozzles for the combustion chamber are disposed along the tube axis, and each slit is connected to the corresponding flat fuel-gas spraying nozzle or oxygen-containing spraying nozzle, an arrangement may be made, wherein multiple small-sized openings forming a nozzle orifice for the combustion chamber are formed along the tube axis, and each nozzle is connected to the corresponding array formed of the small-sized openings for spraying the fuel gas or the oxygen-containing-gas.

Furthermore, description has been made in the present embodiment regarding the arrangement wherein the fuel gas is sprayed, an arrangement may be made wherein liquid fuel is sprayed. Note that kerosene, gas oil, alcohol, A-type heavy oil, or the like, which readily evaporates under relatively low temperature, is suitably employed as the liquid fuel.

Furthermore, description has been made in the present embodiment regarding the arrangement wherein the fuel gas and the oxygen-containing-gas are separately sprayed, an arrangement may be made wherein a mixture gas formed by premixing the fuel gas and the oxygen-containing-gas is sprayed.

In case of the tubular flame burner according to the present embodiment, the ignition spark plug is disposed at a suitable position near the tube axis of the combustion chamber, thereby performing ignition of a mixture gas of the fuel gas and the oxygen-containing-gas within the combustion camber in a definite way to be stable. And furthermore, the tubular flame burner according to the present embodiment requires no ignition pilot burner, thereby reducing the size and costs thereof.

Note that the tubular flame burner according to the present embodiment may be also formed with a polygonal cross-sectional shape rather than round.

SECOND EMBODIMENT

(Embodiment 2-1)

Figure 4:
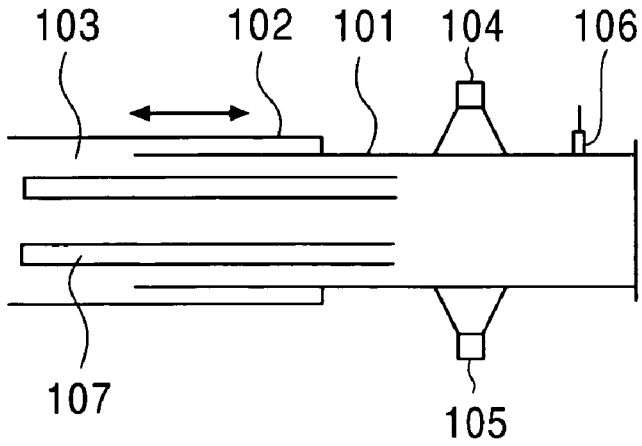
FIG. 4 is a longitudinal cross-sectional view, which shows a tubular flame burner according to an embodiment of the present invention.

Description will be made regarding a second embodiment of the present invention with reference to the drawings. FIG. 4 is a longitudinal cross-sectional diagram, which shows a tubular flame burner according to the present embodiment.

The tubular flame burner comprises a combustion chamber 103 formed of an inner tube 101 of which one end opens, and an outer tube 102 wherein both ends opens, and which can be slid along the outer circumferential wall of the inner tube 101, a fuel-spraying nozzle 104 and an oxygen-containing-gas-spraying nozzle 105, wherein a nozzle orifice of each is formed on the inner face of the inner tube 101 of the aforementioned combustion chamber 103.

Note that the fuel-spraying nozzle 104 and the oxygen-containing-gas-spraying nozzle 105 are connected so that each spraying direction generally matches the tangential direction of the inner circumferential wall of the combustion chamber 103 as viewed in the diameter direction of the combustion chamber 103. Note that the oxygen-containing-gas represents a gas for carrying oxygen used for combustion such as air, oxygen, oxygen-enriched air, exhaust mixture gas, or the like.

With such a configuration, the fuel is sprayed from the fuel-spraying nozzle 104 into the combustion chamber 103 as well as spraying the oxygen-containing-gas from the oxygen-containing-gas-spraying nozzle 105, and ignition is made by the ignition plug 106, whereby a tube-shaped flame is formed along the inner circumferential wall of the inner tube 101 of the combustion chamber 103. The flame thus formed is referred to as a tube-shaped flame 107.

While in general, a tubular flame burner is designed so that combustion of the tube-shaped flame 107 is made within the combustion chamber 103, with the tubular flame burner according to the present invention, a part of the tube-shaped flame 107 can be formed on the outside of the inner tube 101, wherein in the event that the outer tube 102 is slid so as to extend the combustion chamber 103, the entire tube-shaped flame 107 is formed within the combustion chamber 103. And on the other hand, in the event that the outer tube 102 is slid so as to collapse the combustion chamber 103, a part of the tube-shaped flame 107 is formed on the outside of the combustion camber 103.

The lengths of the inner tube 101 and the outer tube 102 may be experimentally determined as well as being theoretically determined.

Figure 5:
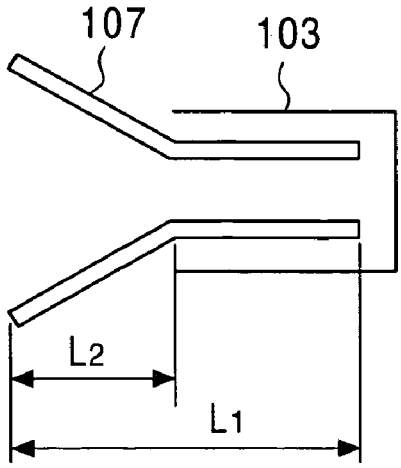
FIG. 5 is a diagram which shows the whole length $L_1$ of the tube-shaped flame formed within the combustion chamber and the length $L_2$ of the tube-shaped flame formed on the inside and the outside of the combustion chamber.
Figure 6:
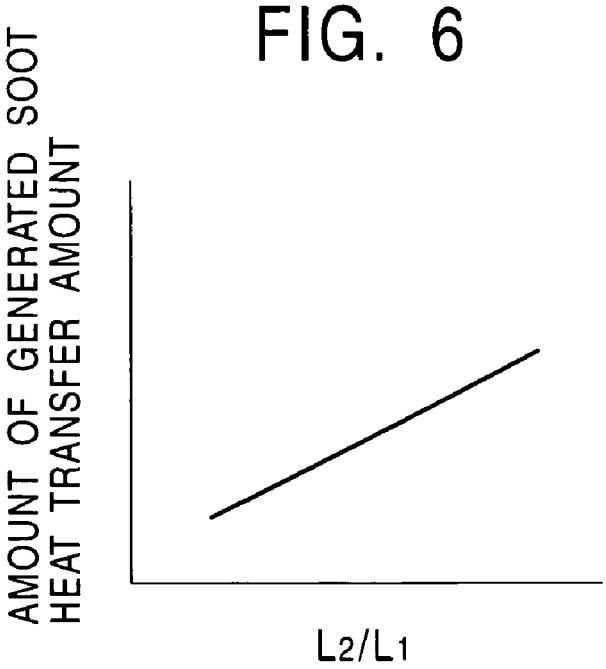
FIG. 6 is a chart, which shows the relation between $L_2/L_1$, the heat transfer amount, and the amount of created soot.

With the entire length of the tube-shaped flame 107 thus formed as $L_1$, and with the length of the tube-shaped flame 107 formed on the outside of the combustion chamber 103 as $L_2$, as shown in FIG. 5, the greater the value $L_2/L_1$ is, the greater the heat transfer amount and the amount of created soot are, as shown in the chart in FIG. 6. The reason why is that the increased $L_2$ causes an increase of the ratio of a luminous flame, and accordingly, the ratio of stable combustion is reduced within the combustion chamber 103 as well as promoting heat transfer to the heated object. This results in such a state that soot is readily generated.

Figure 7:
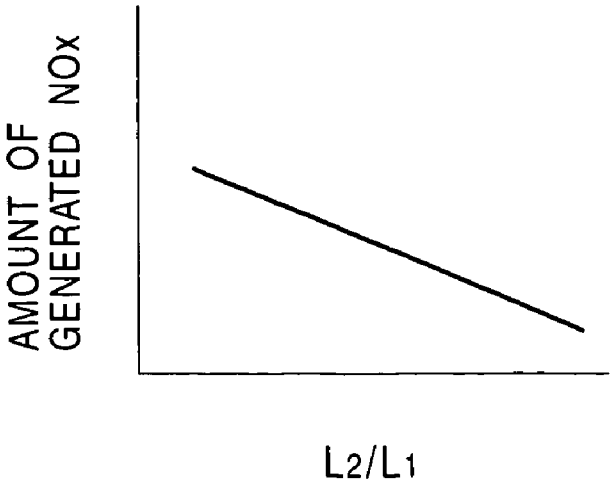
FIG. 7 is a chart, which shows the relation between $L_2/L_1$ and the amount of created $NO_x$.
Figure 8A:
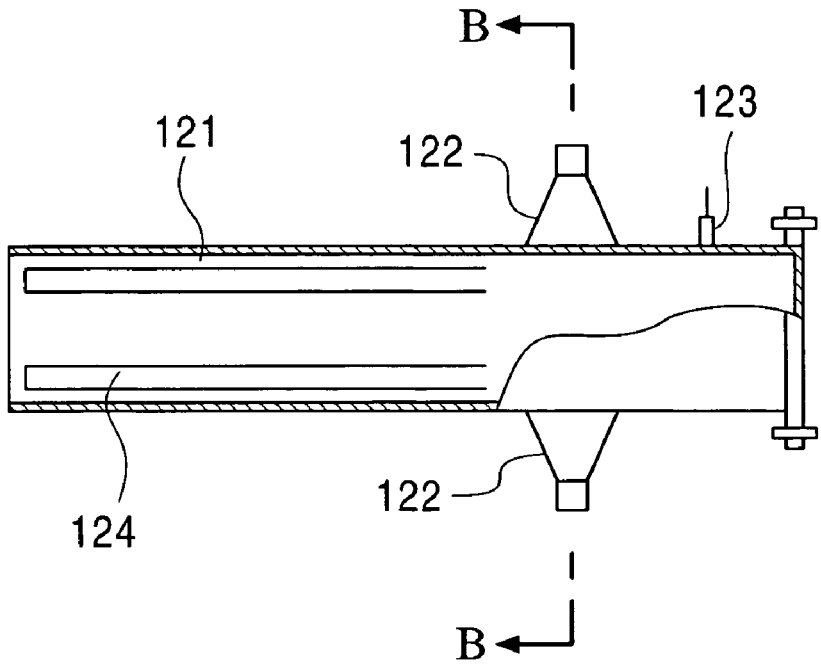
FIG. 8A is an explanatory diagram for describing a conventional tubular flame burner, and is also a configuration diagram of the tubular flame burner.
Figure 8B:
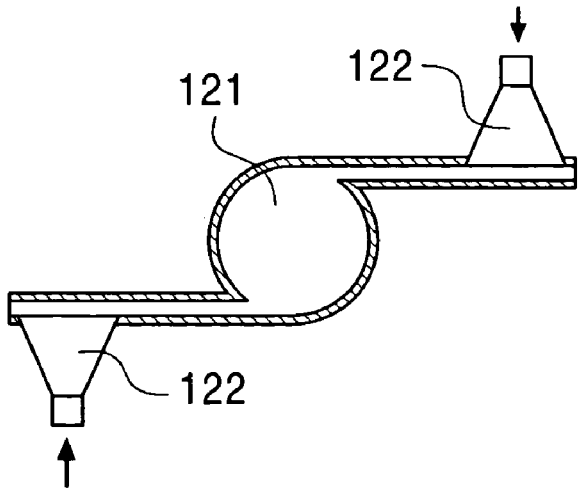
FIG. 8B is a cross-sectional view taken along line B-B in FIG. 8A.

On the other hand, the greater the $L_2/L_1$ is, the smaller the amount of the created NOx as shown in the chart in FIG. 7. The reason why is that increased ratio of combustion on the outside of the combustion chamber 103 within the furnace space leads to dilution-combustion while swirling an exhaust gas within a space on the outside of the combustion chamber 103. Accordingly, the concentration of oxygen is reduced within the combustion space as well as preventing generation of partial high-temperature region, thereby suppressing reaction of creation of thermal NOx, and thereby suppressing the amount of created NOx.

The tubular flame burner according to the present invention controls the heat transfer amount, the amount of created soot, and the amount of the created NOx.

Note that the tubular flame burner according to the present embodiment may be also formed with a polygonal cross-sectional shape rather than round.

(Embodiment 2-2)

Combustion testing was performed using the tubular flame burner according to the present invention.

Figure 9:
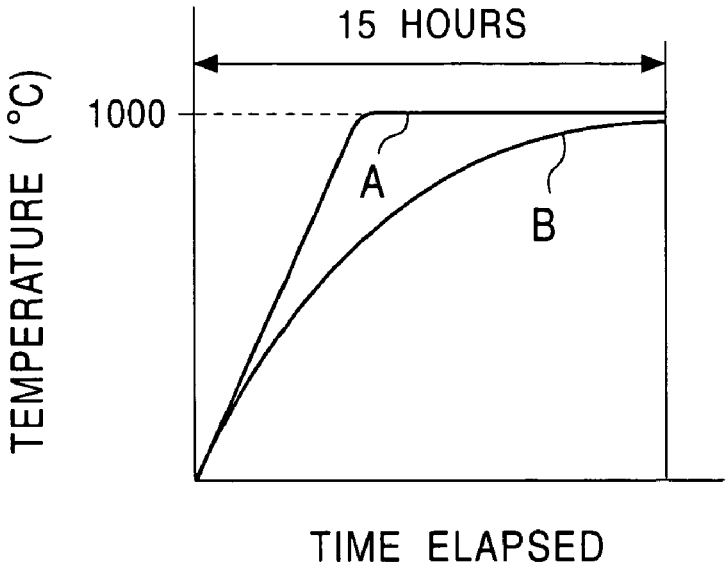
FIG. 9 is a chart, which shows the furnace temperature and the temperature of heated steel over time, obtained from a combustion test according to the present invention.

FIG. 9 is a chart that shows the in-furnace temperature (curve A) and the temperature of steel (curve B) over time, which have been measured in the combustion test. In the aforementioned combustion test, the in-furnace temperature is raised at a constant temperature increase rate to 1000° C., and upon reaching 1000° C., the temperature is maintained at 1000° C. for a total heating time of 15 hours.

Figure 10:
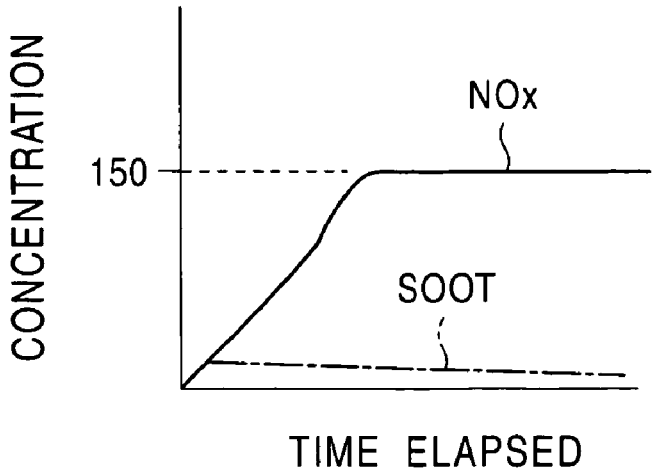
FIG. 10 is a chart, which shows the concentration of $NO_x$ and soot over time, obtained from a combustion test according to the present invention.

First, steel was heated under the condition that the outer circumferential wall (denoted by reference numeral 102 in FIG. 4) was slid toward the inside of the furnace such that $L_2$ shown in FIG. 5 becomes 0 or less, i.e., the flame was formed only within the combustion chamber (first combustion test). FIG. 10 shows concentration of NOx and soot over time obtained in the aforementioned combustion test.

In FIG. 10, an index representation of the concentration thereof is expressed with the permissive value as 100.

In such a case, while only a small amount of soot was generated, the amount of NOx increased up to the concentration of index value 150 over time until the in-furnace temperature reached 1000° C. And the concentration of NOx was maintained to the high concentration of index value 150 after the in-furnace temperature reached 1000° C. Accordingly, it has been revealed that the aforementioned combustion leads to a problem of generating a high NOx.

On the other hand, the measured temperature of the steel after heating for 15 hours was 950° C., which was considerably lower than the determined temperature of 1000° C.

Figure 11:
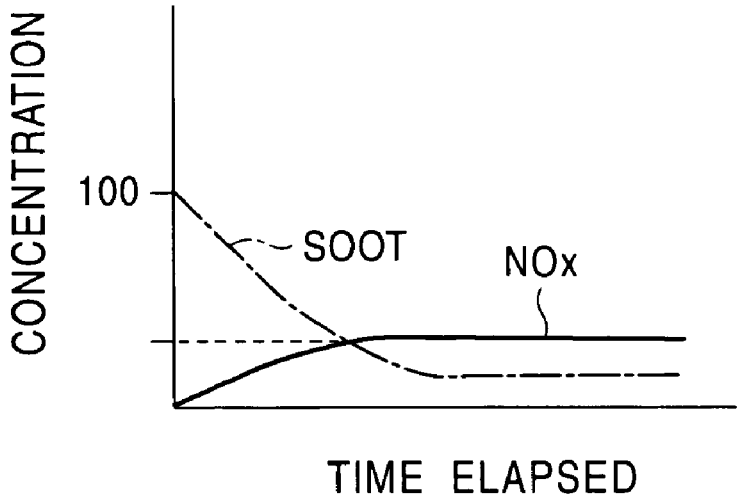
FIG. 11 is a chart, which shows the concentration of $NO_x$ over time according to the present invention.

Next, steel was heated under the same conditions as the first combustion test, except that the outer circumferential wall 102 was slid away from the inside of the furnace such that $L_2$ shown in FIG. 5 exceeds 0, i.e., a part of the flame was formed outside the combustion chamber (the second combustion test). FIG. 11 shows the concentration of NOx and soot over time obtained in the aforementioned combustion test.

In FIG. 11, an index representation of the concentration is made with the permissive values as 100. In the aforementioned combustion, while a somewhat great amount of soot was generated during the temperature-rising step, the amount of the generated soot became small after the in-furnace temperature reached 1000° C., which brings up a little bit problem. On the other hand, the amount of the generated NOx was suppressed to a low level over all the heating steps. That is to say, the combustion in such a case causes no problems to generate NOx, while leading to a small problem of a somewhat great amount of the soot generated in the temperature-rising step.

On the other hand, the measured temperature of the steel after heating for 15 hours was 980° C., which was closer to the determined temperature of 1000° C., compared with the first combustion test. It has been revealed that the second combustion method exhibits more efficient heating of steel than with the first combustion method, except for generating the soot at a low temperature.

Next, steel was heated under the combination of heating conditions for the first and second combustion test. This was done for the in-furnace temperature to be as the same as the second combustion test, that is, after the in-furnace temperature exceeded 800° C., a part of the flame was formed on the outside of the combustion chamber. This resulted in suppressing the amount of the generated soot and NOx to an extent of the permissive values or less. These were done, based on the results from the first and second combustion tests (third combustion test).

Figure 12:
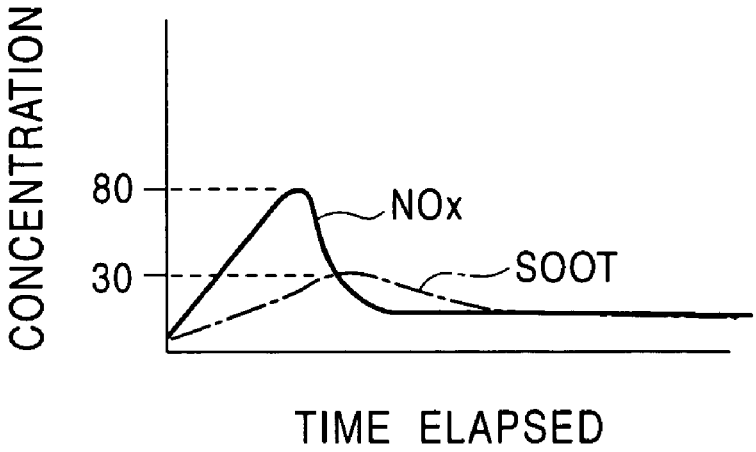
FIG. 12 is a chart, which shows the concentration of soot over time according to the present invention.

FIG. 12 shows concentration of NOx and soot over time obtained in the aforementioned combustion test.

In FIG. 12, an index representation of the concentration thereof is made with the permissive values as 100 in the same way. In the aforementioned combustion, both the amount of the generated soot and that of the generated NOx exists in a stable condition, resulting in suppressing the concentration values to low levels. In such a way, the amount of the generated soot is suppressed to an extent of the concentration value, 30 or less. And the amount of the generated NOx is suppressed to an extent of the concentration value, 80 or less over all the heating steps, whereby excellent heating is achieved.

On the other hand, when the steel temperature was measured after heated for 15 hours, it was 975° C. And it has been revealed that efficient heating was achieved in the third combustion test, while the temperature of steel was somewhat lower than that in the second combustion test.

As described above, it has been revealed that the combustion by a fixed and constant length of the combustion chamber of the tubular flame burner leads to a problem of generating soot at a low in-furnace temperature. And it leads to a problem of generating NOx at a high temperature therein. On the contrary, by adjusting the length of the combustion chamber corresponding to the in-furnace temperature, the steel can be heated in a good and an excellent way.

THIRD EMBODIMENT (Embodiment 3-1)

Figure 13:
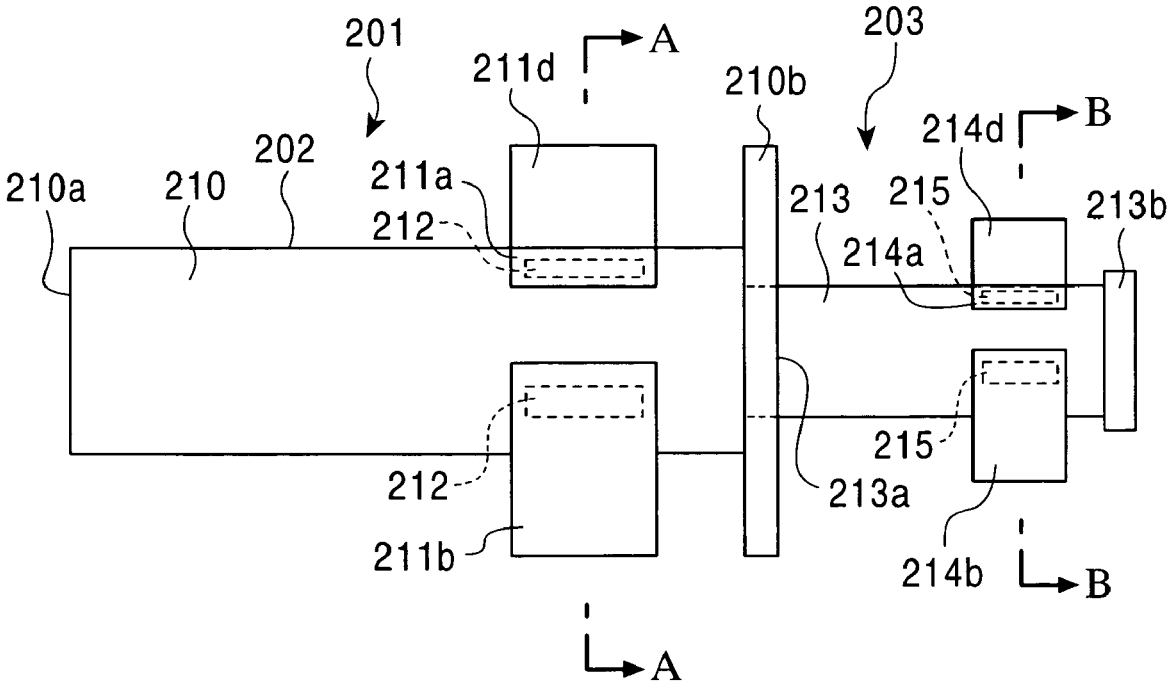
FIG. 13 is a side view of a multi-stage tubular flame burner according to an embodiment of the present invention.
Figure 14A:
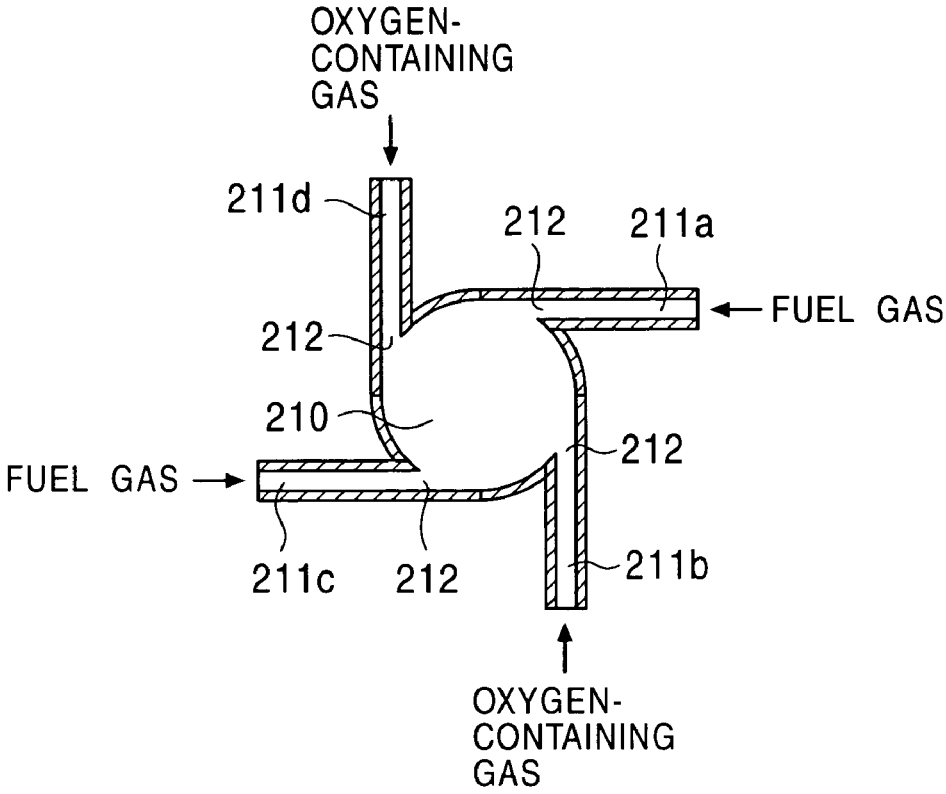
FIG. 14A is a cross-sectional view taken along line A-A in FIG. 13.
Figure 14B:
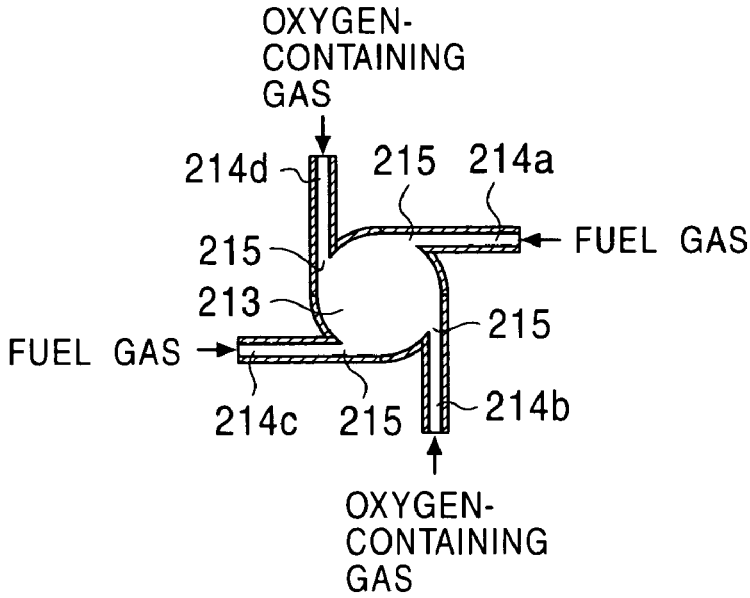
FIG. 14B is a cross-sectional view taken along line B-B in FIG. 13.
Figure 15:
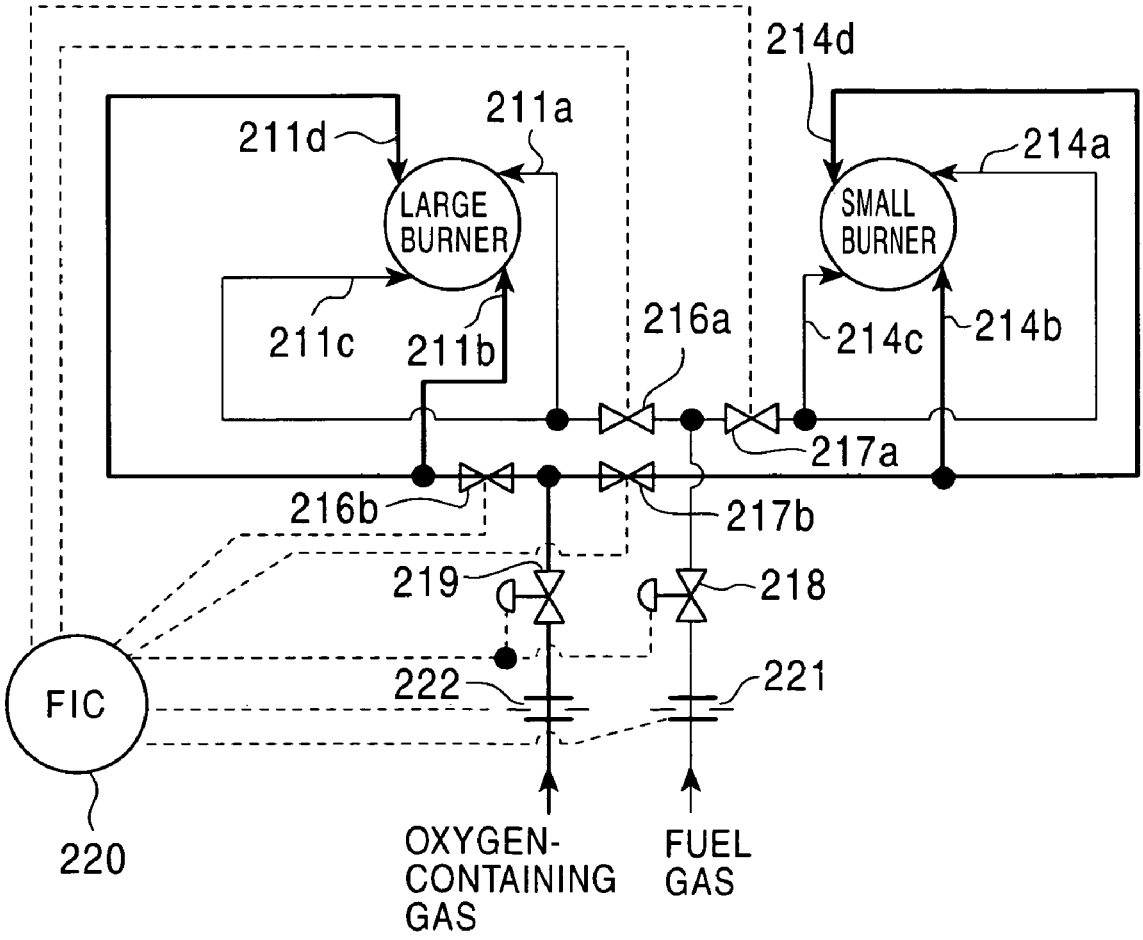
FIG. 15 is an explanatory diagram for describing a combustion control method for a multi-stage tubular flame burner according to an embodiment of the present invention.
Figure 16:
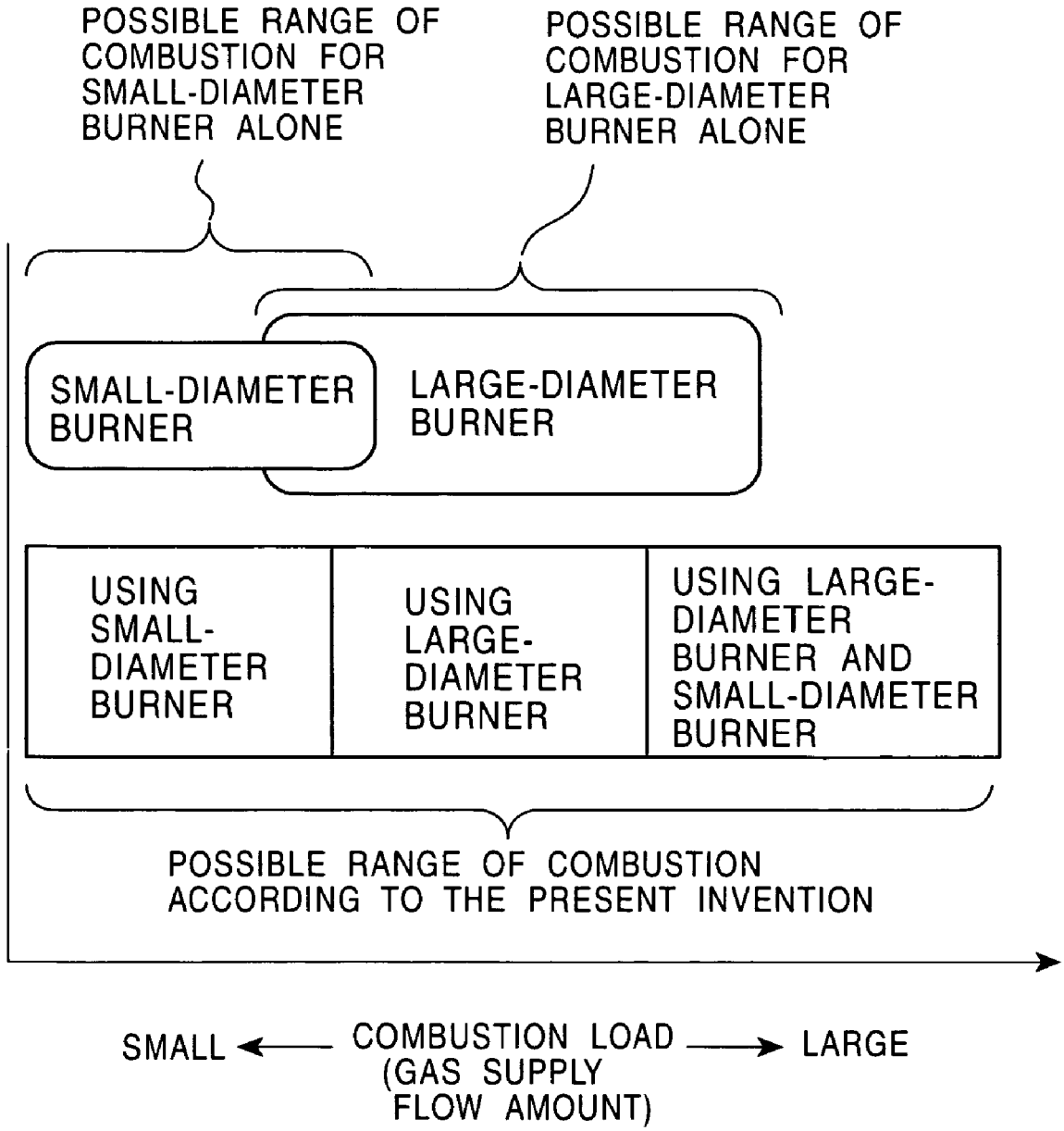
FIG. 16 is an explanatory diagram for describing a combustion control method for a multi-stage tubular flame burner according to an embodiment of the present invention.

FIG. 13 through FIG. 16 show a multi-stage tubular flame burner according to an embodiment of the present invention. FIG. 13 is a side view of the multi-stage tubular flame burner according to the present embodiment. FIG. 14A is a cross-sectional view taken line A-A in FIG. 13. FIG. 14B is a cross-sectional view taken line B-B in FIG. 13. FIG. 15 and FIG. 16 are explanatory diagrams, which describes a method for controlling combustion by the multi-stage tubular flame burner according to the present embodiment.

In FIG. 13, reference numeral 201 denotes the multi-stage tubular flame burner according to the present embodiment. FIG. 13 has such a configuration that a small-diameter flame burner 213 with a small inner diameter is connected to the rear-end of a large-diameter flame burner 202 with a large inner diameter in series, so as to form a single tubular flame burner.

The large-diameter tubular flame burner 202 includes a tubular combustion chamber 210, whose one end 210*a* opens for serving as an exhaust vent for a combustion gas, and nozzles 211*a*, 211*b*, 211*c*, and 211*d*, for separately spraying a fuel gas and an oxygen-containing-gas into the combustion chamber 210. Long and narrow slits 212 are formed at the four parts. Here, the four parts are located on the same single circumference of the combustion chamber 210, and these slits are located at the neighborhood of the rear-end 210*b* of the combustion chamber 210, in order to serve them as nozzle orifices for the combustion chamber 210. And these slits 212 are connected to nozzles 211*a*, 211*b*, 211*c*, and 211*d*, as being formed flat, being long and narrow along the tube axis, respectively. The nozzles 211*a*, 211*b*, 211*c*, and 211*d*, are disposed so that the spraying direction of each is in a tangential direction of the inner circumferential wall of the combustion chamber 210, so as to cause a swirl in a single rotational direction. Of these four nozzles, two nozzles of the nozzles 211*a* and 211*c* serve as fuel-gas-spraying nozzles, and the rested two nozzles of these four nozzles, 211*b* and 211*d* serve as oxygen-containing-gas-spraying nozzles.

The fuel-gas-spraying nozzles 211*a* and 211*c* spray a fuel gas in the tangential direction of the inner circumferential wall of the combustion chamber 210 at a high speed, as well as the oxygen-containing-gas-spraying nozzles 211*b* and 211d spraying an oxygen-containing-gas in the tangential direction of the inner circumferential wall of the combustion chamber 210 at a high speed, so as to form a swirl while efficiently mixing the fuel gas and the oxygen-containing-gas at a region near the inner circumferential wall of the combustion chamber 210. Upon ignition of the mixture gas forming a swirl by an ignition device (not shown) such as an ignition plug, pilot burner, or the like, a tube-shaped flame is formed within the combustion chamber 210. A combustion gas is discharged from the front-end 210*a* of the combustion chamber 210.

On the other hand, as shown in FIG. 13 and FIG. 14B, the small-diameter tubular flame burner 203 includes a tubular combustion chamber 213 having a configuration. Here, the front-end 213*a* is connected to the rear-end 210*b* of the large-diameter tubular flame burner 202, so as to serve as an exhaust vent for a combustion gas, and nozzles 214*a*, 214*b*, 214*c*, and 214*d*, for separately spraying a fuel gas and an oxygen-containing-gas into the combustion chamber 213. Long and narrow slits 215 are formed at the respective four parts, on the same single circumference of the combustion chamber 213. They are located at the neighborhood of the rear-end 213*b* of the combustion chamber 213 for serving as nozzle orifices for the combustion chamber 213. Here, these slits 215 are connected to nozzles 214*a*, 214*b*, 214*c*, and 214*d*, as being flat, long and narrow along the tube axis, respectively. The respective nozzles 214*a*, 214*b*, 214*c*, and 214*d*, are disposed so that the spraying direction of each is in a tangential direction of the inner circumferential wall of the combustion chamber 213, so as to cause a swirl in a single rotational direction. Of these four nozzles, two nozzles, 214*a* and 214*c*, serve as fuel-gas-spraying nozzles, and the rested two nozzles of these nozzles, 214*b* and 214*d*, serve as oxygen-containing-gas-spraying nozzles.

Note that the slits 212 of the large-diameter tubular flame burner 202 are formed with the area of each orifice larger than the slits 215 of the small-diameter tubular flame burner 203 corresponding to a larger inner diameter of the combustion chamber 210 of the large-diameter tubular flame burner 202.

The fuel-gas-spraying nozzles 214*a* and 214*c* spray a fuel gas in the tangential direction of the inner circumferential wall of the combustion chamber 213 at a high speed, as well as the oxygen-containing-gas-spraying nozzles 214*b* and 214*d* spraying an oxygen-containing-gas in the tangential direction of the inner circumferential wall of the combustion chamber 213 at a high speed, so as to form a swirl while efficiently mixing the fuel gas and the oxygen-containing-gas at a region near the inner circumferential wall of the combustion chamber 213. Upon igniting the mixture gas forming a swirl by an ignition device (not shown) such as an ignition plug, pilot burner, or the like, a tube-shaped flame is formed within the combustion chamber 213. A combustion gas is discharged from the front-end 210*a* through the front-end 213*a* of the combustion chamber 213 and the combustion chamber 210 of the large-diameter tubular flame burner 202.

Note that the oxygen-containing-gas represents a gas for carrying oxygen used for combustion such as air, oxygen, oxygen-enriched air, exhaust mixture gas, or the like.

Furthermore, as shown in FIG. 15, an switching valve 216a for switching supply of the fuel gas to the nozzles 211*a* and 211*c* is disposed at a portion on a line for supplying the fuel gas to the fuel-gas-spraying nozzles 211*a* and 211*c* of the large-diameter tubular flame burner 202, and an switching valve 216*b* for switching supply of the oxygen-containing-gas to the nozzles 211*b* and 211*d* is disposed at a portion on a line for supplying the oxygen-containing-gas to the fuel-gas-spraying nozzles 211*b* and 211*d* of the large-diameter tubular flame burner 202. Thus, switching is performed between use and stop of the large-diameter tubular flame burner 202 by switching the switching valves 216*a* and 216*b*.

Furthermore, an switching valve 217*a* for switching supply of the fuel gas to the nozzles 214*a* and 214*c* is disposed at a portion on a line for supplying the fuel gas to the fuel-gas-spraying nozzles 214*a* and 214*c* of the small-diameter tubular flame burner 203, and an switching valve 217*b* for switching supply of the oxygen-containing-gas to the nozzles 214*b* and 214*d* is disposed at a portion on a line for supplying the oxygen-containing-gas to the fuel-gas-spraying nozzles 214*b* and 214*d* of the large-diameter tubular flame burner 203. Thus, switching is performed between use and stop of the small-diameter tubular flame burner 203 by switching the switching valves 217*a* and 217*b*.

Furthermore, a supply controller 220 is provided for controlling on/off of the switching valves 216*a*, 216*b*, 217*a*, and 217*b*, whereby the tubular flame burner to be used is selected for use by the on/off control thereof.

Furthermore, a fuel-gas-flow regulator 218 for adjusting the total flow of the fuel gas to be supplied to the fuel-gas-spraying nozzles 211*a*, 211*c*, 214*a*, and 214*c*, is disposed on a line for supplying the fuel gas, and an oxygen-containing-gas-flow regulator 219 for adjusting the total flow of the oxygen-containing-gas to be supplied to the oxygen-containing-gas-spraying nozzles 211*b*, 211*d*, 214*b*, and 214*d*, is disposed on a line for supplying the oxygen-containing-gas. The supply controller 220 controls the fuel-gas-flow regulator 218 and the oxygen-containing-gas-flow regulator 219 so as to control the total flow of supplied fuel gas and oxygen-containing-gas.

Note that the total supply flow of the fuel gas and the oxygen-containing-gas is measured by a flow-meter 221 for the fuel gas and a flow-meter 222 for the oxygen-containing-gas, and the measurement value is sent to the supply controller 220 so as to be used for adjusting the apertures of the fuel-gas-flow regulator 218 and the oxygen-containing-gas-flow regulator 219.

Description will be made below regarding a method for controlling combustion by the multi-stage tubular flame burner 201 having such a configuration with reference to FIG. 15 and FIG. 16.

With the combustion control method for the multi-stage tubular flame burner, a desired tubular flame burner is selected for combustion from the large-diameter tubular flame burner 202 and the small-diameter tubular flame burner 203 corresponding to the combustion load.

That is to say, each of the large-diameter tubular flame burner 202 and the small-diameter tubular flame burner 203 has a particular possible range of combustion. That is, a particular range of the combustion load, corresponding to the range of supply flow between the minimal flame-formation flow speed required for forming a tubular flame and the maximal permissive flow speed dependent upon the pressure loss. Here, the small-diameter tubular flame burner 203 is formed with a small inner diameter of the combustion chamber and a small aperture area of the slits. Accordingly, it has a possible range of combustion corresponding to a range of a small combustion load, and on the other hand, the large-diameter tubular flame burner 202 is formed with a large inner diameter of the combustion chamber and a large aperture area of the slits, and accordingly has a possible range of combustion corresponding to a range of a relatively large combustion load.

Thus, in case of a small combustion load, the small-diameter tubular flame burner 203 is used. And in the event that the combustion load becomes greater, the large-diameter tubular flame burner 202 is used. And in the event that the combustion load becomes much greater, both the large-diameter tubular flame burner 202 and the small-diameter tubular flame burner 203 are used.

Thus, the multi-stage tubular flame burner according to the present embodiment enables stable combustion to be in a wide range of the combustion load, which is difficult for a single-diameter tubular flame burner.

Note that the tubular flame burner according to the present embodiment may also be formed with a polygonal cross-sectional shape, rather than round.

(Embodiment 3-2)

Next, description will be made regarding another embodiment with reference to FIG. 17.

In the previous embodiment, as shown in FIG. 15, the multi-stage tubular flame burner has a configuration for adjusting the total flow of the fuel gas and the total flow of the oxygen-containing-gas to be supplied to the tubular flame burner that has a large diameter, and/or the tubular flame burner that has a small-diameter. An arrangement according to the present embodiment has a configuration for further adjusting the total flow of the fuel gas and the total flow of the oxygen-containing-gas to be supplied for each of the large-diameter tubular flame burner 210 and the small-diameter tubular flame burner 213.

Figure 17:
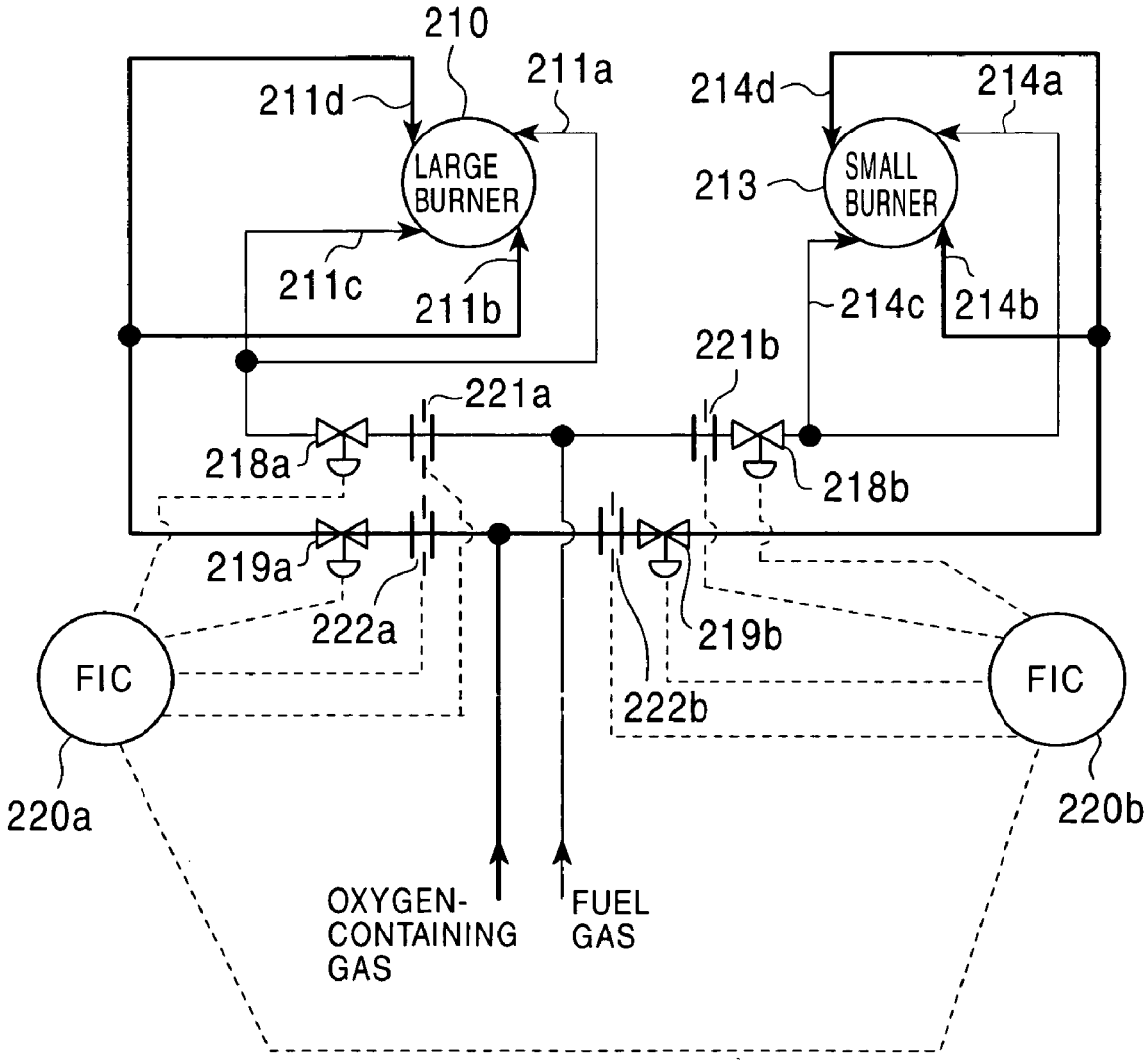
FIG. 17 is an explanatory diagram for describing a combustion control method for a multi-stage tubular flame burner according to an embodiment of the present invention.

That is to say, as shown in FIG. 17, first, a fuel-gas-flow regulator 218*a* for adjusting the flow of the fuel gas to be supplied to the fuel-gas-spraying nozzles 211*a* and 211*c* is provided on a line for supplying the fuel gas to the tubular flame burner 210 that has a large-diameter, and furthermore, an oxygen-containing-gas-flow regulator 219*a* for adjusting the flow of the oxygen-containing-gas to be supplied to the oxygen-containing-gas-spraying nozzles 211*b* and 211*d* is provided on a line for supplying the oxygen-containing-gas to the tubular flame burner that has a large-diameter 210. The supply controller 220*a* adjusts the fuel-gas-flow regulator 218*a* and the oxygen-gas-flow regulator 219*a*, so as to control each of the fuel-gas flow and the oxygen-containing-gas flow to be supplied to the large-diameter tubular flame burner. The supply flow of the fuel gas and the supply flow of the oxygen-containing-gas are measured by a fuel-gas flow-meter 221*a* and an oxygen-containing-gas flow-meter 222*a*, respectively. And the measurement values are sent to the supply controller 220*a*, so as to be used for aperture adjustment of the fuel-gas-flow regulator 218*a* and the oxygen-containing-gas-flow regulator 219*a*.

In the same way, a fuel-gas-flow regulator 218*b* for adjusting the flow of the fuel gas to be supplied to the fuel-gas-spraying nozzles 214*a* and 214*c* is provided on a line for supplying the fuel gas to the small-diameter tubular flame burner 213. And furthermore, an oxygen-containing-gas-flow regulator 219*b* for adjusting the flow of the oxygen-containing-gas to be supplied to the oxygen-containing-gas-spraying nozzles 214*b* and 214*d* is provided on a line for supplying the oxygen-containing-gas to the small-diameter tubular flame burner 213. The supply controller 220*b* adjusts the fuel-gas-flow regulator 218*b* and the oxygen-gas-flow regulator 219*b*, so as to control each of the fuel-gas flow and the oxygen-containing-gas flow to be supplied to the small-diameter tubular flame burner 213. The supply flow of the fuel gas and the supply flow of the oxygen-containing-gas are measured by a fuel-gas flow-meter 221*b* and an oxygen-containing-gas flow-meter 222*b*, respectively. And the measurement values are sent to the supply controller 220*b* so as to be used for aperture adjustment of the fuel-gas-flow regulator 218*b* and the oxygen-containing-gas-flow regulator 219*b*.

The supply controller 220*a* for the large-diameter tubular flame burner 210 and the supply controller b for the small-diameter tubular flame burner 213 are interconnected each other for adjusting the total supply flow of the fuel gas and the oxygen-containing-gas.

In case of a small combustion load, using the multi-stage tubular flame burner having such a configuration and doing the combustion, each of the apertures are adjusted corresponding to the combustion state. (Here, each of the apertures exists between the fuel-gas-flow regulator 218*b* and the oxygen-containing-gas-flow regulator 219*b* of the tubular flame burner 213 that has the small diameter. Here, each of the apertures is determined and adjusted to be zero, wherein the respective apertures exist between the fuel-gas-flow regulator 218*a* and the oxygen-containing-gas-flow regulator 219*a* of the tubular flame burner 210 that has a large-diameter. And, in the event that the combustion load becomes greater, each of the apertures of the fuel-gas-flow regulator 218*a* and the oxygen-containing-gas-flow regulator 219*a* of the large-diameter tubular flame burner 210 are adjusted corresponding to the combustion state. In this case, each of the apertures of the fuel-gas-flow regulator 218*b* is set to be zero, wherein each of the apertures exist between the oxygen-containing-gas-flow regulator 219*b* of the small-diameter tubular flame burner 213. Furthermore, in the event that the combustion load becomes more greater, the apertures of the fuel-gas-flow regulator 218*b* and the oxygen-containing-gas-flow regulator 219*b* of the small-diameter tubular flame burner 213, which have been determined to be zero, open. The fuel-gas-flow regulator 219*b* of the large-diameter tubular flame burner 210 opens corresponding to the combustion load. And concerning the apertures of the fuel-gas-flow regulator 218*a* and the oxygen-containing-gas-flow regulator 219*a* of the large-diameter tubular flame burner 210 and the apertures of the fuel-gas-flow regulator 218*b* and the oxygen-containing-gas-flow regulator 219*b* of the small-diameter tubular flame burner 213, they are as follows. That is, both of the apertures are adjusted respectively, corresponding to the combustion load.

Thus, the multi-stage tubular flame burner according to the present embodiment enables stable combustion to exist within a wide range of the combustion load, which is hard to be applied to a single-diameter tubular flame burner.

Up to now, in the above-described embodiments, description has been made regarding the arrangement that has a configuration so that two tubular flame burners are connected. But, it may be a case, another arrangement is made to have a configuration, wherein three or more tubular flame burners are connected, in accordance with the respective requirements.

Furthermore, description has been made in the above-described embodiments regarding the arrangement, wherein the fuel-gas-spraying nozzles and the oxygen-containing-gas-spraying nozzles are disposed so that each spraying direction is in a tangential direction of the inner circumferential wall of the combustion chamber. However, an arrangement according to the present invention is not always applied to the aforementioned one. It may be a case, an arrangement is applied to that any spraying direction is not in a tangential direction of the inner circumferential wall of the combustion chamber as long as a swirl of a mixture gas is formed within the combustion chamber.

Furthermore, description has been made in the above-described embodiments regarding the arrangement, wherein the slits serving as the nozzles for the combustion chamber are disposed along the tube axis, and wherein each slit is connected to the corresponding flat fuel-gas spraying nozzle or oxygen-containing spraying nozzle. But, it may be a case, an arrangement is applied to that multiple small-sized openings, which serve as a nozzle orifice for the combustion chamber, are formed along the tube axis. And, it may be a case, each nozzle is connected to the corresponding array formed of the small-sized openings for spraying the fuel gas or the oxygen-containing-gas.

Furthermore, description has been made in the present embodiment regarding the arrangement, wherein the fuel gas and the oxygen-containing-gas are separately sprayed. However, it may be a case, an arrangement is applied to another way, that is, a mixture gas formed by premixing the fuel gas and the oxygen-containing-gas is sprayed.

According to the present embodiment, when the multi-stage tubular flame burner is used, a suitable tubular flame burner is used selectively for combustion corresponding to the variable increasing/decreasing combustion load, resulting in making it possible to keep a stable combustion in accordance with a wide range of the combustion load.

The tubular flame burner according to the present embodiment may also be formed with a polygonal cross-sectional shape, rather than round.

FOURTH EMBODIMENT

Figure 18A:
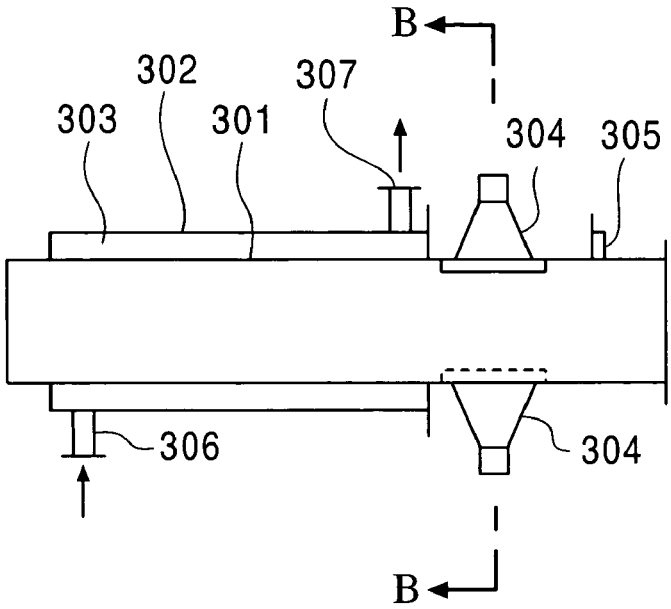
FIG. 18A is an explanatory diagram for describing a tubular flame burner according to an embodiment of the present invention, and is also a configuration diagram of the tubular flame burner.
Figure 18B:
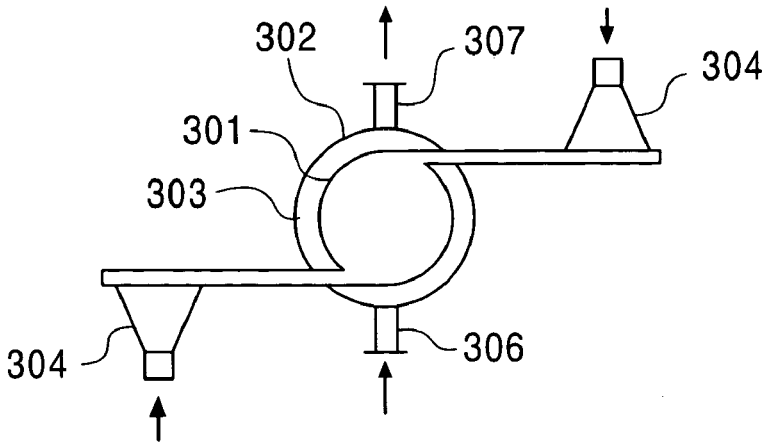
FIG. 18B is an explanatory diagram for describing a tubular flame burner according to an embodiment of the present invention, and is also a cross-sectional view taken along line B-B in FIG. 18A.

Description is made regarding to a tubular flame burner according to the fourth embodiment of the present invention, referencing to the drawings. FIG. 18A is a configuration diagram of the tubular flame burner, and FIG. 18B is a view taken along line B-B in FIG. 18A.

The tubular flame burner includes a tubular combustion chamber 301 whose one-end opens and nozzles 304 for spraying a fuel gas and an oxygen-containing-gas. Here, each nozzle orifice of the nozzles is formed on the inner face of the aforementioned combustion chamber 301. It is disposed so that each spraying direction is in a neighborhood of a tangential direction of the inner circumferential wall of such a configuration that the combustion chamber 301 is combustion chamber 301. And the tubular flame burner has covered with an outer tube 302, which has a greater outer diameter than that of the combustion chamber 301. This is as a role to form a space between the outer face of the combustion chamber 301 and the inner face of the outer tube 302. Here, the space between the outer face and the inner face serves as a flow path 303 for a fuel gas or an oxygen-containing-gas. The path is provided before being supplied to the aforementioned spraying nozzle, as well as forming the combustion chamber 301 with a greater length than that of a tube-shaped flame formed therein.

One end of the combustion chamber 301 opens for serving as an exhaust vent for a combustion exhaust gas. Furthermore, long slits are formed on the other end of the combustion chamber 301 along the tube axis, and are connected to nozzles 304 for separately spraying the fuel gas and the oxygen-containing-gas.

The nozzles 304 are disposed in a neighborhood of a tangential direction of the inner circumferential wall of the combustion chamber 301, so as to form a swirl within the combustion chamber 301 due to spraying of the fuel gas and the oxygen-containing-gas. Note that the tip of each nozzle 304 is formed flat with a reduced orifice area so as to spray the fuel gas and the oxygen-containing-gas at a high speed. Reference numeral 305.denotes an ignition plug.

The outer tube 302 has closed front-end and rear-one. And the outer tube has a configuration, wherein a pipe 306 is connected to a portion on the front-end side of the outer tube 302 for supplying a combustion gas or an oxygen-containing-gas to a space 303 formed between the combustion camber 301 and the outer tube 302.

On the other hand, a pipe 307, connected to one of the aforementioned nozzle 304, is connected to a portion on the rear-end side of the outer tube 302, so as to introduce the preheated fuel gas or oxygen-containing-gas to the nozzle 304. In such a case, when the preheated fuel gas is supplied, the oxygen-containing-gas before having been preheated is supplied to the other nozzle 304 that is disposed thereon. On the other hand, when the preheated oxygen-containing-gas is supplied, the fuel gas before having been preheated is supplied to the other nozzle 304 that is disposed thereon.

The tubular flame burner, according to the present embodiment, has the same configuration as the conventional tubular flame burners, except for the above-described configuration, wherein the fuel gas or the oxygen-containing-gas is preheated, so as to be supplied to the combustion chamber 301. And the tubular flame burner has the same combustion mechanism as the conventional tubular flame burners. Accordingly, detailed description thereof is omitted.

The tubular flame burner according to the present embodiment is formed so that the combustion chamber is longer than a tube-shaped flame formed therewithin. Accordingly, while the front-end of the combustion chamber becomes high temperature due to the combustion gas, the fuel gas or oxygen-containing-gas that has a room temperature cools the combustion chamber. Accordingly, the burner is not damaged due to heat, thereby improving the life span of the burner. Furthermore, with the tubular flame burner according to the present embodiment, the fuel gas or oxygen-containing-gas is preheated, thereby improving combustion performance, and thereby extending a range of kinds of fuel, which can be employed for combustion.

Note that the tubular flame burner according to the present embodiment may also be formed with a polygonal cross-sectional shape rather than round.

EXAMPLES

In order to confirm the effectiveness of the double-tube burner according to the present embodiment, combustion test was performed, using fuel that has a low calorific heating value. Note that combustion test was also performed using a conventional single-tube tubular flame burner as a comparative example (without preheating of the combustion air or fuel). A mixture gas formed of only a blast furnace gas or formed by mixing the blast furnace gas (BFG) with $N_2$ gas or a coke-oven gas (COG) is employed as the aforementioned fuel gas that has a lower calorific heating value than that of the blast furnace gas. Table 1 shows the obtained results.

Note that the fuel gases having the same components were employed in the comparative examples 1 through 3 as in the present examples in Table 1.

TABLE 1

| | | BFG amount $Nm^3/h$ | $N_2$ amount $Nm^3/h$ | COG amount $Nm^3/h$ | Air amount $Nm^3/h$ | Theoretical air amount | Air excess ratio |
|---|---|---|---|---|---|---|---|
| Present examples | 1 | 36.3 | — | — | 35.3 | 0.752 | 1.29 |
| | 2 | 9.9 | 20.7 | 1.5 | 26.9 | 0.455 | 1.84 |
| | 3 | 15.3 | 10.2 | — | 12.9 | 0.451 | 1.12 |
| | 4 | 15.2 | — | — | 13.7 | 0.752 | 1.20 |
| | 5 | 15.0 | 10.0 | — | 13.2 | 0.451 | 1.17 |
| Comparative examples | 1 | 36.3 | — | — | 35.3 | 0.752 | 1.29 |
| | 2 | 9.9 | 20.7 | 1.5 | 26.9 | 0.455 | 1.84 |
| | 3 | 15.3 | 10.2 | — | 12.9 | 0.451 | 1.12 |

| | | Heat amount of fuel | Preheating of fuel or air | Preheating temperature (° C.) Air for combustion | Fuel | Combustion state |
|---|---|---|---|---|---|---|
| Present examples | 1 | 933 | Yes | 363 | Room temperature | Good |
| | 2 | 504 | Yes | 272 | Room temperature | Good |
| | 3 | 560 | Yes | 270 | Room temperature | Good |
| | 4 | 933 | Yes | Room temperature | 263 | Good |
| | 5 | 560 | Yes | Room temperature | 143 | Good |
| Comparative examples | 1 | 933 | No | Room temperature | Room temperature | Good |
| | 2 | 504 | No | Room temperature | Room temperature | unsatisfactory |
| | 3 | 560 | No | Room temperature | Room temperature | unsatisfactory |

Note:
Calorific Value (Heating value) is represented by "kcal/$Nm^3$"

As can be clearly understood from Table 1, in case of combustion of the blast furnace gas, excellent combustion was obtained both in the present example wherein the combustion air has been preheated, and the comparative example 1 wherein the combustion air has not been preheated. But, on the other hand, in case of combustion of a fuel gas with lower heating value than with the blast furnace gas, poor combustion occurred in the comparative examples 2 and 3, wherein the combustion air and the fuel gas have not been preheated. On the contrary, excellent combustion was obtained in the present examples 2 through 5, wherein the combustion air or the fuel gas has been preheated.

Note that examples of the fuel gases with low heat output used in the present examples 2 and 3 include an exhaust gas from a reducing atmosphere furnace or a non-oxidizing atmosphere furnace. Such an untreated exhaust gas cannot be discharged prohibited. Therefore, the exhaust gas is burned with a dedicated combustion furnace so as to be discharged into the air. From such a viewpoint, the present embodiment has such an advantage that double-tube tubular flame furnace enables combustion to be made using such an exhaust gas as a fuel gas without requiring a special dedicated combustion furnace.

FIFTH EMBODIMENT

(Embodiment 5-1)

Figure 19:
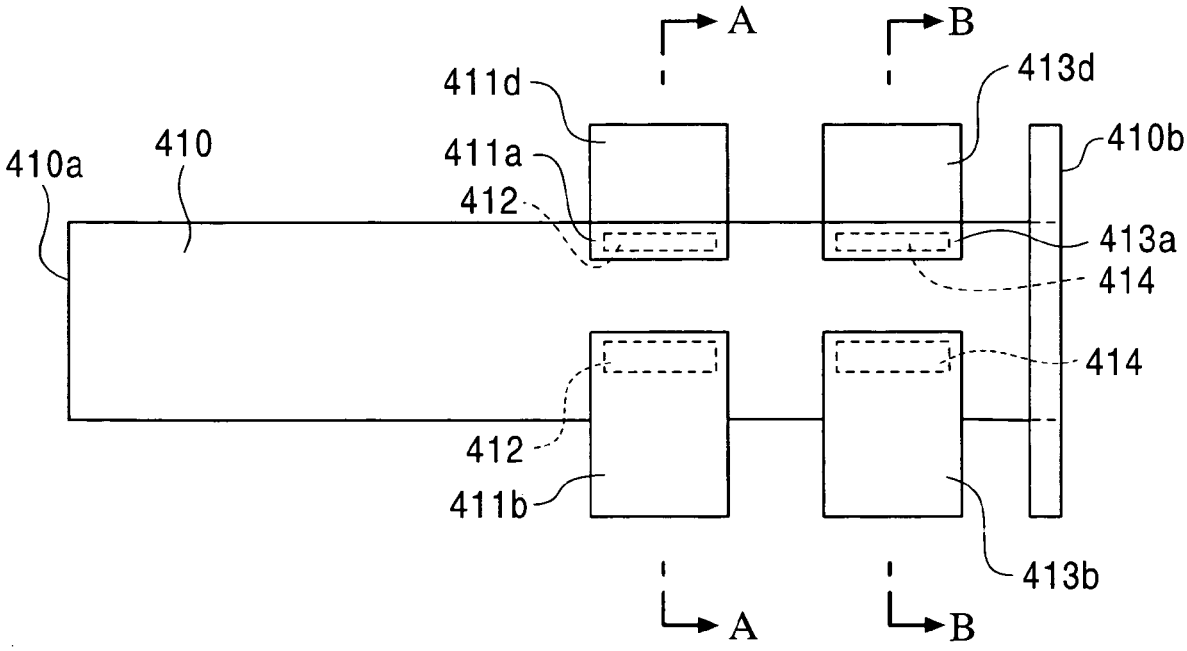
FIG. 19 is a side view of a tubular flame burner according to an embodiment of the present invention.
Figure 20A:
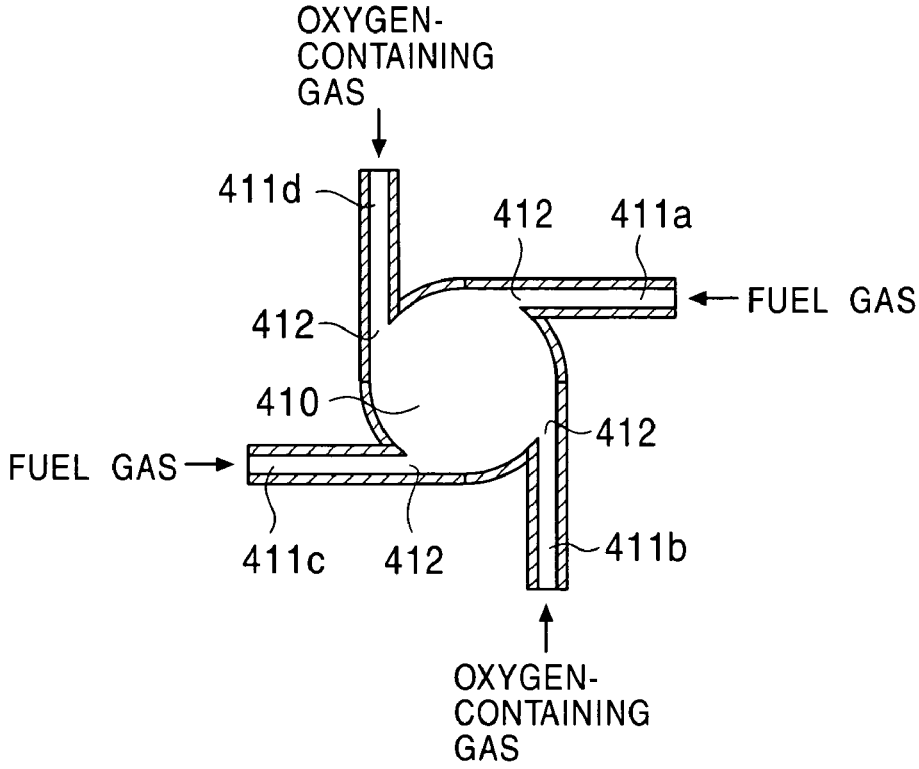
FIG. 20A is a cross-sectional view taken along line A-A in FIG. 19.
Figure 20B:
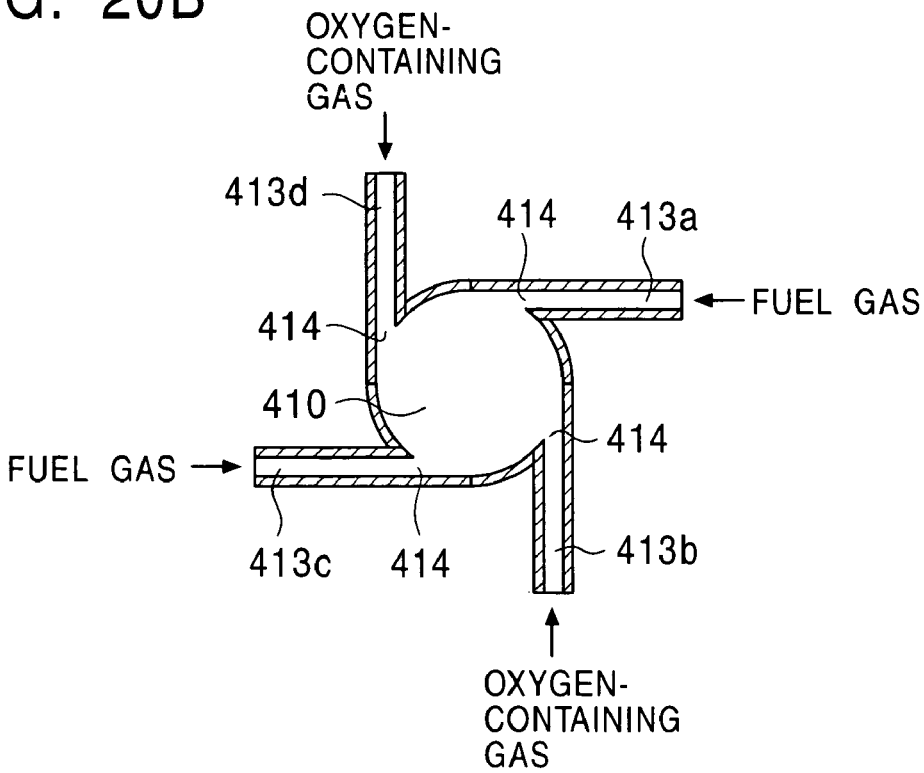
FIG. 20B is a cross-sectional view taken along line B-B in FIG. 19.
Figure 21:
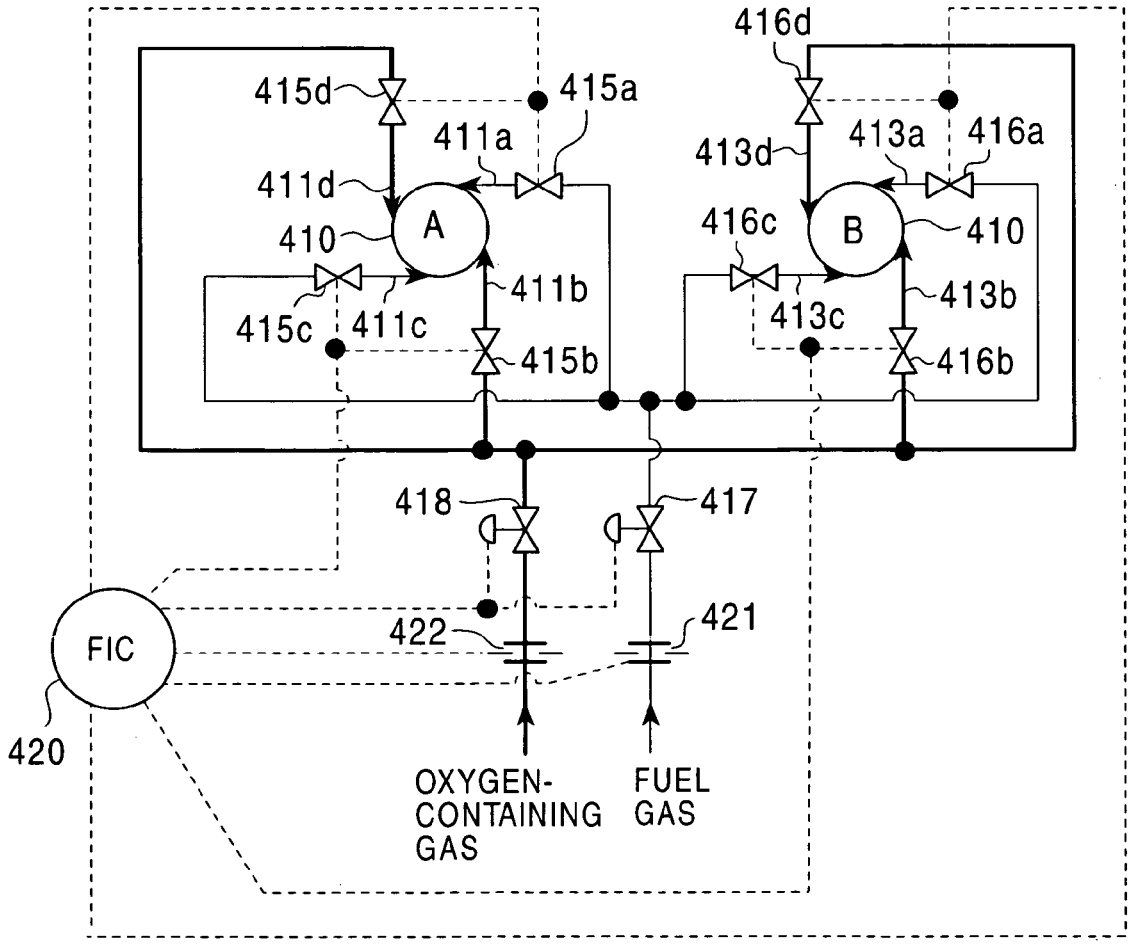
FIG. 21 is an overall configuration diagram, which shows a combustion controller for a tubular flame burner according to an embodiment of the present invention.

FIG. 19 through FIG. 22 show an embodiment 5-1 according to the present invention. FIG. 19 is a side view of a tubular flame burner according to the present embodiment, FIG. 20A is a cross-sectional view taken along line A-A in FIG. 19, and FIG. 20B is a cross-sectional view taken along line B-B in FIG. 19. FIG. 21 is an overall configuration diagram of a combustion controller for the tubular flame burner according to the present embodiment, and FIG. 22 is an explanatory diagram for describing a combustion control method for the tubular flame burner according to the present embodiment.

In FIG. 19, reference numeral 410 denotes a tube-shaped combustion chamber, wherein the front-end 410*a* opens so as to serve as an exhaust vent for a combustion exhaust gas. Furthermore, the combustion chamber 410 includes two nozzle-mounting portions A and B on the side of the rear-end 410*b* along the tube axis for mounting nozzles for spraying a fuel gas to the combustion chamber 410, and nozzles for spraying an oxygen-containing-gas thereto.

At the nozzle-mounting portion A, four long and narrow slits 412 extending along the tube axis are formed along the circumferential wall of the combustion chamber 410 so as to serve as nozzles for the combustion chamber 410. And these slits are connected to nozzles 411*a*, 411*b*, 411*c*, and 411*d*, formed flat, and long and narrow along the tube axis, respectively, as shown in FIG. 19 and FIG. 20A. The nozzles 411*a*, 411*b*, 411*c*, and 411*d*, are disposed so that each spraying direction is in a tangential direction of the inner circumferential wall of the combustion chamber 410 so as to cause a swirl to be in a predetermined rotational direction. Of these four nozzles, the nozzle 411*a* and the nozzle 411*c* serve as fuel-gas-spraying nozzles, and the nozzle 411*b* and the nozzle 411*d* serve as oxygen-containing-gas spraying nozzles.

The fuel gas is sprayed from the fuel-gas spraying nozzles 411*a* and 411*c* in the tangential direction of the inner circumferential wall of the combustion chamber 410 at a high speed. Such a procedure is as well as spraying the oxygen-containing-gas from the oxygen-containing-gas spraying nozzles 411*b* and 411*d* in the tangential direction of the inner circumferential wall of the combustion chamber 410 at a high speed. This results in forming a swirl while efficiently mixing the fuel gas and the oxygen-containing-gas at a region near the inner circumferential wall of the combustion chamber 410. Upon ignition of the mixture gas forming a swirl by an ignition device (not shown) such as an ignition plug, pilot burner, or the like, a tube-shaped flame is formed within the combustion chamber 410.

In the same way, at the nozzle-mounting portion B, four long and narrow slits 414 extending along the tube axis are formed along the circumferential wall of the combustion chamber 410 so as to serve as nozzles for the combustion chamber 410. These nozzles are connected to nozzles 413*a*, 413*b*, 413*c*, and 413*d*, formed flat, and long and narrow along the tube axis, respectively, as shown in FIG. 19 and FIG. 20B. The nozzles 413*a*, 413*b*, 413*c*, and 413*d*, are disposed so that each spraying direction is in a tangential direction of the inner circumferential wall of the combustion chamber 410 so as to cause a swirl to be in a predetermined rotational direction. Of these four nozzles, the nozzle 413*a* and the nozzle 413*c* serve as fuel-gas-spraying nozzles, and the nozzle 413*b* and the nozzle 413*d* serve as oxygen-containing-gas spraying nozzles.

The fuel gas is sprayed from the fuel-gas spraying nozzles 413*a* and 413*c* in the tangential direction of the inner circumferential wall of the combustion chamber 410 at a high speed. This procedure is done as well as spraying the oxygen-containing-gas from the oxygen-containing-gas spraying nozzles 413*b* and 413*d* in the tangential direction of the inner circumferential wall of the combustion chamber 410 at a high speed, so as to form a swirl while efficiently mixing the fuel gas and the oxygen-containing-gas at a region near the inner circumferential wall of the combustion chamber 410. Upon ignition of the mixture gas forming a swirl by an ignition device (not shown) such as an ignition plug, pilot burner, or the like, a tube-shaped flame is formed within the combustion chamber 410.

As described above, the tubular flame burner according to the present embodiment includes two nozzle sets along the tube axis. Each of these ones are formed of two fuel-gas-spraying nozzles and two oxygen-containing-gas spraying nozzles along the circumference of the tube, i.e., the tubular flame burner according to the present embodiment includes four fuel-gas-spraying nozzles and four oxygen-containing-gas spraying nozzles.

Note that the oxygen-containing-gas represents a gas for carrying oxygen used for combustion such as air, oxygen, oxygen-enriched air, exhaust mixture gas, or the like.

Furthermore, as shown in FIG. 20, switching valves 415*a*, 415*c*, 416*a*, and 416*c*, for controlling on/off of the fuel gas to the nozzles 411*a*, 411*c*, 413*a*, and 413*c*, respectively, are disposed on lines for supplying the fuel gas to the fuel-gas spraying nozzles 411*a*, 411*c*, 413*a*, and 413*c*, respectively. And switching valves 415*b*, 415*d*, 416*b*, and 416*d*, for controlling on/off of the oxygen-containing-gas to the nozzles 411*b*, 411*d*, 413*b*, and 413*d*, respectively, are disposed on lines for supplying the oxygen-containing-gas to the oxygen-containing-gas spraying nozzles 411*b*, 411*d*, 413*b*, and 413*d*, respectively.

Furthermore, a supply controller 420 is provided for controlling on/off of the switching valves 415*a*, 415*b*, 415*c*, 415*d*, 416*a*, 416*b*, 416*c*, and 416*d*, so as to select desired nozzles for spraying the fuel gas and the oxygen-containing-gas to the combustion chamber 410.

Furthermore, the line for supplying the fuel gas includes a fuel-gas-flow regulator 417 for adjusting the total supply flow of the fuel gas to be supplied to the fuel-gas-spraying nozzles 411*a*, 411*c*, 413*a*, and 413*c*, and on the other hand, the line for supplying the oxygen-containing-gas includes an oxygen-containing-gas-flow regulator 418 for adjusting the total supply flow of the oxygen-containing-gas to be supplied to the oxygen-containing-gas-spraying nozzles 411*b*, 411*d*, 413*b*, and 413*d*. The supply controller 420 adjusts the fuel-gas-flow regulator 417 and the oxygen-containing-gas-flow regulator 418 so as to control each entire flow of the fuel gas and the oxygen-containing-gas to be supplied according to the combustion load. That is to say, in case of small combustion load, the apertures of the fuel-gas-flow regulator 417 and the oxygen-containing-gas-flow regulator 418 are reduced so as to reduce the total supply flow thereof. And on the other hand, in case of a great combustion load, the apertures of the fuel-gas-flow regulator 417 and the oxygen-containing-gas-flow regulator 418 are increased so as to increase the total supply flow thereof.

A fuel-gas flow-meter 421 and an oxygen-containing-gas flow-meter 422 measure each of total supply flow of the fuel gas and the oxygen-containing-gas. And the measured values are sent to the supply controller 420 so as to be used for adjusting the apertures of the fuel-gas-flow regulator 417 and the oxygen-containing-gas-flow regulator 418.

Description will be made regarding a combustion control method for the tubular flame burner using the combustion controller having such a configuration with reference to FIG. 21 and FIG. 22.

In the method for controlling the combustion by the tubular flame burner, the number of nozzles used for spraying the fuel gas and the oxygen-containing-gas to the combustion chamber 410 is determined according to the combustion load so that the fuel gas and the oxygen-containing-gas are sprayed at an initial flow speed in a range between the maximal permissive flow speed Vp dependent upon the pressure loss and the minimal flow speed Vq required for forming a tube-shaped flame.

Figure 22A:
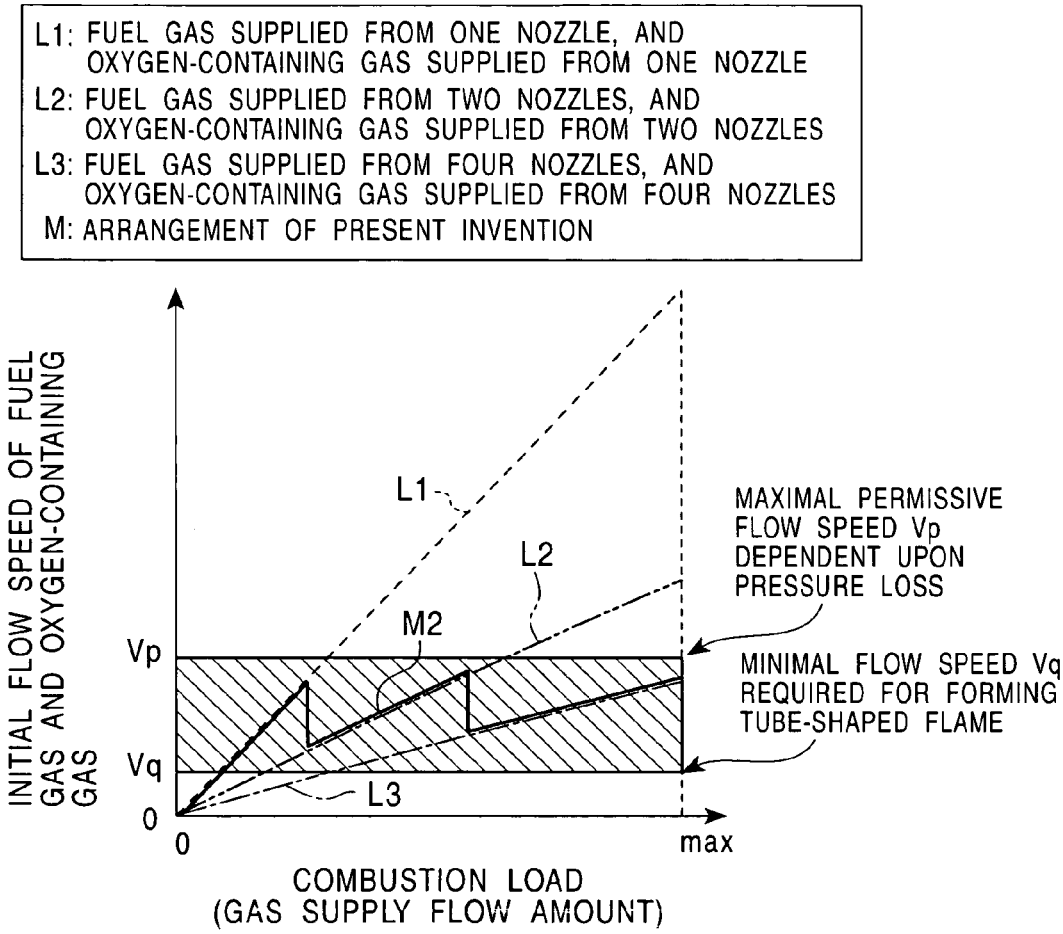
FIG. 22A is an explanatory diagram for describing a combustion control method according to an embodiment of the present invention.

That is to say, when increasing each total supply flow of the fuel gas and the oxygen-containing-gas sprayed to the combustion chamber 410 according to the combustion load, in case that the switching valve 415a opens while closing the other three switching valves 415*c*, 416*a*, and 416*c*, for spraying the fuel gas from only the fuel-gas-spraying nozzle 411*a*, and the switching valve 415*b* opens while closing the other three switching valves 415*d*, 416*b*, and 416*d*, for spraying the oxygen-containing-gas from only the oxygen-containing-gas-spraying nozzle 411*b*, all the supplied fuel gas flow is concentrated at the single fuel-gas spraying nozzle 411*a* while concentrating all the supplied oxygen-containing-gas flow at the single oxygen-containing-gas-spraying nozzle 411*b*, and accordingly, the initial flow speed from the spraying nozzles 411*a* and 411*b* is rapidly increased over the increased total supply flow, i.e., increased combustion load, as shown by the line $L_1$ in FIG. 22A. As a result, while the flow speed rapidly reaches the minimal flow speed Vq required for forming a tube-shaped flame, the flow speed rapidly exceeds the maximal permissive flow speed Vp dependent upon the pressure loss.

On the other hand, in case that the two switching valves 415*a* and 415*c* open while closing the other two switching valves 416*a*, and 416*c*, for spraying the fuel gas from the two fuel-gas-spraying nozzles 411*a* and 411*c*, and in case that the switching valves 415*b* and 415*d* open while closing the other two switching valves 416*b* and 416*d*, for spraying the oxygen-containing-gas from the two oxygen-containing-gas-spraying nozzle 411*b* and 411*d*, the supplied fuel gas flow is divided into two halves so as to be sprayed from the two fuel-gas spraying nozzles 411*a* and 411*c*, respectively, and the supplied oxygen-containing-gas flow is divided into two halves so as to be sprayed from the two oxygen-containing-gas spraying nozzles 411*b* and 411*d*, respectively. Accordingly, the initial flow speed from the spraying nozzles relatively gently increase over the increased total supply flow, i.e., increased combustion load, as shown by the line $L_2$ in FIG. 22A. Specifically, in this case, the flow speed increases over the combustion load with a half ratio as compared with a case of using a single nozzle 411*a* for spraying the fuel gas and a single nozzle 411*b* for spraying the oxygen-containing-gas. As a result, while the flow speed relatively slowly reaches the minimal flow speed Vq required for forming a tube-shaped flame, the flow speed relatively slowly exceeds the maximal permissive flow speed Vp dependent upon the pressure loss.

Furthermore, in a case that all the four switching valves 415*a*, 415*c*, 416*a*, and 416*c*, open for spraying the fuel gas from the four fuel-gas-spraying nozzles 411*a*, 411*c*, 413*a*, and 413*c*, while opening all the four switching valves 415*b*, 415*d*, 416*b*, ad 416*d*, for spraying the oxygen-containing-gas from the four oxygen-containing-gas-spraying nozzle 411*b*, 411*d*, 413*b*, and 413*d*, the supplied fuel gas flow is divided into four quarters so as to be sprayed from the four fuel-gas spraying nozzles 411*a*, 411*c*, 413*a*, and 413*c*, respectively, and the supplied oxygen-containing-gas flow is divided into four quarters so as to be sprayed from the four oxygen-containing-gas spraying nozzles 411*b*, 411*d*, 413*b*, and 413*d*, respectively. Accordingly, the initial flow speed from the spraying nozzles extremely gently increases over the increased total supply flow, i.e., the increased combustion load as shown by the line $L_3$ in FIG. 17A. Specifically, in this case, the flow speed increases over the combustion load with a quarter ratio as compared with a case of using a single nozzle 411*a* for spraying the fuel gas and a single nozzle 411*b* for spraying the oxygen-containing-gas. As a result, while the flow speed considerably slowly reaches the minimal flow speed Vq required for forming a tube-shaped flame, the flow speed considerably slowly exceeds the maximal permissive flow speed Vp dependent upon the pressure loss.

Figure 22B:
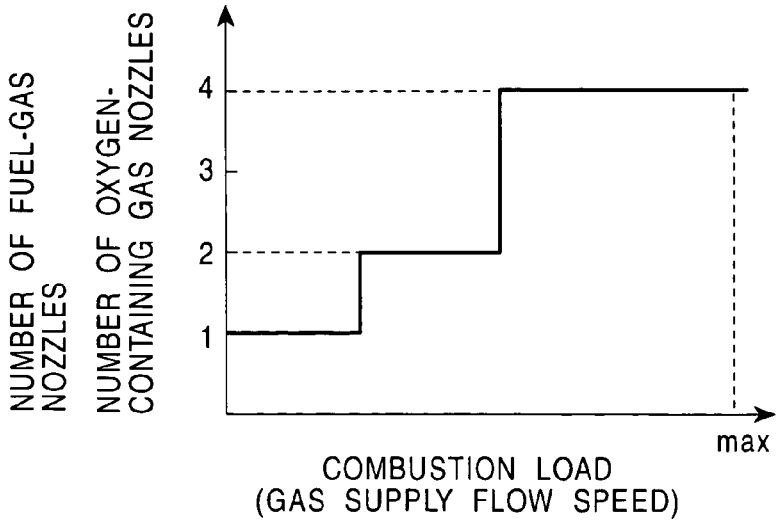
FIG. 22B is an explanatory diagram for describing a combustion control method according to an embodiment of the present invention.

Based on the above-described relation, the present combustion control method determines that the number of the nozzles to be used for spraying the fuel gas and the oxygen-containing-gas is adjusted by the supply controller 420, which controls on/off of the switching valves 415*a*, 415*b*, 415*c*, 415*d*, 416*a*, 416*b*, 416*c*, and 416*d*. Such a determination is done, in order for the fuel gas and the oxygen-containing-gas to be sprayed into the combustion chamber 410, at an initial flow speed within a range of the maximal permissive flow speed Vp and the minimal flow speed Vq. Here, Vp is dependent upon the pressure loss, and Vq is required for forming a tube-shaped flame. Specifically, as shown in FIG. 22B, when a combustion load is fallen within a range from the predetermined minimal combustion load to that of approximately ¼ of the predetermined maximum combustion load, a single nozzle for spraying the fuel gas and a single nozzle for spraying the oxygen-containing-gas are used. When a combustion load is fallen within a range from a approximately ¼ of the predetermined maximum combustion load to approximately ½ of the predetermined maximum combustion load, two nozzles for spraying the fuel gas and two nozzles for spraying the oxygen-containing-gas are used. Furthermore, in case of a combustion load in a range between a load of approximately ½ to the predetermined maximal combustion load, four nozzles for spraying the fuel gas and four nozzles for spraying the oxygen-containing-gas are used.

Thus, as shown by the line M in FIG. 22A, the initial flow speed from the spraying nozzles is obtained within a range between the maximal permissive flow speed Vp (Vp is dependent on the pressure loss), and the minimal flow speed Vq (Vp is required for forming a tube-shaped flame). Such a procedure results in suppressing excessive pressure loss, while maintaining the high speed of the flow required for forming a tube-shaped flame.

As described above, the tubular flame burner according to the present embodiment includes two nozzles that set along the tube axis. Each of these nozzles is formed of two fuel-gas-spraying nozzles and two oxygen-containing-gas-spraying nozzles along a single circumference of the tubular combustion chamber 410. These nozzles have such a configuration that the nozzles to be used for combustion are selected from the multiple fuel-gas spraying nozzles and the oxygen-containing-gas spraying nozzles. These nozzles are used by appropriately controlling on/off of the switching values, so as to exhibit a predetermined flow speed, even in case of change in the total supply flow of the fuel gas and the oxygen-containing-gas, corresponding to change in the combustion load. This results in suppressing the pressure loss at the time of an increase of the supply flow, as well as maintaining formation of a swirl at the time of reduction of the supply flow.

Note that while description has been made in the present embodiment regarding the tubular flame burner including two nozzle sets along the tube axis, each of which are formed of two fuel-gas spraying nozzles and two oxygen-containing-gas spraying nozzles along a single circumference thereof, the tubular flame burner may include a suitable number of nozzle sets along the tube axis, each of which are formed of a suitable number of fuel-gas spraying nozzles and two oxygen-containing-gas spraying nozzles along a single circumference thereof, as appropriate.

Furthermore, description has been made in the present embodiment regarding another arrangement. That is, the fuel-gas-spraying nozzles and the oxygen-containing-gas-spraying nozzles are disposed so that each spraying direction is in a tangential direction of the inner circumferential wall of the combustion chamber. The arrangement according to the present invention is not restricted to the aforementioned arrangement. It may be a case, any spraying direction is not in a tangential direction of the inner circumferential wall of the combustion chamber as long as a swirl of a mixture gas is formed within the combustion chamber.

Furthermore, description has been made in the present embodiment regarding another arrangement. It may be a case, that the slits serving as the nozzles for the combustion chamber are disposed along the tube axis. And each slit is connected to the corresponding flat fuel-gas spraying nozzle or oxygen-containing spraying nozzle. An arrangement may be made, wherein multiple small-sized openings serving as a nozzle orifice for the combustion chamber are formed along the tube axis. And each nozzle is connected to the corresponding array formed of the small-sized openings for spraying the fuel gas or the oxygen-containing-gas.

Furthermore, description has been made in the present embodiment regarding another arrangement, wherein the fuel gas is sprayed, but liquid fuel may be sprayed. It may be a case, liquid fuel which readily evaporate under relatively low temperature, such as kerosene, gas oil, alcohol, A-type heave oil, or the like, is suitably employed as the liquid fuel.

Note that the tubular flame burner according to the present embodiment may also be formed with a polygonal cross-sectional shape rather than round.

(Embodiment 5-2)

Figure 26:
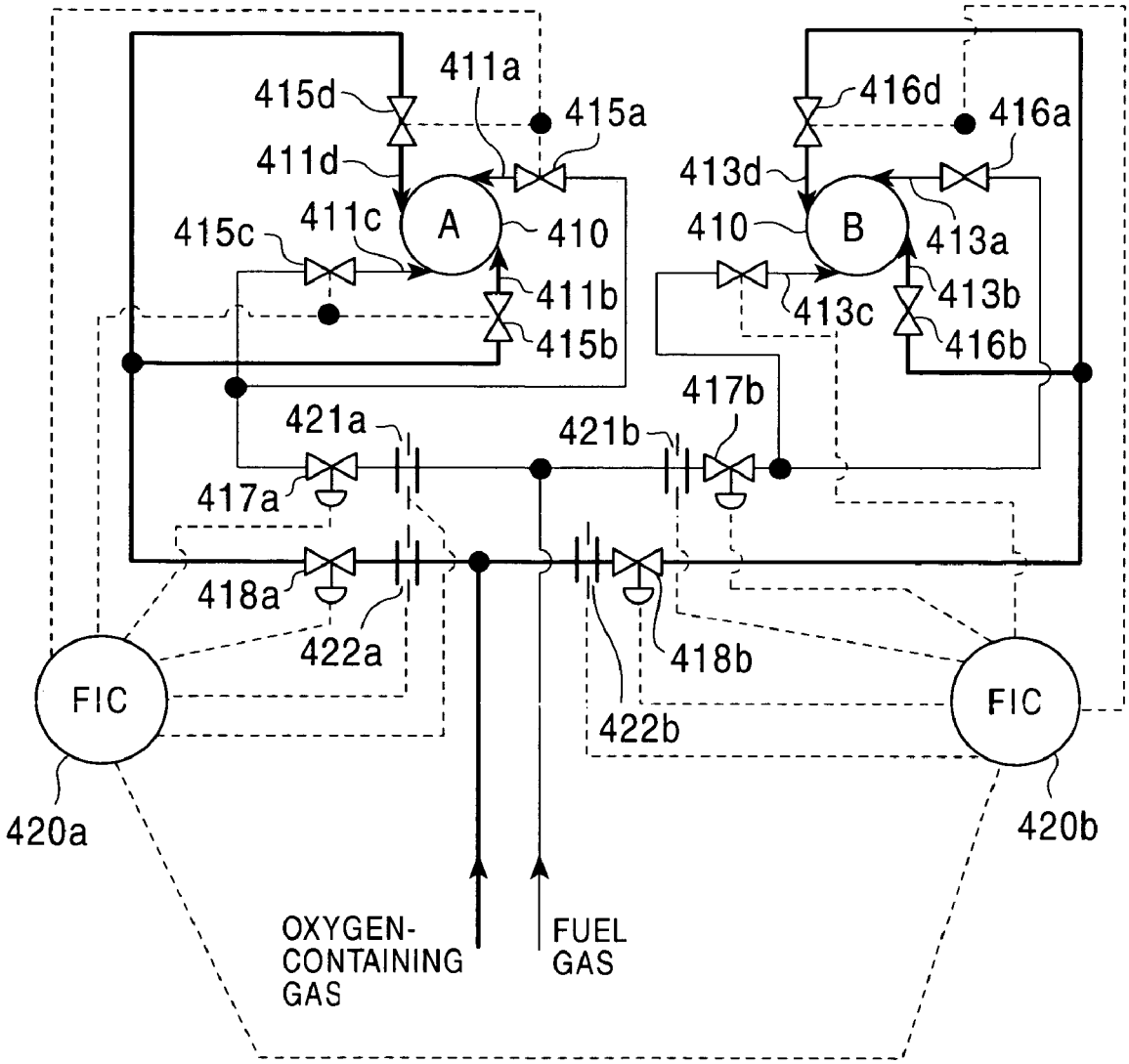
FIG. 26 is an overall configuration diagram, which shows a combustion controller for a tubular flame burner according to an embodiment of the present invention.

The present embodiment is shown in FIG. 26. FIG. 26 is an overall configuration diagram, which shows a combustion controller for a tubular flame burner according to the present embodiment.

The combustion controller, according to the above-described embodiment 5-1, has such a configuration as the total flow of the fuel gas and the total flow of the oxygen-containing-gas. Here, they are supplied to the nozzles at the mounting portion A and/or the nozzles at the mounting portion B are adjusted, as shown in FIG. 21. The combustion controller according to the present embodiment has a configuration wherein the fuel-gas flow and the oxygen-containing-gas flow to be supplied to the nozzles mounted on the mounting portion A are independently adjusted.

That is to say, as shown in FIG. 26, the line for supplying the fuel gas to the nozzles at the mounting portion A includes a fuel-gas-flow regulator 417*a* for controlling the fuel-gas flow to be supplied to the fuel-gas spraying nozzles 411*a* and 411 *c*. On the other hand, the line for supplying the oxygen-containing-gas to the nozzles at the mounting portion A includes an oxygen-containing gas-flow regulator 418*a* for controlling the oxygen-containing-gas flow to be supplied to the oxygen-containing-gas spraying nozzles 411*b* and 411*d*. The fuel-gas-flow regulator 417*a* and the oxygen-containing-gas-flow regulator 418*a* are controlled by the supply controller, thereby enabling the fuel gas flow and the oxygen-containing-gas flow to be adjusted in order to be supplied to the nozzles at the mounting portion A. The flow-meter 421*a* for the fuel gas and the flow-meter 422*a* for the oxygen-containing-gas measure the supply amounts of the fuel gas and the oxygen-containing-gas, respectively. And the measured values are sent to the supply controller 420a so as to be used for adjusting the apertures of the fuel-gas-flow regulator 417*a* and the oxygen-containing-gas flow regulator 418*a*. In the same way, the line for supplying the fuel gas to the nozzles at the mounting portion B includes a fuel-gas-flow regulator 417*b* for controlling the fuel-gas flow to be supplied to the fuel-gas spraying nozzles 413*a* and 413*c*. On the other hand, the line for supplying the oxygen-containing-gas to the nozzles at the mounting portion B includes an oxygen-containing-gas-flow regulator 418*b* for controlling the oxygen-containing-gas flow to be supplied to the oxygen-containing-gas spraying nozzles 413*b* and 413*d*The supply controller 420*b* controls the fuel-gas-flow regulator 417*b* and the oxygen-containing-gas-flow regulator 418*b*. The supply amounts of the fuel gas and the oxygen-containing-gas to be supplied to the nozzles at the mounting portion B are measured by the flow-meter 421*b* for the fuel gas, and the flow-meter 422*b* for the oxygen- containing-gas, respectively. The measured values are sent to the supply controller 420*b* so as to be used for adjusting the apertures of the fuel-gas-flow regulator 417*b* and the oxygen-containing-gas-flow regulator 418*b*.

The supply controller 420*a* for the nozzles at the mounting portion A and the supply controller 420*b* for the nozzles at the mounting portion B, are interconnected each other for adjusting the total supply flow of the fuel gas and the oxygen-containing-gas.

Furthermore, switching valves 415*a* and 415*c* are provided for controlling on/off of the supply of the fuel gas to the fuel-gas spraying nozzles 411*a* and 411*c* at the mounting portion A. On the other hand, the line for supplying the oxygen-containing-gas to the oxygen-containing-gas spraying nozzles 411*b* and 411*d* at the mounting portion A includes switching valves 415*b* and 415*d* for controlling on/off of supply of the oxygen-containing-gas to the nozzles 411*b* and 411*d*, respectively. Here, each of the switching valves 415*a*, 415*b*, 415*c*, and 415*d*, are controlled by the supply controller 420*a*.

On the other hand, the aforementioned line for supplying the fuel gas to the fuel-gas spraying nozzles 413*a* and 413*c* at the mounting portion B includes switching valves 416*a* and 416*c* for controlling on/off of the supply of the fuel gas to the fuel-gas-spraying nozzles 413*a* and 413*c*. On the other hand, the line for supplying the oxygen-containing-gas to the oxygen-containing-gas spraying nozzles 413*b* and 413*d* at the mounting portion B includes switching valves 416*b* and 416*d* for controlling on/off of supply of the oxygen-containing-gas to the nozzles 413*b* and 413*d*. Here, each of the switching valves 416*a*, 416*b*, 416*c*, and 416*d*, are controlled by the supply controller 420*b*.

Thus, the supply controllers 420*a* and 420*b* control on/off of the nozzles, thereby selecting the nozzles to be used for spraying the fuel gas and the oxygen-containing-gas to the combustion chamber 410.

Thus, in the tubular flame burner according to the present embodiment, the number of the nozzles to be used for combustion is suitably selected from the multiple combustion-gas spraying nozzles and oxygen-containing-gas spraying nozzles. Controlling on/off of the switching valves does such a way, and this way is as well as adjusting the flow supplied to each nozzle by controlling the corresponding regulator, so as to obtain a predetermined spraying speed. It ends up in suppressing the pressure loss when the supply flow increases, as well as maintaining formation of a swirl when the supply flow reduces. Even in the event of change in the total supply flow of the fuel gas and the oxygen-containing-gas corresponding to change in the combustion load, the above-mentioned procedure is done.

Note that the tubular flame burner according to the present embodiment may also be formed with a polygonal cross-sectional shape rather than round.

(Embodiment 5-3)

Figure 23:
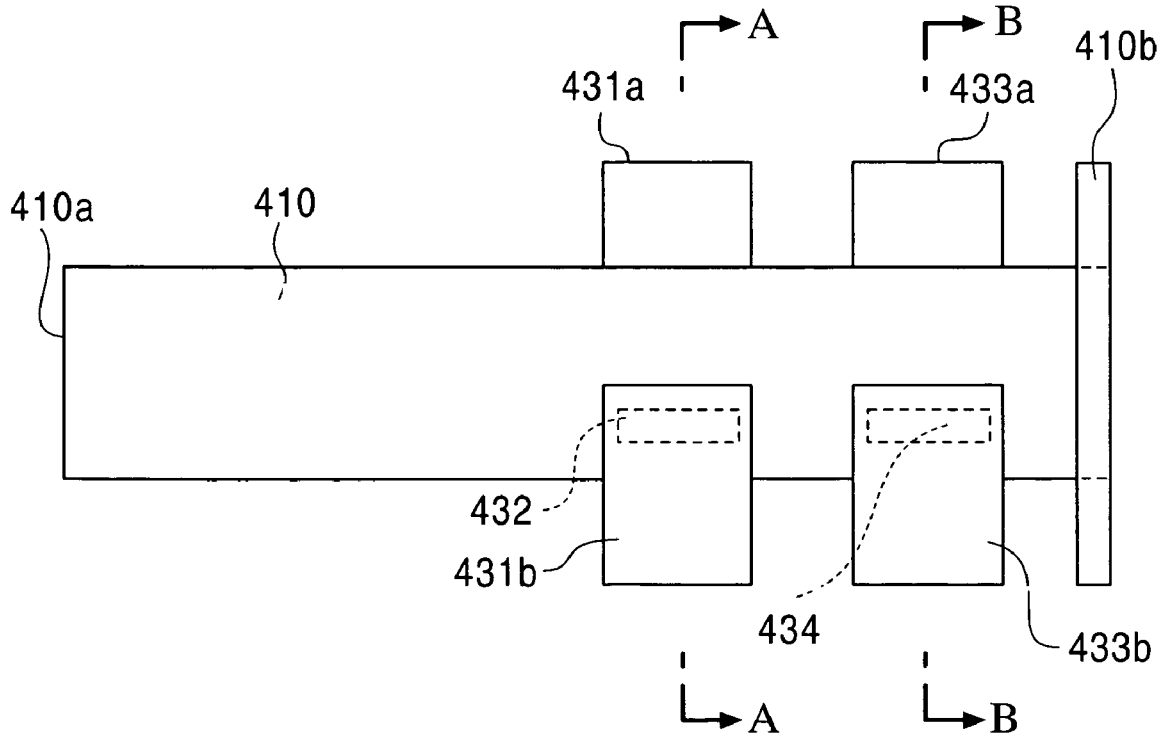
FIG. 23 is a side view of a tubular flame burner according to an embodiment of the present invention.
Figure 24A:
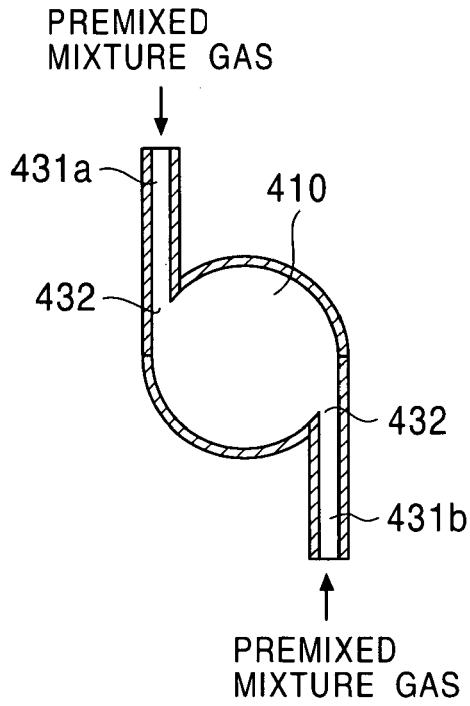
FIG. 24A is a cross-sectional view taken along line A-A in FIG. 23.
Figure 24B:
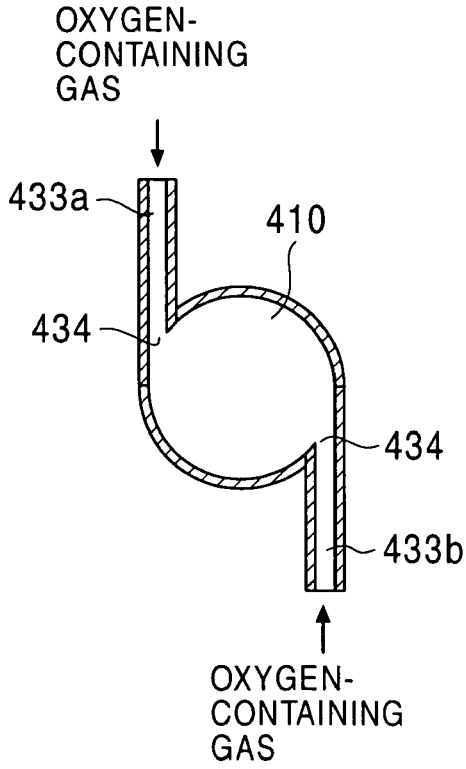
FIG. 24B is a cross-sectional view taken along line B-B in FIG. 23.
Figure 25:
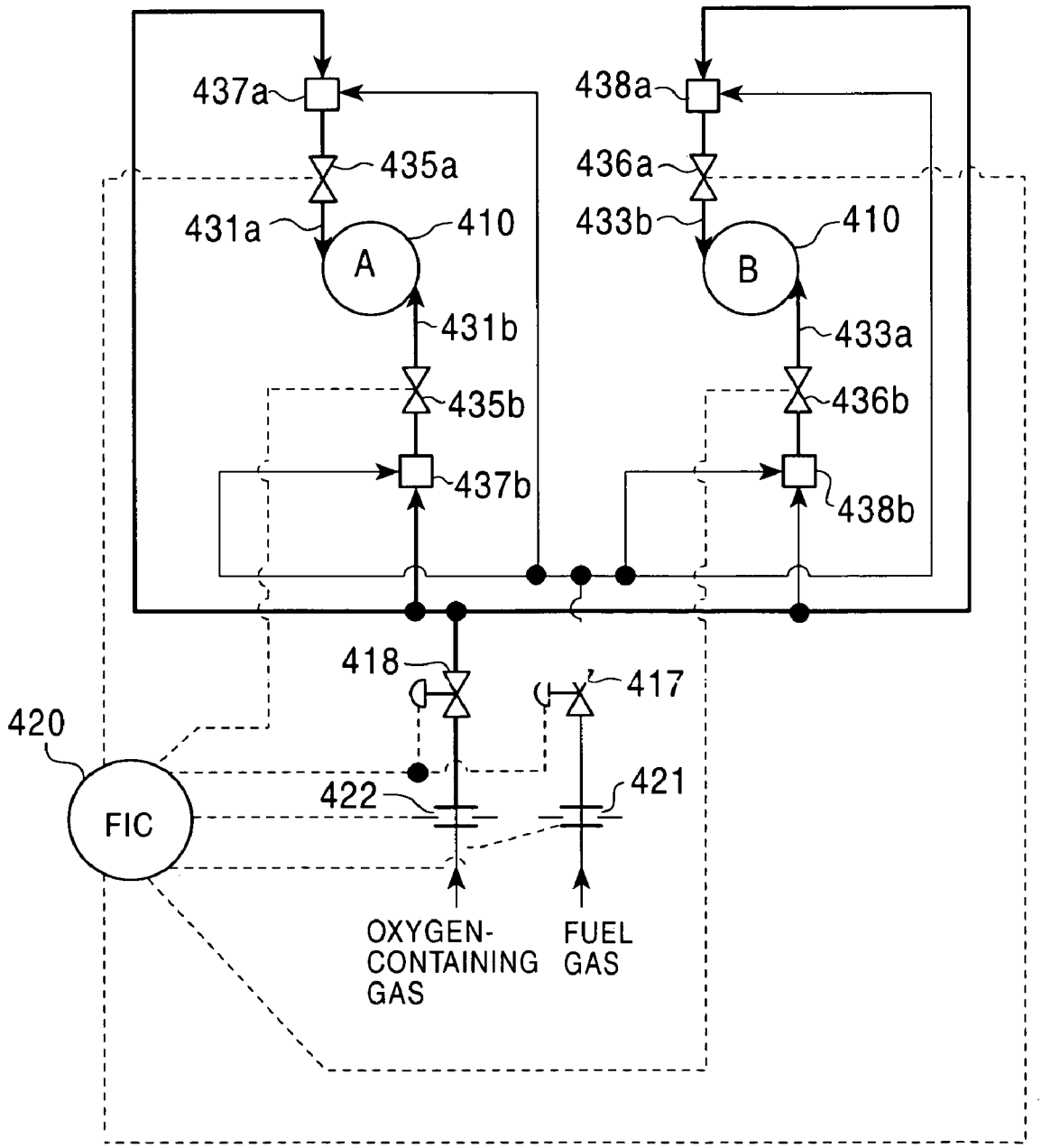
FIG. 25 is an overall configuration diagram, which shows a combustion controller for a tubular flame burner according to an embodiment of the present invention.

FIG. 23 through FIG. 25 show an embodiment 5-3 according to the present invention. FIG. 23 is a side view of a tubular flame burner according to the present embodiment, FIG. 24A is a cross-sectional view taken along line A-A in FIG. 23, and FIG. 24B is a cross-sectional view taken along line B-B in FIG. 23. FIG. 25 is an overall configuration diagram, which shows a combustion controller for the tubular flame burner according to the present embodiment.

In FIG. 23, reference numeral 410 is a tubular combustion chamber, wherein the one end 410*a* opens so as to serve as an exhaust vent for combustion exhaust gas. Furthermore, the tubular combustion chamber 410 includes two nozzle-mounting portions A and B along the tube axis on the side of the rear-end 410*b* thereof for spraying a fuel gas and an oxygen-containing-gas to the combustion chamber 410.

At the nozzle-mounting portion A, two long and narrow slits 432 extending along the tube axis are formed along the circumferential wall of the combustion chamber 410, so as to serve as nozzles for the combustion chamber 410. And such slits are connected to nozzles 431*a* and 431*b*, formed flat, and long and narrow along the tube axis, respectively, as shown in FIG. 23 and FIG. 24A. These nozzles 431*a* and 431*b* are disposed so that each spraying direction thereof is in a tangential direction of the inner circumferential wall of the combustion chamber 410 so as to form a swirl in a predetermined direction. Note that a premixed gas wherein the fuel gas and the oxygen-containing-gas have been mixed beforehand is supplied to the nozzles 431*a* and the nozzles 431*b*.

The premixed gas is sprayed in the tangential direction of the circumferential wall of the combustion chamber 410 at a high speed from the premixed-gas spraying nozzles 431*a* and 431*b* to which the premixed gas is supplied. This is done so as to form a swirl at a region near the inner circumferential wall of the combustion chamber 410. When the premixed gas forming such a swirl by an ignition device (not shown) such as an ignition plug, pilot burner, or the like, are ignited, a tube-shaped flame is formed within the combustion chamber 410.

In the same way, at the nozzle-mounting portion B, two long and narrow slits 434 extending. along the tube axis are formed along the circumferential wall of the combustion chamber 410, so as to serve as nozzles for the combustion chamber 410. And such slits are connected to nozzles 433*a* and 433*b*, formed flat, and long and narrow along the tube axis, respectively, as shown in FIG. 23 and FIG. 24B. These nozzles 433*a* and 433*b* are disposed so that each spraying direction thereof is in a tangential direction of the inner circumferential wall of the combustion chamber 410 so as to form a swirl in a predetermined direction. Note that a premixed gas wherein the fuel gas and the oxygen-containing-gas have been mixed beforehand is supplied to the nozzles 433*a* and the nozzles 433*b*.

The premixed gas is sprayed in the tangential direction of the circumferential wall of the combustion chamber 410 at a high speed from the premixed-gas spraying nozzles 433*a* and 433*b* to which the premixed gas is supplied. This is done, so as to form a swirl at a region near the inner circumferential wall of the combustion chamber 410. When the premixed gas forming such a swirl by an ignition device (not shown) such as an ignition plug, pilot burner, or the like are ignited, a tube-shaped flame is formed within the combustion chamber 410.

As described above, the tubular flame burner according to the present embodiment includes two nozzles that set along the tube axis. Each of these nozzles are formed of two premixed-gas spraying nozzles along a single circumference of the combustion chamber, i.e., the tubular flame burner according to the present embodiment includes four premixed-gas spraying nozzles.

Furthermore, as shown in FIG. 25, the lines for supplying the premixed gas to the premixed-gas spraying nozzles 431*a*, 431*b*, 433*a*, and 433*b*, include switching valves 435*a*, 435*b*, 436*a*, and 436*b*, for controlling on/off of the supply of the premixed gas to the nozzles 431*a*, 431*b*, 433*a*, and 433*b*, respectively. And the lines further include gas mixers 437*a*, 437*b*, 438*a*, and 438*b*, for premixing the fuel gas and the oxygen-containing-gas beforehand, respectively.

The supply controller 420, thereby enabling the nozzles to be selectively used for spraying the premixed gas to the combustion chamber 410, performs on/off control of the switching valves 435*a*, 435*b*, 436*a*, and 436*b*.

The line for supplying the fuel gas to the gas mixers 437*a*, 437*b*, 438*a*, and 438*b*, includes a fuel-gas-flow regulator 417 for adjusting the total flow of the fuel gas to be supplied. On the other hand, the line for supplying the oxygen-containing-gas to the gas mixers 437*a*, 437*b*, 438*a*, and 438*b*, includes an oxygen-containing-gas-flow regulator 418 for adjusting the total flow of the oxygen-containing-gas to be supplied. The fuel-gas-flow regulator 417 and the oxygen-containing-gas-flow regulator 418 are controlled by the supply controller 420 so as to adjust the total flow of the fuel gas and the total flow of the oxygen-containing-gas, which are to be supplied, corresponding to the combustion load. That is to say, when a combustion load is small, the apertures of the fuel-gas-flow regulator 417 and the oxygen-containing-gas-flow regulator 418 reduces, so as to reduce the total supply flow. On the other hand, when a combustion load is great, the apertures of the fuel-gas-flow regulator 417 and the oxygen-containing-gas-flow regulator 418 increase so as to increase the total supply flow.

Note that the flow-meter 421 for the fuel gas and the flow-meter 422 for the oxygen-containing-gas measure each of the total supply flow of the fuel gas and the oxygen-containing-gas. And the measurement results are sent to the supply controller 420, so as to be used for adjusting the apertures of the fuel-gas-flow regulator 417 and the oxygen-containing-gas-flow regulator 418.

Combustion control with the combustion controller for a tubular flame burner having such a configuration is performed in the same way as with the above-described embodiment.

That is to say, the number of the nozzles to be used for spraying the premixed gas is adjusted by the supply controller 420 controlling on/off of the switching valves 435*a*, 435*b*, 436*a*, and 436*b*, corresponding to the combustion load, so that the initial flow speed of the premixed gas sprayed to the combustion chamber is maintained in a range between the maximal permissive flow speed Vp dependent upon the pressure loss and the minimal flow speed Vq required for forming a tube-shaped flame.

For example, when a combustion load is fallen within a range from the predetermined minimal combustion load to a load of approximately ¼, a single nozzle for spraying the premixed gas is used. And when a combustion load is fallen within a range from a load of approximately ¼ to approximately ½ thereof, two nozzles for spraying the premixed gas are used. Furthermore, when a combustion load is fallen within a range from a load of approximately ½ to the predetermined maximal combustion load, four nozzles for spraying the premixed gas are used.

Thus, the initial flow speed from the spraying nozzles is obtained within a range between the maximal permissive flow speed Vp (dependent upon the pressure loss) and the minimal flow speed Vq(required for forming a tube-shaped flame), thereby suppressing excessive pressure loss while maintaining the high speed of the flow required for forming a tube-shaped flame.

As described above, the tubular flame burner according to the present embodiment includes two nozzles that set along the tube axis. Each of these nozzles is formed of two nozzles for spraying the premixed gas, along a single circumference of the tubular combustion chamber 410. And the tubular flame burner, wherein the number of the nozzles to be used for combustion, is suitably selected from the multiple nozzles for spraying the premixed gas, by controlling on/off of the switching valves so as to exhibit a predetermined flow speed, even in a case of change in the total supply flow of the premixed gas corresponding to change in the combustion load, thereby suppressing the pressure loss at the time of an increase of the supply flow, as well as maintaining formation of a swirl at the time of reduction of the supply flow.

Note that description has been made in the present embodiment regarding the tubular flame burner including two nozzles that sets along the tube axis. Each of these nozzles is formed of two nozzles for spraying the premixed gas along a single circumference thereof. The tubular flame burner may include a suitable number of nozzle sets along the tube axis, each of which are formed of a suitable number of nozzles for spraying the premixed gas along a single circumference thereof, as appropriate.

Furthermore, description has been made in the present embodiment regarding the arrangement, wherein the nozzles for spraying the premixed gas are disposed so that each spraying direction is in a tangential direction of the inner circumferential wall of the combustion chamber. An arrangement according to the present invention is not restricted to the aforementioned arrangement. An arrangement may be made wherein any spraying direction is not in a tangential direction of the inner circumferential wall of the combustion chamber as long as a swirl of a mixture gas is formed within the combustion chamber.

Furthermore, while description has been made in the present embodiment regarding the arrangement, wherein the slits serving as the nozzles for the combustion chamber are disposed along the tube axis, and each slit is connected to the corresponding flat nozzle for spraying the premixed gas. An arrangement may be made wherein multiple small-sized openings are formed along the tube axis, and each nozzle is connected to the corresponding array formed of the small-sized openings for spraying the premixed gas.

Furthermore, in the present embodiment, a gas formed by preheating liquid fuel may be employed as a fuel gas. Note that liquid fuel which readily evaporate under relatively low temperature, such as kerosene, gas oil, alcohol, A-type heave oil, or the like, is suitably employed as the liquid fuel.

Note that the tubular flame burner according to the present embodiment may also be formed with a polygonal cross-sectional shape rather than round.

(Embodiment 5-4)

Figure 27:
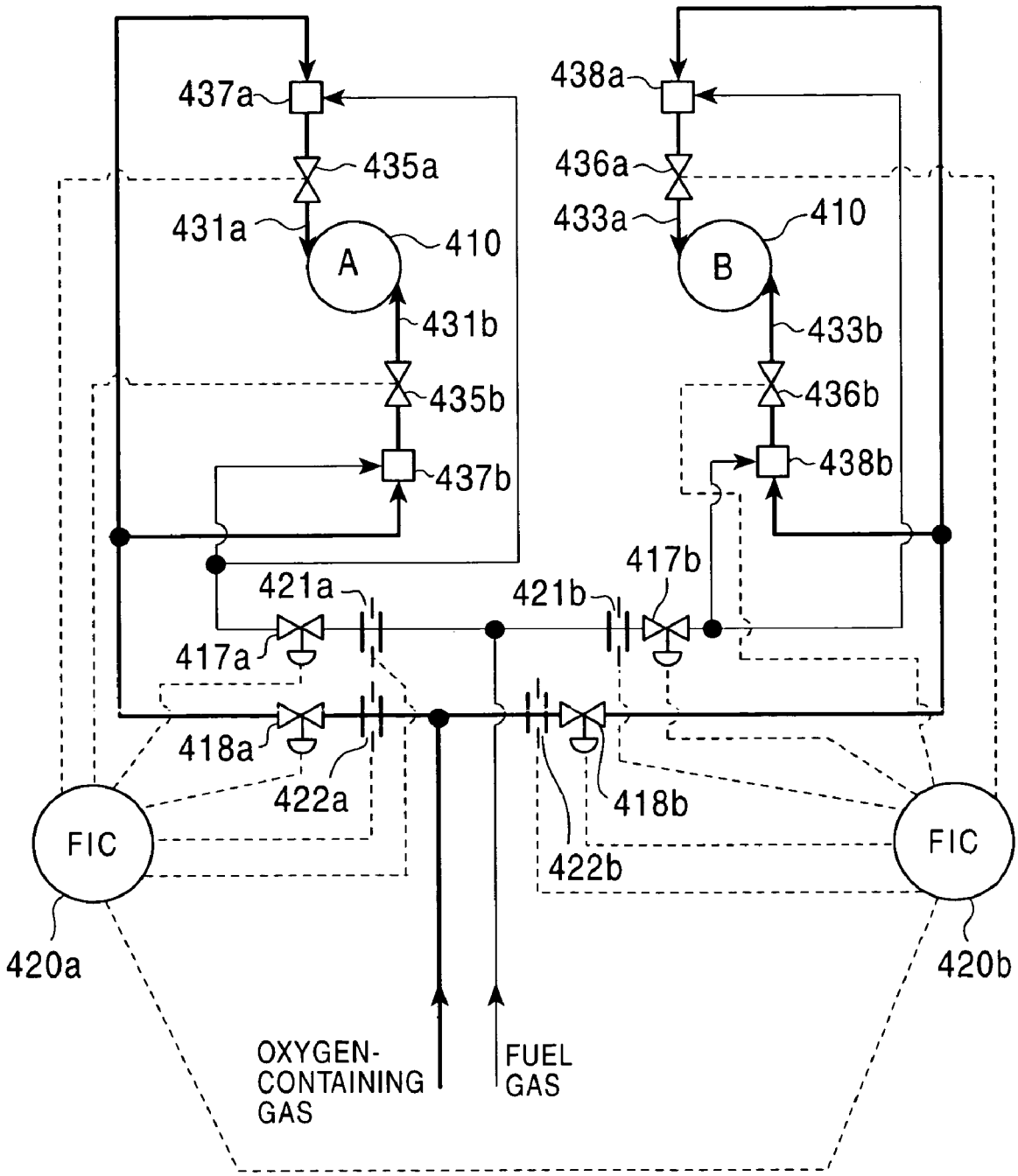
FIG. 27 is an overall configuration diagram, which shows a combustion controller for a tubular flame burner according to an embodiment of the present invention.

The present embodiment is shown in FIG. 27. FIG. 27 is an overall configuration diagram, which shows a combustion controller for a tubular flame burner according to the present embodiment.

The combustion controller according to the above-described embodiment 5-3 has a configuration. Here, the total flow of the fuel gas and the total flow of the oxygen-containing-gas, which are to be supplied to the premixed-gas spraying nozzles at the mounting portion A and/or to the fuel-gas spraying nozzles at the mounting portion B, are adjusted as shown in FIG. 25. The combustion controller according to the present embodiment has a configuration wherein the fuel-gas flow and the oxygen-containing-gas flow, which are to be supplied to the premixed-gas spraying nozzles at the mounting portion A, are independently adjusted.

That is to say, as shown in FIG. 26, the line for supplying the fuel gas to the premixed spraying nozzles 431*a* and 431*b* at the mounting portion A includes the fuel-gas flow regulator 417*a* for adjusting the flow of the fuel-gas, which is to be supplied. On the other hand, the line for supplying the oxygen-containing-gas to the premixed spraying nozzles 431*a* and 431*b* at the mounting portion A includes the oxygen-containing-gas-flow regulator 418*a* for adjusting the flow of the oxygen-containing-gas, which is to be supplied. The fuel-gas-flow regulator 417*a* and the oxygen-containing-gas-flow regulator 418*a* are controlled by the supply controller 420*a*, thereby enabling the fuel-gas flow and the oxygen-containing-gas flow to be adjusted, which are to be supplied to the premixed-gas spraying nozzles 431*a* and 431*b* at the mounting portion A. The supply flow of the fuel gas and the supply flow of the oxygen-containing-gas are measured by the flow-meter 421*a* for the fuel gas and the flow-meter 422*a* for the oxygen-containing-gas, respectively. And the measured results are sent to the supply controller 420*a*, so as to be used for adjusting the apertures of the fuel-gas-flow regulator 417*a* and the oxygen-containing-gas-flow regulator 418*a*.

In the same way, the line for supplying the fuel gas to the premixed spraying nozzles 433*a* and 433*b* at the mounting portion B includes the fuel-gas-flow regulator 417*b* for adjusting the flow of the fuel gas which is to be supplied. On the other hand, the line for supplying the oxygen-containing-gas to the premixed spraying nozzles 433*a* and 433*b* at the mounting portion B includes the oxygen-containing-gas-flow regulator 418*b* for adjusting the flow of the oxygen-containing-gas, which is to be supplied. The supply controller 420*b* controls the fuel-gas-flow regulator 417*b* and the oxygen-containing-gas-flow regulator 418*b*. Such a controlling method makes it possible to adjust the fuel-gas flow and the oxygen-containing-gas flow, which are to be supplied to the premixed-gas spraying nozzles 433*a* and 433*b* at the mounting portion B, and the flow-meter for the oxygen-containing-gas. The supply flow of the fuel gas and the supply flow of the oxygen-containing-gas are measured by the flow-meter 421*b* for the fuel gas and the flow-meter 422*b* for the oxygen containing-gas, respectively. And the measured results are sent to the supply controller 420*b* so as to be. used for adjusting the apertures of the fuel-gas-flow regulator 417*b* and the oxygen-containing-gas-flow regulator 418*b*.

The supply controller 420*a* for the premixed gas spraying nozzles 431*a* and 431*b* at the mounting portion A, and the supply controller 420*b* for the premixed-gas spraying nozzles 433*a* and 433*b* at the mounting portion B, are interconnected each other for adjusting the total supply flow of the fuel gas and the oxygen-containing-gas.

Note that the line for supplying the premixed gas to the premixed-gas spraying nozzle 431*a* at the mounting portion A from the gas mixer 437*a* includes the switching valve 435*a* for controlling on/off of supply of the premixed gas to the premixed-gas spraying nozzle 431*a*. And the line for supplying the premixed gas to the premixed-gas spraying nozzle 431*b* at the mounting portion A from the gas mixer 437*b* includes the switching valve 435*b* for controlling on/off of supply of the premixed gas to the premixed-gas spraying nozzle 431*b*.

On the other hand, the line for supplying the premixed gas to the premixed-gas spraying nozzle 433*a* at the mounting portion B from the gas mixer 438*a* includes the switching valve 436*a* for controlling on/off of supply of the premixed gas to the premixed-gas spraying nozzle 433*a*. And the line for supplying the premixed gas to the premixed-gas spraying nozzle 433*b* at the mounting portion B from the gas mixer 438*b* includes the switching valve 436*b* for controlling on/off of supply of the premixed gas to the premixed-gas spraying nozzle 433*b*.

On/off control of the switching valves 435*a* and 435*b* is performed by the supply controller 420*a*. And on/off control of the switching valves 436*a* and 436*b* is performed by the supply controller 420*b*. The nozzles to be used for spraying the premixed gas to the combustion chamber 410 are selected by the aforementioned on/off control.

Thus, in the present embodiment, the number of the nozzles to be used for combustion is suitably selected from the multiple nozzles for spraying the premixed gas, by controlling on/off of the switching valves. And the flow supplied to each nozzle is adjusted by controlling the corresponding flow regulator, so as to exhibit a predetermined flow speed. This is done, even in a case of change in the total supply flow of the premixed gas corresponding to change in the combustion load. This makes it possible to suppress the pressure loss when an increase of the supply flow increases, as well as maintaining formation of a swirl at the time of reduction of the supply flow.

In the present embodiment, the number of the nozzles to be used for spraying the fuel gas and the oxygen-containing-gas to the combustion chamber, or the number of the nozzles to be used for spraying the premixed gas formed of the fuel gas and the oxygen-containing-gas to the combustion chamber, is suitably selected so as to exhibit a predetermined spraying speed. This is done, even in case of change in the total supply flow of the fuel and oxygen-containing-gas corresponding to change in the combustion load, thereby achieving stable combustion in a wider range of the combustion load.

Note that the tubular flame burner according to the present embodiment may also be formed with a polygonal cross-sectional shape rather than round.

EMBODIMENT 6

Figure 28:
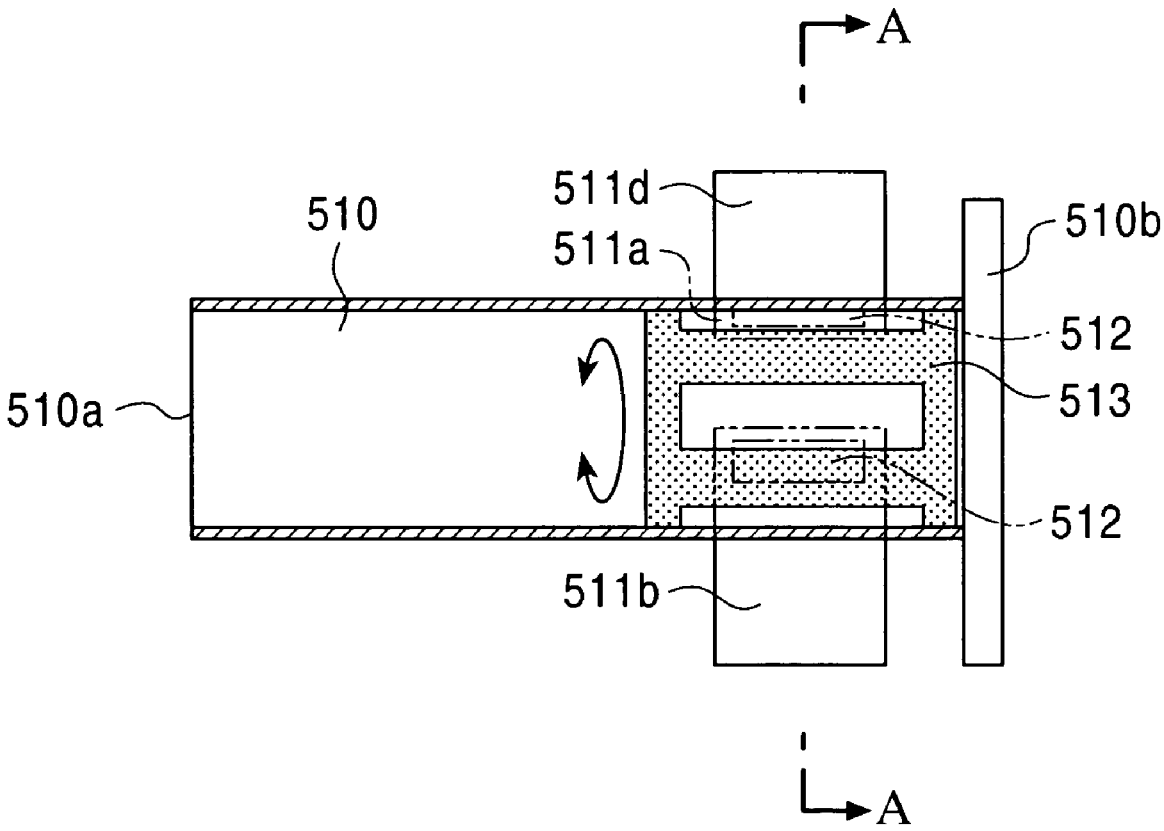
FIG. 28 is a side view of a tubular flame burner according to an embodiment of the present invention.
Figure 29A:
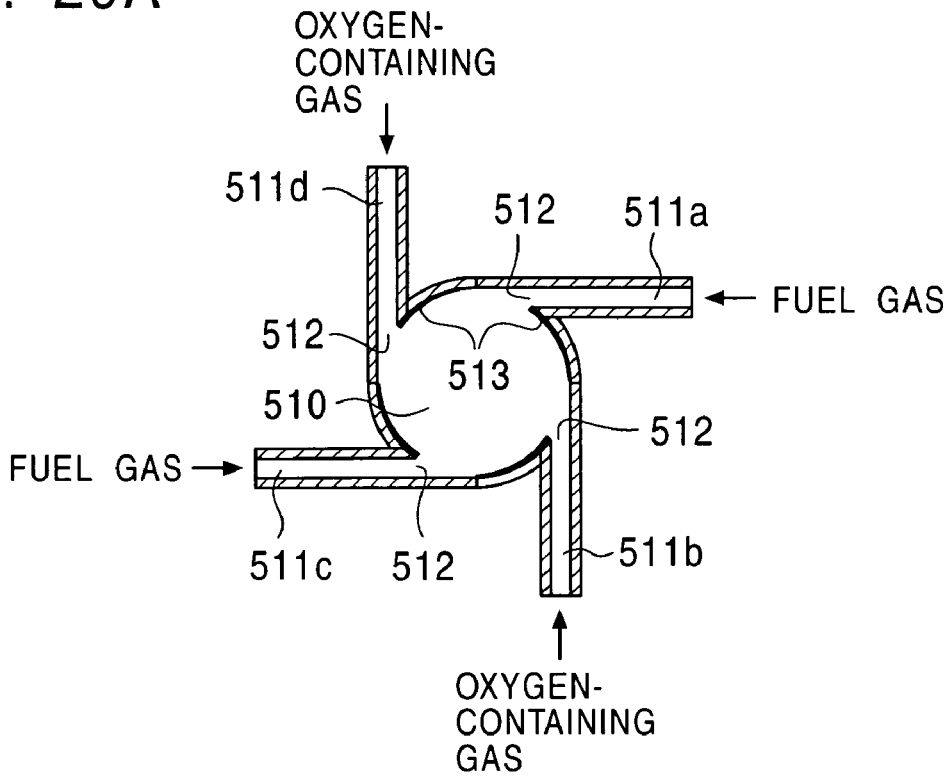
FIG. 29A is a cross-sectional view taken along line A-A in FIG. 28.
Figure 29B:
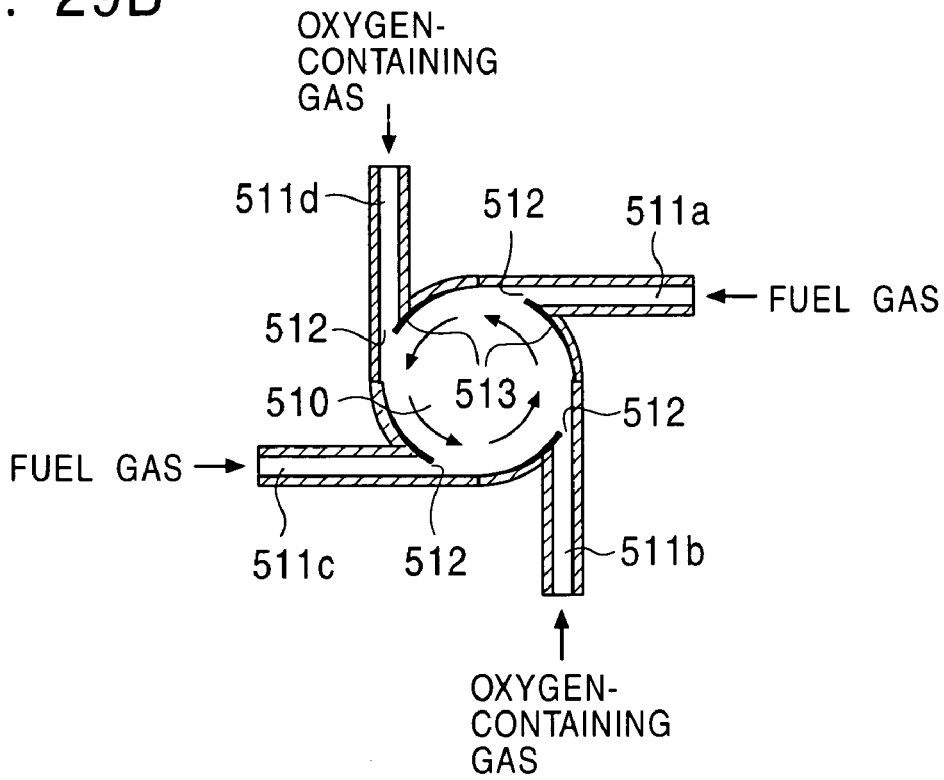
FIG. 29B is a cross-sectional view taken along line B-B in FIG. 28.
Figure 30:
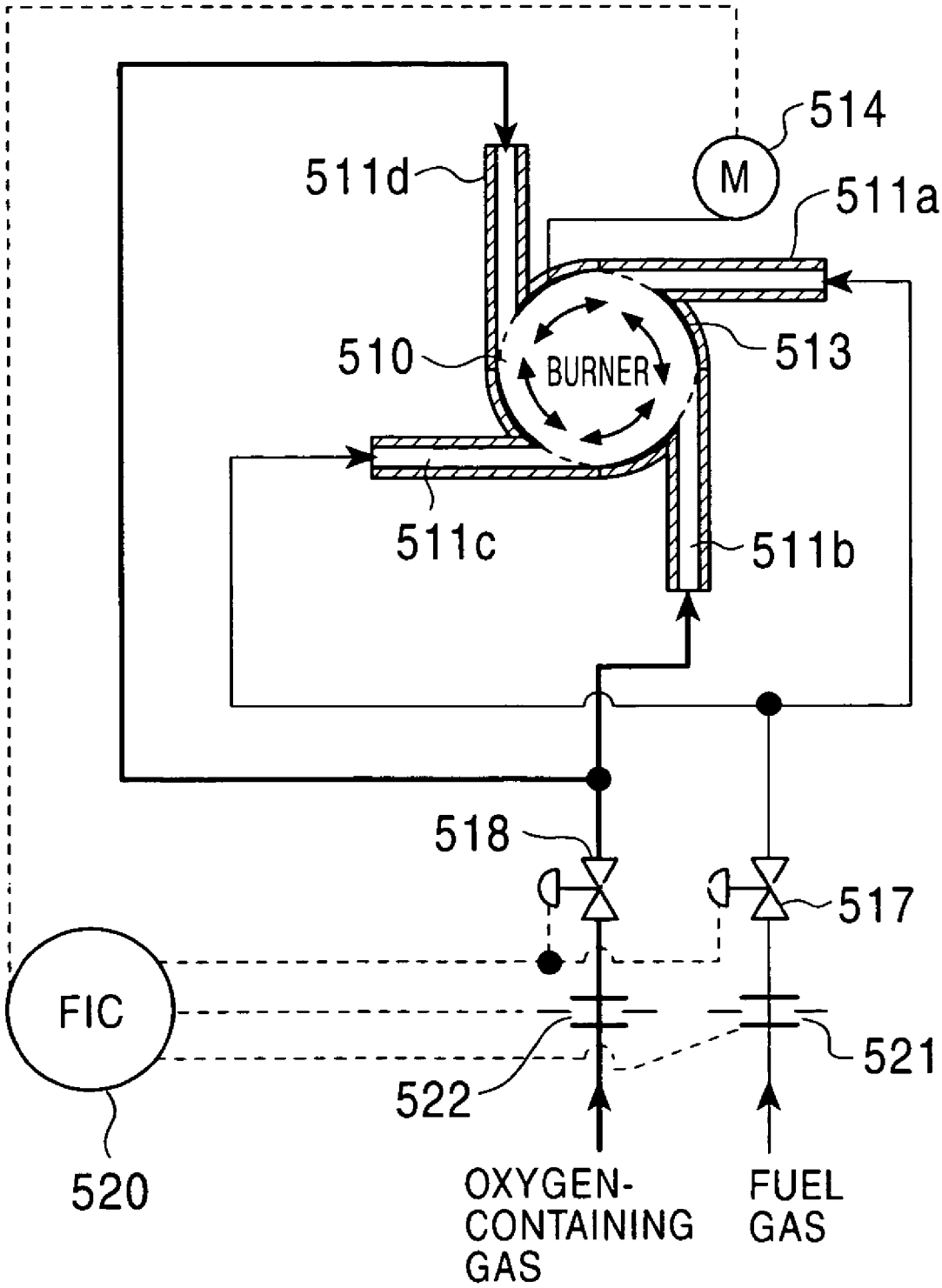
FIG. 30 is an overall configuration diagram, which shows a combustion controller for a tubular flame burner according to an embodiment of the present invention.

FIG. 28 through FIG. 31 show an embodiment 6 according to the present invention. FIG. 28 is a side view of a tubular flame burner according to the present embodiment, FIG. 29A is a cross-sectional view taken along line A-A in FIG. 28. FIG. 30 is an overall configuration diagram which shows a combustion controller for the tubular flame burner according to the present embodiment, and FIG. 31 is an explanatory diagram for describing a combustion control method for the tubular flame burner according to the present embodiment.

In FIG. 28, reference numeral 510 denotes a tubular combustion chamber, wherein the front-end 510*a* opens so as to serve as an exhaust vent for a combustion exhaust gas. Furthermore, the combustion chamber 510 includes nozzles for spraying a fuel gas to the combustion chamber 510, and nozzles for spraying an oxygen-containing-gas thereto, near the rear-end 510 thereof.

As shown in FIG. 28 and FIG. 29, the combustion chamber 510 includes four long and narrow slits 512 arrayed along a single tube circumference. Each of these slits are formed long along the tube axis thereof, so as to serve as nozzles for the combustion camber 510, which are connected to nozzles 511*a*, 511*b*, 511*c*, and 511*d*, formed flat, long and narrow along the tube axis thereof, respectively. These nozzles 511*a*, 511*b*, 511*c*, and 511*d*, are disposed so that each spraying direction is in a tangential direction of the inner circumferential wall of the combustion chamber 510 so as to form a swirl in a predetermined direction. Of these four nozzles, the nozzles 511*a* and 511*c* serve as fuel-gas spraying nozzles, and the nozzles 511*b* and 511*d* serve as oxygen-containing-gas spraying nozzles.

The fuel gas is sprayed in the tangential direction of the inner circumferential wall of the combustion chamber 510 at a high speed from the fuel-gas spraying nozzles 51la and 511*c*. And, the oxygen-containing-gas is sprayed in the tangential direction of the inner circumferential wall of the combustion chamber 510 at a high speed from the oxygen-containing-gas spraying nozzles 511*b* and 511*d*, so as to form a swirl while efficiently mixing the fuel gas and the oxygen-containing-gas at a neighborhood region of the inner circumferential wall of the combustion chamber 510. When the mixture gas forming a swirl the tubular flame burner is ignited by an ignition device (not shown) such as an ignition plug, pilot burner, or the like, a tube-shaped flame is formed within the combustion chamber 510. A combustion gas therefrom is discharged from the front-end 510*a* of the combustion chamber 510.

Note that the oxygen-containing-gas represents a gas for carrying oxygen used for combustion such as air, oxygen, oxygen-enriched air, exhaust mixture gas, or the like.

Furthermore, as shown in FIG. 29A and FIG. 29B, a slit aperture adjusting ring 513 is disposed at a portion, where the slits 512 are disposed, so as to be in contact with the inner wall of the combustion chamber 510 for adjusting the apertures of the slits 512. The slit aperture-adjusting ring 513 is formed in the shape of a tube with a small thickness. The slit aperture includes four slots along the circumferential direction corresponding to the four slits 512,. wherein the apertures of the four slits 512 are adjusted by rotating the slit aperture adjusting ring 513 in the direction of the tube circumference.

Specifically, FIG. 29A shows the combustion chamber 510, wherein the slots of the slit aperture adjusting ring 513 just matches with the corresponding slits 512, so as to adjust the aperture of each slit 512 to the maximum. FIG. 29B shows the combustion chamber 510, wherein the slit aperture adjusting ring 513 is rotated by a certain angle from the state shown in FIG. 29A, so that a part of each slit 512 is closed with the slit aperture adjusting ring 513 so as to reduce the aperture of each slit 512.

Furthermore, as shown in the overall configuration diagram in FIG. 30, with the combustion controller for the tubular flame burner according to the present embodiment, the line for supplying the fuel gas includes the fuel-gas-flow regulator 517 for adjusting the flow of the fuel gas to be supplied to the fuel-gas spraying nozzles 511*a* and 511*c*, and the line for supplying the oxygen-containing-gas includes the oxygen-containing-gas-flow regulator 518 for adjusting the flow of the oxygen-containing-gas to be supplied to the oxygen-containing-gas spraying nozzles 511*b* and 511*d*. The supply controller 520, so as to adjust the supply flow of the fuel gas and the oxygen-containing-gas corresponding to the combustion load, controls the fuel-gas-flow regulator 517 and the oxygen-containing-gas-flow regulator 518. Specifically, in case of a small combustion load, the apertures of the fuel-gas-flow regulator 517 and the oxygen-containing-gas-flow regulator 518 are reduced, so as to reduce the supply flow thereof. On the other hand, in case of a great combustion load, the apertures of the fuel-gas-flow regulator 517 and the oxygen-containing-gas-flow regulator 518 are increased so as to increase the supply flow thereof.

Note that the supply flow of the fuel gas and the supply flow of the oxygen-containing-gas are measured by the flow-meter 521 for the fuel gas and the flow-meter 522 for the oxygen-containing-gas, respectively. And the measurement results are sent to the supply controller 520 so as to be used for adjusting the apertures of the fuel-gas-flow regulator 517 and the oxygen-containing-gas-flow regulator 518.

Furthermore, a motor 514 is provided for adjusting the angular position of the slit aperture adjusting ring 513, is controlled by the supply controller 520, and adjusts the apertures of the slits 512 by controlling the angular position of the slit aperture adjusting ring 513. Note that an actuator such as a hydraulic cylinder, an air cylinder, or the like, may be employed instead of the motor 514.

Description will be made regarding a combustion control method for the tubular flame burner having such a configuration with reference to FIG. 30 and FIG. 31.

In the method for controlling the combustion by the tubular flame burner, when the supply flow is variable and changes corresponding to the combustion load, the apertures of the slits 512 are adjusted in the following way. That is, the initial flow speed of the fuel gas and the oxygen-containing-gas sprayed to the combustion chamber 510 is maintained within a range from the maximal permissive flow speed Vp (dependent upon the pressure loss) and the minimal flow speed Vq (required for forming a tube-shaped flame).

Figure 31A:
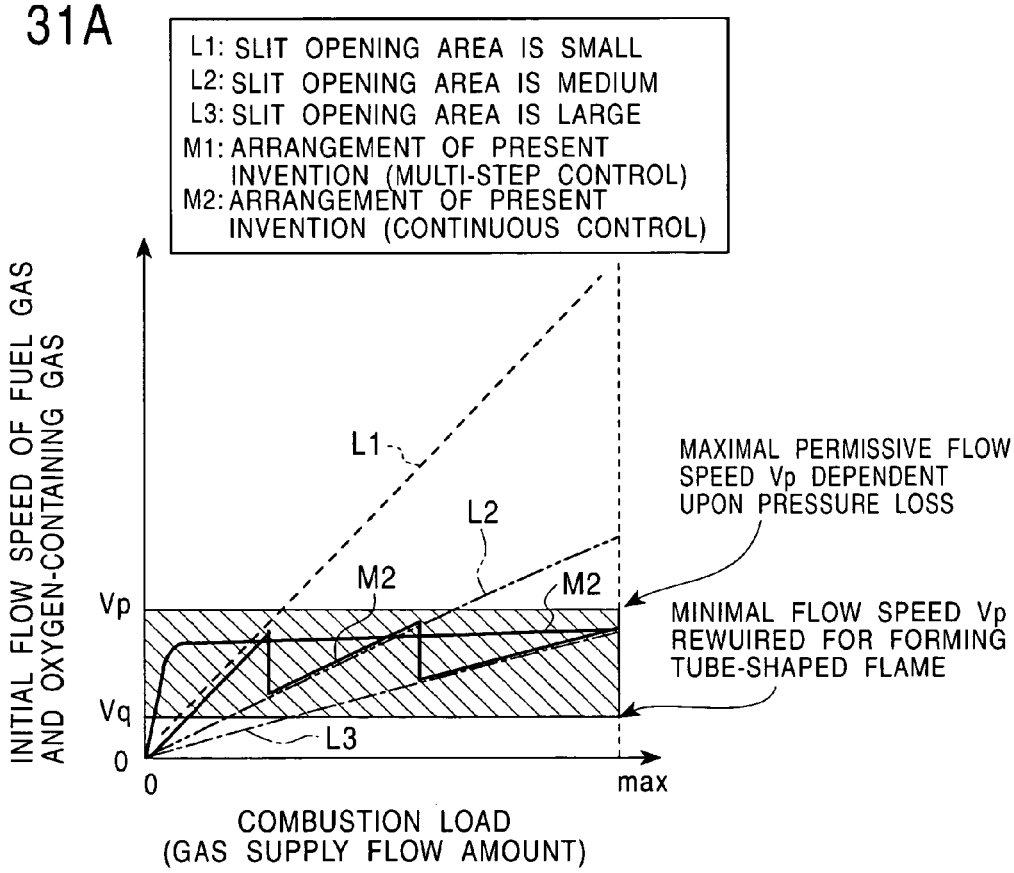
FIG. 31A is an explanatory diagram for describing a combustion control method according to an embodiment of the present invention.

Specifically, as shown by the line $L_1$ in FIG. 31A, when the apertures of the slits 512 reduces, the initial flow speed of the flow from the spraying nozzles 511*a* through 511*d* exhibits a rapid increase corresponding to the increased supply flow, i.e., the increased combustion load. As a result, while the flow speed rapidly reaches the minimal flow speed Vq (required for forming a tube-shaped flame), the flow speed rapidly exceeds the maximal permissive flow speed Vp(dependent upon the pressure loss).

On the other hand, when the apertures of the slits 512 somewhat increases, the initial flow speed of the flow from the spraying nozzles exhibits a relatively gentle increase thereof corresponding to the increased supply flow, i.e., the increased combustion load, as shown by the line $L_2$ in FIG. 31A. As a result, while the flow speed relatively slowly reaches the minimal flow speed Vq (required for forming a tube-shaped flame), the flow speed relatively slowly exceeds the maximal permissive flow speed Vp (dependent upon the pressure loss).

Furthermore, when the apertures of the slits 512 increases to the maximum, the initial flow speed of the flow from the spraying nozzles exhibits an extremely gentle increase thereof corresponding to the increased supply flow, i.e., the increased combustion load, as shown by the line L3 in FIG. 31A. As a result, while the flow speed considerably slowly reaches the minimal flow speed Vq (required for forming a tube-shaped flame), the flow speed considerably slowly exceeds the maximal permissive flow speed Vp (dependent upon the pressure loss).

In the present combustion control method, the supply controller 520 controls the angular position of the slit aperture adjusting ring 513, so as to adjust the apertures of the slits 512 such that the initial flow speed of the fuel gas. And the oxygen-containing-gas sprayed to the combustion chamber 510 is maintained in a range between the maximal permissive flow speed Vp (dependent upon the pressure loss) and the minimal flow speed (Vq required for forming a tube-shaped flame based upon the above-described relation).

Figure 31B:
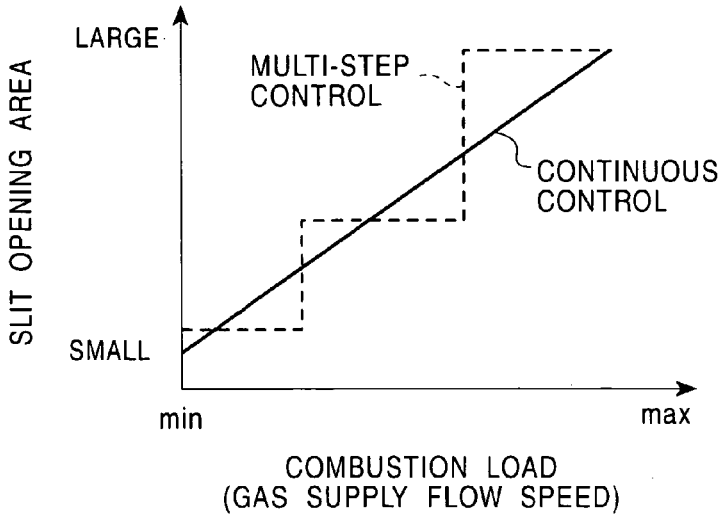
FIG. 31B is an explanatory diagram for describing a combustion control method according to an embodiment of the present invention.

Specifically, as shown in FIG. 31B, in case of a combustion load in a range between the predetermined minimal combustion load to approximately ⅓ of the predetermined maximal combustion load, the apertures of the slits 512 are reduced. In case of combustion load in a range between approximately ⅓ of the predetermined maximal combustion load to approximately ⅔ thereof, the apertures of the slits 512 somewhat increases. Furthermore, in case of a combustion load in a range between approximately ⅔ of the predetermined maximal combustion load to the predetermined maximal combustion load, the apertures of the slits 512 increases to the maximum, to perform combustion.

Thus, as shown by the line M1 in FIG. 31A, the initial flow speed from the spraying nozzles is maintained within a range from the maximal permissive flow speed Vp (dependent upon the pressure loss) and the minimal flow speed (Vq required for forming a tube-shaped flame), resulting in suppressing excessive pressure loss while maintaining the high speed of the flow required for forming a tube-shaped flame.

Description has been made regarding the method for controlling the combustion, wherein the apertures of the slits 512 are adjusted in a step-wise way, corresponding to the combustion load. But it may be a case, a combustion control is performed, wherein the apertures of the slits 512 are continuously adjusted corresponding to the combustion load as shown in FIG. 31B. In such a way, the initial flow speed from the spraying nozzles is maintained within a range from the maximal permissive flow speed Vp (dependent upon the pressure loss) to the minimal flow speed Vq (required for forming a tube-shaped flame) while maintaining a constant flow speed, as shown by the line $M_2$ in FIG. 31A.

Note that while description has been made in the present embodiment regarding the arrangement, wherein the fuel-gas spraying nozzles and the oxygen-containing-gas spraying nozzles are disposed so that each spraying direction is in a tangential direction of the inner circumferential wall of the combustion chamber. The arrangement of the present invention is not restricted to the aforementioned arrangement. Another arrangement may be made, wherein any spraying direction is not in a tangential direction of the inner circumferential wall of the combustion chamber as long as a swirl of the gas is formed within the combustion chamber.

Furthermore, description has been made in the present embodiment regarding the arrangement, wherein the slits serving as the nozzles for the combustion chamber are disposed along the tube axis, may be a case, that each slit is connected to the corresponding fuel-gas spraying nozzle or oxygen-containing-gas spraying nozzle. In such a case, the nozzle has been formed flat, an arrangement may be made wherein multiple small-sized openings are formed along the tube axis, and each of the fuel-gas spraying nozzles and the oxygen-containing-gas spraying nozzles are connected to the corresponding array formed of the small-sized openings.

Furthermore, description has been made in the present embodiment regarding the arrangement wherein the fuel gas is sprayed, another arrangement may be made wherein liquid fuel is sprayed. Note that liquid fuel which readily evaporate under relatively low temperature, such as kerosene, gas oil, alcohol, A-type heave oil, or the like, is suitably employed as the liquid fuel.

Furthermore, description has been made in the present embodiment regarding the arrangement wherein the fuel gas and the oxygen-containing-gas are separately sprayed, an arrangement may be made wherein a mixture gas formed by premixing the fuel gas and the oxygen-containing-gas is sprayed.

According to the present embodiment, the apertures of the nozzle orifices are adjusted so as to exhibit a predetermined flow speed. This is done, even in case of change in the supply flow of the fuel and the oxygen-containing-gas corresponding to change in the combustion load, thereby enabling stable combustion to be in a wider range of the combustion load.

Note that the tubular flame burner according to the present embodiment may also be formed with a polygonal cross-sectional shape rather than round one.

The invention claimed is:

1. A method for controlling combustion by a tubular flame burner comprising the steps of:

preparing a tubular combustion chamber having a front-end, a rear-end and an inner wall, wherein the front-end is open and for preparing a plurality of fuel-gas spraying nozzles and a plurality of oxygen-containing-gas spraying nozzles, the tubular combustion chamber having rectangular slits at the rear-end of the tubular combustion chamber, the rectangular slits being long in an axial direction and narrow in a radial direction, the fuel-spraying nozzles and oxygen-containing-gas spraying nozzles having a flat shape and being connected to the slits, wherein respective nozzle orifices of the fuel-gas spraying nozzles and the oxygen-containing-gas spraying nozzles face toward the inner wall of the combustion chamber, and wherein the fuel-gas spraying nozzles and the oxygen-containing-gas spraying nozzles of the combustion chamber are disposed along a circumferential direction;

connecting supply-lines to the nozzles and for providing Switching-valves to the supply-lines;

adjusting the fuel-gas spraying nozzles and the oxygen-containing-gas spraying nozzles so that each spraying is in a direction to produce a swirl of the sprayed fuel-gas and oxygen-containing-gas in the combustion chamber, to control the combustion; and controlling on/off of the switching valves, such that an initial spraying speed of the fuel gas and the oxygen-containinq-gas sprayed into the combustion chamber in accordance with a combustion load is controlled to be within a range between a maximal permissive speed (Vp) dependent upon the pressure loss and a minimal spraying speed (Vq) required for forming a tubular flame, so that the spraying speed from the nozzles is maintained within a predetermined range in accordance with the combustion load of the tubular flame burner.

2. The method according to claim 1, wherein said controlling on/off of the switching valves comprises: determining the number of nozzles used for spraying the fuel gas and the oxygen containing gas into the combustion chamber according to the combustion load.

3. A method for controlling combustion by a tubular flame burner comprising the steps of:

preparing a tubular combustion chamber having a front-end, a rear-end and an inner wall, wherein the front-end is open and preparing a plurality of premixed spraying nozzles to spray a premixed gas formed of a fuel-gas and an oxygen-containing gas wherein the tubular combustion chamber having rectangular slits at the rear-end of the tubular combustion chamber, the rectangular slits are long in an axial direction and narrow in a radial direction, the nozzles have a flat shape and are connected to the slits, respective nozzle orifices of the nozzles face toward the inner wall of the combustion chamber, and the premixed gas spraying nozzles are disposed along a circumferential direction;

connecting supply-lines to the nozzles, and providing switching valves to the supply-lines;

adjusting the respective spraying directions of the nozzles to be in a direction to produce a swirl of the premixed gas in the combustion chamber, to control combustion;

controlling on/off of the switching valves, such that an initial spraying speed of the premixed gas sprayed into the combustion chamber in accordance with a combustion load is controlled to be within a range between a maximal permissive speed (Vp) dependent upon a pressure loss and a minimal spraying speed (Vq) required for forming a tubular flame, so that the spraying speed from the nozzles is maintained within a predetermined range corresponding to the combustion load of tubular flame burner.

4. The method according to claim 3, wherein said controlling on/off of the switching valves comprises: determining the number of nozzles used for spraying the premixed gas into the combustion chamber according to the combustion load.

5. A method for controlling combustion by a tubular flame burner comprising the steps of:

preparing a tubular combustion chamber having a front-end, a rear-end and an inner all, wherein the front-end is open, and preparing a plurality of fuel spraying nozzles and a plurality of oxygen-containing-gas spraying nozzles, wherein the tubular combustion chamber having rectangular slits at the rear-end of the tubular combustion chamber, the rectangular slits are long in an axial direction and narrow in a radial direction, the nozzles have a flat shape are connected to the slits and respective nozzle orifices of the fuel-gas spraying nozzles and the oxygen-containing-gas spraying nozzles face the inner wall of the combustion chamber;

connecting supply-lines to the nozzles, and providing switching valves to the supply-lines;

adjusting respective directions of the fuel-gas spraying nozzles and the oxygen-containing-gas spraying nozzles to be in a direction to produce a swirl of the fuel-gas and oxygen containing gases on the combustion chamber, to control combustion;

controlling on/off of the switching valves, such that an initial spraying speed of the fuel gas and the oxygen containing gas sprayed into the combustion chamber in accordance with a combustion load is controlled to be within a range between a maximal permissive speed (Vp) dependent upon a pressure loss and a minimal spraying speed (Vq) required for forming a tubular flame, so that the spraying speed from the nozzles is maintained within a predetermined range corresponding to the combustion load of the tubular flame burner; and adjusting an aperture area of the nozzle orifices so that the spraying speed from the nozzles is maintained within a predetermined range corresponding to the combustion load of the tubular flame burner, by adjusting means for adjusting the aperture area of the nozzle orifices.

6. The method according to claim 5, wherein said controlling on/off of the switching valves comprises: determining the number of nozzles used for spraying the fuel gas and the oxygen containing gas into the combustion chamber according to the combustion load.

7. A method for controlling combustion by a tubular flame burner comprising:

preparing a tubular combustion chamber having a front-end, a rear end and an inner wall, wherein the front-end is open and preparing a plurality of nozzles to spray a premixed gas formed of a fuel-gas and an oxygen-containing-gas, wherein the tubular combustion chamber having rectangular slits at the rear-end of the tubular combustion chamber, the rectangular slits are long in an axial direction and narrow in a radial direction, the nozzles have a flat shape and are connected to the slits and respective nozzle orifices of the premixed gas spraying nozzles face the inner wall of the combustion chamber;

connecting supply-lines to the nozzles, and providing switching valves to the supply lines;

adjusting respective spraying directions of the nozzles to be in a direction to produce a swirl of the premixed gas in the combustion chamber, to control combustion;

controlling on/off of said switching valves, such that an initial spraying speed of the premixed gas sprayed into the combustion chamber in accordance with a combustion load is controlled to be within a range between a maximal permissive speed (Vp) dependent upon a pressure loss and a minimal spraying speed (Vq) required for forming a tubular flame, so that the spraying speed from the nozzles is maintained within a predetermined range corresponding to the combustion load of the tubular flame burner; and adjusting an aperture area of the nozzle orifices so chat the spraying speed from the nozzles is maintained within a predetermined range corresponding to the combustion load of the tubular flame burner, by adjusting means for adjusting the aperture area of the nozzle orifices.

8. The method according to claim 7, wherein said controlling on/off of the switching valves comprises: determining the number of nozzles used for spraying the premixed gas into the combustion chamber according to the combustion load.

9. A combustion controller for a tubular flame burner comprising:

a tubular combustion chamber having a front-end and a rear-end, wherein the front-end is open, the tubular combustion chamber having rectangular slits at the rear-end of the tubular combustion chamber, the rectanqular slits being long in the axial direction and narrow in the radial direction; and, a plurality of fuel-gas spraying nozzles and a plurality of oxygen-containing-gas spraying nozzles, the fuel-gas spraying nozzles and the oxygen-containing-gas spraying nozzles having a flat shape and being connected to the slits; wherein respective orifices of the gas spraying nozzles and the oxygen-containing-gas spraying nozzles face toward an inner surface of the combustion chamber, so as to spray a fuel-gas and an oxygen-containing-gas in a direction to produce a swirl of the fuel-gas and oxygen-containing-gas in the combustion chamber, and wherein the fuel-gas spraying nozzles and the oxygen-containing-gas spraying nozzles are disposed along a circumferential direction;

switching valves disposed on supply-lines, wherein the supply valves are connected to the fuel-gas spraying nozzles and the oxygen-containing-gas spraying nozzles included in the tubular flame burner; and control means for controlling on/off of the switching valves, such that an initial spraying speed of the fuel gas and the oxygen-containing-gas sprayed into the combustion chamber in accordance with a combustion load is controlled to be within a range between a maximal permissive speed (Vp) dependent upon a pressure loss and a minimal spraying speed (Vg) required for forming a tubular flame, so that the spraying speed from the nozzles is maintained within a predetermined range in accordance with the combustion load of the tubular flame burner.

10. The combustion controller for a tubular flame burner according to claim 9, wherein the positions of the fuel-gas spraying nozzles and the oxygen-containing-gas spraying nozzles in the inner wall surfaces and the wall of the combustion chamber coincide.

11. The combustion controller according to claim 9, wherein said control means for controlling on/off of the switching valves comprises: determination means for determining the number of nozzles used for spraying the fuel gas and the oxygen containing gas into the combustion chamber according to the combustion load.

12. A combustion controller for a tubular flame burner comprising:

a tubular flame burner, the tubular flame burner comprising:

a tubular combustion chamber having a front-end and a rear-end, wherein the front-end is open; the tubular combustion chamber having rectangular slits at the rear-end of the tubular combustion chamber, the rectangular slits being long in the axial direction and narrow in the radial direction; and, a plurality of premixed gas spraying nozzles, the premixed gas spraying nozzles having a flat shape and being connected to the slits wherein respective orifices of the premixed gas spraying nozzles face toward an inner surface of the combustion chamber, so as to spray a premixed gas formed of a fuel-gas and an oxygen-containing-gas in a direction to produce a swirl of the premixed gas in the combustion chamber, and wherein the premixed gas spraying nozzles are disposed along;

switching valves disposed on supply-lines, wherein the supply-lines are connected to the premixed gas spraying nozzles; and control means for controlling on/off of the switching valves, such that an initial spraying speed of the premixed gas sprayed into the combustion chamber in accordance with the combustion load is controlled to be within a range between a maximal permissive speed (Vp) dependent upon a pressure loss and a minimal spraying speed (Vq) required for forming a tubular flame, so that the spraying speed from the nozzles is maintained within a predetermined range in accordance with the combustion load of the tubular flame burner.

13. The combustion controller for a tubular flame burner according to claim 12, wherein the positions of the premixed gas spraying nozzles and the oxygen-containing-gas spraying nozzles in the inner wall surfaces and the wall of the combustion chamber coincide.

14. The combustion controller according to claim 12, wherein said control means for controlling on/off of the switching valves comprises: determination means for determining the number of nozzles used for spraying the premixed gas into the combustion chamber according to the combustion load.

15. A combustion controller for a tubular flame burner comprising:

a tubular combustion chamber, the tubular flame burner comprising:

a tubular combustion chamber having a front-end and a rear-end, wherein the front-end is open, the tubular combustion chamber having rectangular slits at the rear-end of the tubular combustion chamber, the rectangular slits being long in an axial direction and narrow in a radial direction; and, a plurality of fuel-gas spraying nozzles and a plurality of oxygen-containing-gas spraying nozzles, the nozzles having a flat shape and being connected to the slits, wherein respective orifices of the fuel-gas spraying nozzles and the oxygen-containing-gas spraying nozzles face toward an inner surface of the combustion chamber, so as to spray the fuel-gas and the oxygen-containing-gas in a direction to produce a swirl of the fuel-gas and oxygen-containing-gas in the combustion chamber;

switching valves disposed on supply-lines, wherein the supply-lines are connected to the fuel-gas spraying nozzles and the oxygen-containing-gas spraying nozzles;

control means for controlling on/off of the switching Valves, such that an initial spraying speed of the fuel gas and the oxygen containing gas sprayed into the combustion chamber in accordance with the combustion load is controlled to be within a range between a maximal permissive speed (Vp) dependent upon a pressure loss and a minimal speed (Vq) required for forming a tubular flame, so that the spraying speed from the nozzles is maintained in a predetermined range in accordance with the combustion load of the tubular flame burner;

adjusting means for adjusting an aperture area of each nozzle orifice; and control means for controlling the aperture area of each nozzle orifice so that the spraying speed from the nozzles is maintained within a predetermined range corresponding to the combustion load of the tubular flame burner, by the adjusting means.

16. The combustion controller for a tubular flame burner according to claim 15, wherein the positions of the fuel-gas spraying nozzles and the oxygen-containing-gas spraying nozzles in the inner wall surfaces and the wall of the combustion chamber coincide.

17. The combustion controller according to claim 15, wherein said control means for controlling on/off of the switching valves comprises: determination means for determining the number of nozzles used for spraying the fuel gas and the oxygen containing gas into the combustion chamber according to the combustion load.

18. A combustion controller for a tubular flame burner comprising:

a tubular flame burner, the tubular flame burner comprising:

a tubular combustion chamber having a front-end and a rear-end, wherein the front-end is open, the tubular combustion chamber having rectangular slits at the rear-end of the tubular combustion chamber, the rectangular slits being long in an axial direction and narrow in a radial direction; and, a plurality of premixed gas spraying nozzles, the premixed gas spraying nozzles having a flat shape and being connected to the slits, wherein respective orifices of the premixed gas spraying nozzles face toward an inner surface of the combustion chamber, so as to spray a pre-mixed gas formed of the fuel-gas and the oxygen-containing-gas, in a direction to produce a swirl of the pre-mixed gas in the combustion chamber;

switching valves disposed on supply-lines, wherein the supply-lines are connected to the premixed gas spraying nozzles;

control means for controlling on/off of the switching valves, such that an initial spraying speed of the premixed gas sprayed into the combustion chamber in accordance with a combustion load is controlled to be within a range between a maximal permissive speed (Vp) dependent upon a pressure loss and a minimal spraying speed (Vq) required for forming a tubular flame, so that the spraying speed from the nozzles is maintained within a predetermined range in accordance with the combustion load of the tubular flame burner;

adjusting means for adjusting an aperture area of each nozzle orifice; and, control means for controlling the aperture area of the each nozzle orifice so that the spraying speed from the nozzles is maintained in a predetermined range in accordance with the combustion load of the tubular flame burner, by the adjusting means.

19. The combustion controller for a tubular flame burner according to claim 18, wherein the positions of the premixed gas spraying nozzles and the oxygen-containing-gas spraying nozzles in the inner wall surfaces and the wall of the combustion chamber coincide.

20. The combustion controller according to claim 18, wherein said control means for controlling on/off of the switching valves comprises: determination means for determining the number of nozzles used for spraying the premised gas into the combustion chamber according to the combustion load.

* * * * *

UNITED STATES PATENT AND TRADEMARK OFFICE

CERTIFICATE OF CORRECTION

PATENT NO. : 7,654,819 B2
APPLICATION NO. : 10/514668
DATED : February 2, 2010
INVENTOR(S) : Okada et al.

It is certified that error appears in the above-identified patent and that said Letters Patent is hereby corrected as shown below:

Title page, item (75) Inventors: Delete "Tatsuya Shimada, Kanagawa (JP);" "Koichi Takashi, Kanagawa (JP);" "Yoshiki Fujii, Kanagawa (JP);" and "Takamitsu Kusada, Kanagawa (JP)".

Signed and Sealed this

Twenty-first Day of December, 2010

David J. Kappos

David J. Kappos
*Director of the United States Patent and Trademark Office*